US005477235A

United States Patent [19]

Numao

[11] Patent Number: 5,477,235

[45] Date of Patent: Dec. 19, 1995

[54] METHOD FOR DRIVING A FERROELECTRIC LIQUID CRYSTAL PANEL

[75] Inventor: Takaji Numao, Nara, Japan

[73] Assignee: Sharp Kabushiki Kaisha, Osaka, Japan

[21] Appl. No.: 132,693

[22] Filed: Oct. 6, 1993

[30] Foreign Application Priority Data

Oct. 8, 1992 [JP] Japan ..... 4-270286

[51] Int. Cl.[6] ..... G09G 3/36

[52] U.S. Cl. ..... 345/97; 345/94

[58] Field of Search ..... 345/94, 95, 97, 345/87; 348/409

[56] References Cited

U.S. PATENT DOCUMENTS

| | | | |
|---|---|---|---|
| 4,597,010 | 6/1986 | Carr | 348/409 |
| 4,709,995 | 12/1987 | Kuribayashi | 345/97 |
| 5,092,665 | 3/1992 | Kanbe et al. | 359/56 |

FOREIGN PATENT DOCUMENTS

| | | | |
|---|---|---|---|
| 0478382 | 4/1992 | European Pat. Off. . | |
| 62-175714 | 8/1987 | Japan . | |
| 63-229430 | 9/1988 | Japan . | |
| 2-96118 | 4/1990 | Japan . | |
| 3-192214 | 8/1991 | Japan | 345/94 |
| 4-134420 | 5/1992 | Japan . | |

OTHER PUBLICATIONS

Ruckmongathan, T. N. "A Generalized Addressing Technique for RMS Responding Matrix LCD's" 1988 IDR Conference pp. 80–85.

*Primary Examiner*—Curtis Kuntz
*Assistant Examiner*—Vivian W. Chang
*Attorney, Agent, or Firm*—David G. Conlin; Kevin J. Fournier

[57] ABSTRACT

A method for driving a ferroelectric liquid crystal panel in which a ferroelectric liquid crystal is disposed between a plurality of scanning and signal electrodes, and a select or a non-select voltage is applied to the scanning electrode whereas a rewriting or a holding voltage is applied to the signal electrode to change the display of each pixel, the method including: dividing all the scanning electrodes into a plurality of groups composed of a plurality of scanning electrodes; selecting a group whose display is to be changed; applying the select voltage to the scanning electrodes of the selected group at once; applying the rewriting voltage to the signal electrodes corresponding to the pixels whose displays are to be changed; applying the select voltage to each scanning electrode of the selected group successively; and applying the rewriting voltage to the signal electrodes corresponding to the pixels whose liquid crystal is to be placed in a second stable state.

4 Claims, 44 Drawing Sheets

METHOD FOR DRIVING A FERROELECTRIC LIQUID CRYSTAL PANEL

BACKGROUND OF THE INVENTION

1. Field of the Invention

The present invention relates to methods for driving liquid crystal panels, and more particularly to a method for driving a ferroelectric liquid crystal panel (hereinafter referred to as FLC).

2. Description of the Related Art

FIG. 2 is a sectional view showing a general construction of a FLC panel. Two glass substrates 5*a* and 5*b* are located opposite to each other. On the surface of one of the glass substrates 5*a* are located in parallel to each other a plurality of transparent signal electrodes S formed of indium tin oxide (hereinafter abbreviated as ITO). The plurality of signal electrodes are coated with a transparent insulating film 6*a* formed of $SiO_2$ or the like. On the surface of the other glass substrate 5*b* located opposite to the signal electrodes S are located in parallel to each other a plurality of transparent scanning electrodes L formed of ITO or the like in the direction of crossing at right angle with the signal electrodes S. The plurality of scanning electrodes L are coated with a transparent insulating film 6*b*. On each insulating film 6*a* and 6*b* are respectively formed transparent orientation films 7*a* and 7*b* formed of polyvinyl alcohol or the like (hereinafter abbreviated as PVA) subjected to rubbing treatment. Two glass substrates 5*a* and 5*b* are laminated to each other with a sealing agent 8 with an injection port retained on part thereof. After FLC 9 are introduced into a space sandwiched between orientation films 7*a* and 7*b* from the injection port with vacuum injection, the above injection port is sealed with a sealing agent 8. Two glass substrates 5*a* and 5*b* thus laminated to each other are sandwiched between two polarizing plates 10*a* and 10*b* located in such a manner that the polarizing axes thereof run at right angle to each other.

FIG. 3 is a plane view showing a general construction of a FLC display (hereinafter referred to as FLCD) 4 wherein a scanning side driving circuit 11 is connected to the scanning electrodes L of the FLC panel 1 whereas a signal side driving circuit 1 is connected to the signal electrodes S of the FLC panel 1. There is shown in FIG. 3, for simplicity, a display composed of 16 scanning electrodes L and 16 signal electrodes, or a FLCD 4 composed of 16×16 pixels. Each of the scanning electrodes L are classified by adding a subscript i (i=0 through F) whereas each of the signal electrodes are classified by adding a subscript j (j=o through F). In the foregoing passage a pixel formed in a portion formed by any scanning electrode Li and any signal electrode $S_j$ which runs perpendicular to each other is designated by symbol $A_{ij}$.

The scanning side driving circuit 11 serves as a circuit for applying a voltage to the scanning electrodes L. The circuit 11 comprises an address decoder, a latch, and a analog switch array all not shown in the drawings. The circuit 11 applies a select voltage $V_{c1}$ to a scanning electrode Li corresponding to a designated address $A_x$. On the other hand, the signal side driving circuit 12 serves as a circuit for applying a voltage to the signal electrodes S. The circuit 12 comprises a shift register, a latch and an analog switch array not shown in the drawings. The input data DATA applies an active voltage $V_{s1}$ to a signal electrode S corresponding to "1" whereas input data DATA applies a non-active voltage $V_{so}$ to a signal electrode S corresponding to "0".

A FLC molecule 101 carries a spontaneous polarization $P_s$ in the direction perpendicular to the longitudinal axis of the molecule as shown in FIG. 10(B). The molecule receives force proportional to the vector product of an electric field E and the spontaneous polarization, the electric field E being created by the potential difference between the scanning electrodes L and the signal electrodes S. The molecule travels on the surface of a cone 102 having an angle 20 where θ is the tilt angle of the FLC. The molecule 101 has two stable states 104 and 105 as shown in FIG. 10(A). The feature of the molecule 101 is that when it is moved by the electric field E to reach an axis 107 the molecule 101 assumes a stable state 104 whereas when it is moved by the electric field E to reach an axis 106 the molecule 101 assumes the stable state 105. In addition, the molecule 101 receives a resilient force that allows the molecule 101 to return to the original position even if it is moved by the electric field E. Then by setting one of the polarizing plates 10*a* and 10*b* to either the is 104 or the axis 105, a pixel composed of FLC molecules in one stable state exhibits a dark state whereas a pixel composed of molecules in another stable state exhibits a bright state. Incidentally, by setting one of the polarizing axis 104 or 105 either to the axis 10A or 10B, a fair display can be given even if the polarizing plates 10*a* and 10*b* are not necessarily allowed to run at right angle to each other.

As a method for driving a FLCD used so far is a combination of voltage waveforms shown in FIG. 11A and FIG. 11B (refer to Japanese Laid-Open Patent No. HEI 4 (1992)-134420).

Reference Numeral (1) in FIG. 11A designates a waveform of a select voltage $V_{CA}$ applied to a scanning electrode $L_i$ to rewrite a pixel $A_{ij}$ on the scanning electrodes to a dark display state. On the other hand, Reference Numeral (2) in FIG. 11A designates a waveform of a non-select voltage $V_{CB}$ applied to the other scanning electrodes $L_k$ (k=i) to prevent rewriting a display state of a pixel $A_{kj}$ on the scanning electrode. Reference Numeral (3) in FIG. 11A designates a waveform of a rewriting voltage $V_{SC}$ applied to a signal electrode $S_j$ to rewrite a display state of a pixel $A_{ij}$ to a dark display state. Reference Numeral (4) in FIG. 11A designates a holding voltage $V_{SG}$ applied to the signal electrode $S_j$ to prevent rewriting the display state of the pixel $A_{ij}$ on the scanning electrode $L_i$ to which the select voltage $V_{CA}$ is applied. Reference Numerals (5) through (8) in FIG. 11A designate a waveform of a, voltage actually applied to pixels. Out of them, the waveform shown by (5) in FIG. 11A is the voltage waveform A-C applied to a pixel $A_{ij}$ when the select voltage $V_{CA}$ is applied to the scanning electrode $L_i$ and the rewriting voltage $V_{sc}$ is applied to the signal electrode $S_j$. The waveform shown by (6) in FIG. 11A is a voltage waveform A-G applied to the pixel $A_{ij}$ when the select voltage $V_{CA}$ is applied to the scanning electrode $L_i$ and the holding voltage $V_{SG}$ is applied to the signal electrode $S_j$. The waveform shownby (7) in FIG. 11A is a voltage waveform B-C applied to the pixel $A_{kj}$ when the non-select voltage $V_{CB}$ is applied to the scanning electrode $L_k$ and the rewriting voltage $V_{SC}$ is applied to the signal electrode $S_j$. The waveform shown by (8) in FIG. 11A is a voltage waveform B-G when the non-select voltage $V_{CB}$ is applied to the scanning electrode $L_k$ and the holding voltage $V_{SG}$ is applied to the signal electrode $S_j$.

In addition, the waveform shown by (1) in FIG. 11B is a select voltage $V_{CE}$ applied to the scanning electrode $L_i$ to rewrite the display state of the pixel $A_{ij}$ to a bright display state. The waveform shown by (2) in FIG. 11B is a non-select voltage $V_{CH}$ applied to other scanning electrode $L_k$(k=i) to prevent rewriting the display state of the pixel $A_{kj}$ on the scanning electrode. The waveform shown by (3) in FIG. 11B is a rewriting voltage $V_{SD}$ applied to the signal electrode $S_j$ to rewrite to a bright display state the display state of the pixel $A_{ij}$ on the scanning electrode $L_i$ to which the select voltage $V_{CE}$ is applied. The waveform shown by (4) in FIG. 11B is a holding voltage $V_{SH}$ applied to the signal electrode $S_j$ to prevent rewriting the display state of the pixel $A_{ij}$ on the scanning electrode $L_i$ to which the select voltage $V_{CE}$ is applied. The waveforms shown by (5) through (8) in FIG. 11B designates a waveform of a voltage actually applied to a pixel. Out of such waveforms, the waveform shown by (5) in FIG. 11B is a voltage waveform E-D applied to a pixel $A_{ij}$ when the select voltage $V_{CE}$ is applied to the scanning electrode $L_i$ and the rewriting voltage $V_{SD}$ is applied to the signal electrode $S_j$. The voltage waveform shown by (6) in FIG. 11B is a voltage waveform E-H applied to a pixel when the select voltage $V_{CE}$ is applied to the scanning electrode $L_i$ and the holding voltage $V_{SH}$ is applied to the signal electrode $S_j$. The waveform shown by (7) in FIG. 11B is a voltage waveform FD applied to the pixel when the non-select voltage VCF is applied to the scanning electrode $L_k$ and the rewriting voltage $V_{SD}$ is applied to the signal electrode $S_j$. The waveform shown by (8) in FIG. 11B is a voltage waveform F-H applied to the pixel $A_{ij}$ when the non-select voltage $V_{CF}$ is applied to the scanning electrode $L_k$ and the non-select voltage $V_{SF}$ is applied to the scanning electrode $L_k$ and the holding voltage $V_{SH}$ is applied to the signal electrode $S_j$.

The above method for driving FLCD panel detects the difference between a state currently displayed on the FLCD and a state that should be displayed on the FLCD in the subsequent step to make distinct the following three cases;

1) a case in which the pixel changes from a dark display state to a bright display state, 2) a case in which the pixel changes from a bright display state to a dark display state, and 3) a case in which the display of the pixel does not change.

In case 1), the voltage waveform A-G shown by (6) in FIG. 11A and the voltage waveform E-D shown by (5) in FIG. 11B are applied to the pixel when selecting the display state. In case 2) the voltage waveform A-C shown by (5) in FIG. 11A and the voltage waveform E-H shown by (6) in FIG. 11B are applied to pixels when selecting the display state. In case 3), the voltage waveform A-G shown by (6) in FIG. 1A and the voltage waveform E-H shown by (6) in FIG. 11B are applied to pixels when selecting the display state.

A display control device using this driving method is the display control device 13 shown in FIG. 12.

In this display device 13, data to be displayed in the FLCD is made of a digital RGB signal (attached with clocking) transmitted from a personal computer shown in FIG. 1 to a CRT display 3. This digital RGB signal comprises a horizontal synchronous signal HD that generates a cycle between one horizontal scanning section of image data to be output to the display 3 shown by (1) in FIG. 4 and by (4) in FIG. 4, one vertical synchronous signal VD, a display data Data that constitutes data of the image, and a clock CLK for transmitting data. Incidentally, referring to 3) in FIG. 4, display data Data is classified by adding subscripts in each one horizontal scanning section. On the other hand, referring to (5) in FIG. 4 each pixel is classified by adding a number to each pixel.

This digital signal carries data only for 8×8 pixels. However, the FLCD can display 16×16 pixels just because 16×16 pixels on the FLCD are hypothetically divided into four display parts; display part $P_0$ comprising scanning electrodes $L_0$ through $L_7$ and signal electrodes $S_0$ through $S_7$, display part $P_1$ comprising scanning electrodes $L_0$ through $L_7$ and signal electrodes $S_8$ through $S_F$, and display part $P_2$ comprising scanning electrodes $L_8$ through $L_F$ and signal electrodes $S_0$ through $S_7$, and a display part $P_3$ comprising scanning electrodes $L_8$ through $L_F$ and signal electrodes $S_8$ through $S_8$ through $S_F$; and data in the 0th horizontal scanning sections designates which display parts $P_0$ through $P_3$ data in the 1st to the 8th horizontal scanning sections correspond to.

In other words, referring to FIGS. 5 and 6, when the 3rd data in the 0th horizontal scanning section assume a "bright" state (data without slanted lines) and the 7th data also assume a "bright" state (corresponding to FIG. 5) data in the following 1st to 8th horizontal scanning section correspond to display part $P_0$. When the 3rd data in the 0th horizontal scanning section assume a "bright" state and the 7th data assume a "dark" state (data with slanted line), data in the following 1st to 8th horizontal scanning section correspond to display part $P_1$. When the 3rd data in the 0th horizontal scanning section assume a "dark" state and the 7th data assume a "bright" state (corresponding to FIG. 6), data in the following 1st to 8th horizontal scanning section correspond to display part $P_2$. When the 3rd data in the 0th horizontal scanning section assume a "dark" state and when the 7th data assume a "dark" state, data in the following 1st to 8th horizontal scanning section correspond to display part $P_3$.

The construction of the display control device 13 is shown in a block diagram in FIG. 12. At the outset, the digital RGB signal output from the personal computer 2 is received at an interface circuit 13 and the signal is distributed to an input control circuit 18 and a display memory circuit 15.

The display memory circuit 15 records "ABCD" data already described in the FLCD 4 and shown in FIG. 3. Entering "E" display data Data shown in FIG. 5 allows recording "EBCD" data shown in FIG. 7. Besides, data variation in the memory circuit 15 at this point is shown in FIG. 8 in every pixel. Data variation in the display memory circuit 15 is grouped together in every two pixels (when a variation occurs in one pixel, it is recognized as a variation in the whole group of pixels) to be output to a group memory circuit 16 and a identity/non-identity circuit 17 as a transition data IDF.

In the group memory circuit 16, scanning electrodes $L_0$, $L_1$ correspond to group $G_o$, electrodes $L_2$ and $L_3$ to group $G_1$ and so on,—and scanning electrodes $L_E$, $L_F$ correspond to group $G_7$. When one of the transition data IDF corresponding to the group thereof assumes "1" (indicating the presence of variation), the identification data GDF corresponding to the group assumes "1" (indicating the presence of variation). When all the transition data IDF corresponding to the group assumes "0" (indicating the absence of variation), the identification data GDF corresponding to the group remain unchanged. In addition, the identification data GDF corresponding to the transition data IDF is output to the identity/non-identity memory circuit 17 as group transition data IGDF.

The identity/non-identity memory circuit 17 records as one data item four pixels in the vertical and horizontal directions of electrodes. The logical product of data recorded in correspondence to the transition data IDF and the group transition data IGDF and the logical addition of the transition data IDF corresponding to the data are recorded in a summarized form as shown in FIG. 9 (When there is a variation in any of the logical addition of four pixels, the presence of transition is recorded).

The input control circuit 18 controls the above input behavior.

In addition, the output control circuit 19 outputs a group address $OAG_x$ through an address shift-over circuit 20 to a group memory circuit 16, and receives the corresponding identification data GDF as an output identification data OGDF. When the data assumes "1" (indicating the presence of variation), the scanning electrode corresponding to the group is to be driven for partial rewriting operation. When the data assumes "0" (indicating absence of variation), the output control circuit 19 receives the output identification data OGDF in the following group.

Data DA is entered to a driving control circuit 21 from the display memory circuit 15. From the group memory circuit 16 are entered data RGDF and DGDF to the driving control circuit 21. From the identity/non-identity circuit 17 is entered data DF. In addition, from the output control circuit 19 is entered an address $OAC_x$ through the address shift-over circuit 20. Upon receipt of this data, the driving control circuit 21 outputs an address signal $A_x$ for controlling the behavior of the FLCD 4, the display data DATA, transfer clock XCLK, a timing signal. YCLK, LP, and driving voltage $V_{C0}$, $V_{C1}$, $V_{S0}$ and $V_{S1}$.

FIGS. 13 and 14 are a timing chart for illustrating a concrete behavior of this display control device 13. Reference Numeral (1) in FIG. 13 and (1) in FIG. 14 designate a horizontal synchronous pulse HP, which assumes "0" (low level in the FIG. 13 and 14) in each one select period $4t_0$. Reference Numeral (3) in FIG. 13 and (3) in FIG. 14 designate a driving mode H/R. Numeric value "1" (a high level in FIG. 13 and FIG. 14) designates a partial rewriting operation driving whereas numeric value "0" (a low level in FIG. 13 and 14) designates an interlace driving. Consequently, after one scanning electrode is subjected to interlaced driving, two scanning electrodes are partially rewritten and driven. Reference Numeral (2) in FIG. 13 and (2) in FIG. 14 designate an address $DAC_0$ which becomes effective when the driving mode H/R assumes "1" namely in the partial rewriting driving and which is used for classifying two scanning electrodes in the group. Reference Numeral (4) in FIG. 13 and (4) in FIG. 14 designate a voltage mode E/W for changing over a combination of voltage waveforms shown in FIG. 11A and a combination of voltage waveforms shown in FIG. 11B by combining with the driving mode H/R. Reference Numeral (5) in FIG. 13 and 5) in FIG. 14 designate an address $RAC_x$ showing a scanning electrode that becomes effective in the interlaced driving. The address $RAC_x$ is reflected in the address $OAC_x$ shown by (8) in; FIG. 13 and by (8) in FIG. 14 during time 0 to $4t_0$ and time $12t_0$ to $16t_0$. Reference Numeral (6) in FIG. 13 and 6) in FIG. 14 designate an address $DAC_x$ for inspecting whether or not there is any variation in the output identification data OGDF corresponding to each group. Reference Numeral (7) in FIG. 13 and (7) in FIG. 14 is reflected on an address $OAG_x$ output to the group memory circuit 16 through the address shift-over circuit 20. Reference Numeral (8) in FIG. 13 and (8) in FIG. 14 designate an address $OAC_x$ output to the display memory circuit 15, the identity/non-identity circuit 17 and a driving memory circuit 21. For example, after an address "2" is output for interlaced driving during $12t_0$ to $16t_0$, addresses "0" and "1" for partial rewriting driving are output.

The behavior of this display control device 13 will be detailed hereinbelow in conjunction with FIGS. 13 and 14. In time t=0 through $4t_0$, the output control circuit 19 and the address shift-over circuit 20 allows the display memory circuit 15 and the identity/non-identity circuit 17 to output display data DA and the transition data DF corresponding to the scanning electrode $L_0$. The address shift-over circuit 20 outputs an address OAC="D" to the driving control circuit 21. The output control circuit 19 outputs the driving mode H/R="0" and the voltage mode E/W="1" to the driving control circuit 21. Additionally, the output control circuit 19 and the address shift-over circuit 20 confirms the output identification data OGDF in groups $G_4$ through $G_6$ of the group memory circuit 16.

In the meantime, the input control circuit 18 transforms record data in the display memory circuit 15 from the "ABCD" state shown in FIG. 3 into the "EBCD state. The record data in the identity/non-identity memory circuit 17 is all transformed from the state of no variation to the state with the presence of variation having slanted lines. The identification data GDF in the group memory circuit 16 is transformed from the state of no variation to the state with variation in groups $G_0$ through $G_3$. In the subsequent process, record data in the display memory circuit 15 is kept in the "EBCD" state shown in FIG. 7.

In time $t=4t_0$ through $8t_0$, the output control circuit 19 and the address shift-over circuit 20 allows the display memory circuit 15 and the identity/non-identity memory circuit 17 to output the display data DA and the transition data DF to the driving control circuit 21. The address shift-over circuit 20 outputs an address OAC="A" to the driving control circuit 21. The output control circuit, 19 outputs a driving mode H/R="1" and a voltage mode E/W="1" to the driving control circuit 21. At the same time, the output control circuit 19 and the address shift-over circuit 20 confirms the output identification data OGDF of group $G_7$ and $G_0$ in the group memory circuit 16. Since data in group $G_0$ shows the presence of variation, the confirmation of the output identification data OGDF is suspended. This helps to partially rewrite and drive scanning electrodes $L_0$ and $L_1$ corresponding to group $G_0$.

In time $t=8t_0$ to $12t_0$, the output control circuit 19 and the address shift-over circuit 20 allows the display memory circuit 15 and the identity/non-identity memory circuit 17 to output the display data DA corresponding to the scanning electrode $L_B$ and the transition data DF to the driving control circuit 21. The address shift-over circuit 20 outputs the address OAC="B" to the driving control circuit 21. The output control circuit 19 outputs the driving mode H/R="1" and the voltages mode E/W="1" to the driving control circuit 21.

In time $t=12t_0$ to $16t_0$, the output control circuit 19 and the address shift-over circuit 20 allows the display memory circuit 15 and the identity/non-identity memory circuit 17 to output the display data DA corresponding to scanning electrode $L_2$ and the transition data DF to the driving control circuit 21. The address shift-over circuit 20 outputs the address OAC="2" to the driving control circuit 21. The output control circuit 19 outputs the driving mode H/R="0" and the voltage mode E/W="0" to the driving control circuit 21. At the same time, the output control circuit 19 and the address shift-over circuit 20 output the identification data RGDF corresponding to group $G_1$ and the identification data DGDF corresponding to group $G_0$ from the group memory circuit 16. The identification data GDF is restored to the state of no variation.

In time $t=16t_0$ to $20t_0$, the output control circuit 19 and the address shift-over circuit 20 allows the display memory circuit 15 and the identity/non-identity memory circuit 17 to output the display data DA corresponding to the scanning electrode $L_0$ and the transition data DF to the driving control circuit 21. The address shift-over circuit 20 outputs the address OAC="0" to the driving control circuit 21. The output control circuit 19 outputs the driving mode H/R="1" and the voltage mode E/W="0" to the driving control circuit 21. At the same time, the output control circuit 19 and the address shift-over circuit 20 confirms the output identification data OGDF of group $G_1$ in the group memory circuit 16. Since the data of group $G_1$ shows the presence of variation, the confirmation of the output identification data OGDF is suspended at this point. This helps to partially rewrite and drive scanning electrodes $L_2$ and $L_3$ corresponding to group $G_1$.

In time $t=20t_0$ to $24t_0$, the output control circuit 19 and the address shift-over circuit 20 allows the display memory circuit 15 and the identity/non-identity circuit 17 to output the display data DA corresponding to the scanning electrode $L_1$ and the transition data DF to the driving control circuit 21. The address shift-over circuit 20 outputs the address OAC="1" to the driving control circuit 21. The output control circuit 19 outputs the driving mode H/R="1" and the voltage mode E/W="0" to the driving control circuit 21.

In the foregoing operation the above behavior is repeated. FIG. 15 shows voltages applied to scanning electrodes $L_0$, $L_1$ and $L_2$, signal electrodes $S_1$, $S_2$ and $S_5$, and pixels $A_{11}$, $A_{21}$, $A_{22}$ and $A_{25}$ as a consequence of the repetition of the above behavior. Reference Numeral (1) in FIG. 15 designates a voltage waveform applied to the scanning electrode $L_0$, (2) a voltage waveform applied to the scanning electrode $L_1$, (3) a voltage waveform applied to the scanning electrode $L_2$, which is subjected to the interlaced scanning by using a combination of the voltage waveform shown in FIG. 11(A) which is followed by partial rewriting and scanning of the scanning electrode $L_0$ and partial rewriting and scanning of the scanning electrode $L_1$. Then after the scanning electrode $L_2$ is subjected to the interlaced scanning by using a combination of the voltage waveform shown by FIG. 11(B), the scanning electrode $L_0$ is partially rewritten and scanned and then the scanning electrode $L_1$ is partially rewritten and scanned. Reference Numeral (4) in FIG. 15 designates a voltage waveform applied-to the signal electrode $S_1$, (5) a voltage waveform applied to the signal electrode $S_2$, (6) a voltage waveform applied to the signal electrode $S_5$. Consequently, to the pixel $A_{11}$ is applied a voltage waveform shown by (7) in FIG. 15. To the pixel $A_{21}$ is applied a voltage waveform shown by (8) in FIG. 15. To the pixel $A_{22}$ is applied a voltage waveform shown by (9) in FIG. 15. To the pixel $A_{25}$ is applied a voltage waveform shown by (10) in FIG. 15. In other words, to the pixel $A_{11}$ shown by (7) in FIG. 15 are applied voltage waveforms A-C shown in FIG. 11(A) during the partial rewriting and scanning period to be maintained in a dark stable state. To the pixel $A_{21}$ shown by (8) in FIG. 15 are applied voltage waveforms E-D shown in FIG. 11(B) during the interlaced scanning period to be maintained in the bright stable state.

Use of the above driving method as described in Japanese Laid-Open Patent No. HEI 4 (1992)-134420 prevents flickers from being detected resulting from a partial rewriting operation driving. With a favorable memory properties of the FLCD no flicker resulting from the interlaced scanning is detected. A display free from a limit in the display capacity can be obtained even with a liquid crystal material having a slow response rate.

However, use of a liquid crystal materials having a slow response rate slows down the partial rewriting operation. Such liquid crystal materials having a slow response rate include SCE-8 manufactured by BDH Co. as used in an article "The JORES/ALVEY Ferroelectric Multiplexing Scheme published by RSRE at the FLC'91 Society. Since SCE-8 has a memory pulse width ta of about 70 μs at a voltage as shown in FIG. 11 of 3Va/2=30 V, it takes time $T_p$ as shown in the following equation as time required for partial scanning when the number of scanning electrodes to be driven for partial rewriting operation:

$$T_p=70\mu s\times 6\times 200\times(3/2)=126 \text{ ms}$$

In addition, an increase in the number of scanning electrodes to be driven for partial rewriting operation will results in the prolonged time $T_p$ required for partial rewriting operation, thereby making it impossible for a displayed screen to track an image to be displayed.

SUMMARY OF THE INVENTION

The present invention has been made to provide a method for driving a ferroelectric liquid crystal that shortens as much as possible time required for such partial rewriting scanning and that enables displayed screen to track an image to be displayed.

The present invention provides a method for driving a ferroelectric liquid crystal panel in which a ferroelectric liquid crystal is disposed between a plurality of scanning electrodes formed on a substrate and a plurality of signal electrodes formed on a opposite substrate and arranged in a direction of running crosswise relative to each other, and either a select voltage or a non-select voltage is selectively applied to the scanning electrodes whereas either a rewriting voltage or a holding voltage is selectively applied to the signal electrodes to change the display of each pixel defined where each scanning electrode and each signal electrode run crosswise relative to each other, which comprises: dividing all the scanning electrodes into a plurality of groups composed of a plurality of scanning electrodes; selecting a group of the scanning electrodes to be changed on display from the divided groups, based on a first display data currently displayed and a second display data to be subsequently displayed; and performing a first and a second scanning processes with respect to the selected group to rewrite the display by the second display data whereas applying the non-select voltage to the other groups to maintain the current display; the first scanning process comprising: applying the select voltage to all the scanning electrodes of the selected group at once; and applying the rewriting voltage to the signal electrodes corresponding to the pixels whose displays are to be changed to place in a first stable state the liquid crystal of the pixels whereas applying the holding voltage to the other signal electrodes to place in the current stable state the liquid crystal of the pixels; the second scanning process comprising: applying the select voltage to each scanning electrode successively with respect to the group in which the first scanning process is completed; and applying the rewriting voltage to the signal electrodes corresponding to the pixels whose liquid crystal is to be placed in a second stable state whereas applying the holding voltage to the other signal electrodes to place in the current stable state the liquid crystal of the corresponding pixels.

Preferably, the pixel defined between the scanning electrode to which the select voltage is applied and the signal electrode to which the holding voltage is applied is approximately equal to the pixel defined between the scanning electrode to which the non-select voltage is applied and the signal electrode to which either the rewriting voltage or the holding voltage is applied, in transmitted light intensity. In this case, a ferroelectric liquid crystal may comprise a liquid crystal whose voltage to response rate properties assumes the minimum value at a specific voltage; and a positive voltage having an absolute value smaller than the minimum value and a negative voltage having an absolute value larger than the minimum value, or a negative voltage having an absolute value smaller than the minimum value and a positive voltage having an absolute value larger than the minimum value may be applied to the pixels defined between the scanning electrode to which the select voltage is applied and the signal electrode to which the holding voltage is applied.

The above method may further comprise the step of periodically applying a voltage to the pixels to maintain the display state of the pixels.

In accordance with the present invention, only a group of pixels including one whose display is changed is selected and partially written. Thus this method shortens time required for rewriting one screen compared with the method of rewriting all the groups.

Besides, such selected group of pixels is partially rewritten. Since the present invention rewrites the pixels by a combination of the first scanning and the second scanning process, the invention further shortens time required for partial rewriting of pixels compared with the conventional method for rewriting pixels.

In other words, the conventional method performs linear scanning operation both in the first and the second scanning process. Thus the first scanning process is required to perform scanning operation in the number of times equal to the number of scanning lines included in the group. On the other hand, the method according to the present invention converts the display state of pixels into a different display state at one time by applying a select voltage only once without performing a linear scanning operation. Thus time required for the whole:scanning operation is shortened as a result.

Then the second scanning process rewrites in linear scanning operation pixels to be converted to a display state different from the display state to be performed at one time in the first scanning process thereby completing the whole process of rewriting pixels.

Furthermore, the first scanning process does not rewrite at one time all the pixels belonging to the selected group and does not rewrite pixels on a signal electrode which does not have a pixel whose display-is changed even at a portion within the group. This will be accomplished by applying a holding voltage to such signal electrode.

This reduces changes in the unnecessary display changes and prevents flickering on the screen.

Incidentally, when a plurality of groups of pixels are partially rewritten, the first and the second scanning process can be performed by each group. The first and the second scanning process may be performed at one time in the whole groups of pixels.

In addition, in case a number of scanning lines are included in one group in performing the first and the second scanning operation by each group, each group may be rewritten by dividing scanning lines within one group into a plurality of groups to perform the first and the second scanning operation by each divided group and repeating the same process by the number of thus divided groups.

BRIEF DESCRIPTION OF THE DRAWINGS

The present invention will become fully understood from the detailed description given hereinbelow and accompanying drawings which are given by way of illustration only and thus are not limitative of the present invention in which:

FIG. 10(A) is a view showing the state of the FLC molecule as viewed from a glass substrate whereas FIG. 10(B) is a view showing the state of the FLC molecule in a smectic C phase;

DETAILED DESCRIPTION OF THE PREFERRED EMBODIMENT

Figure 7:
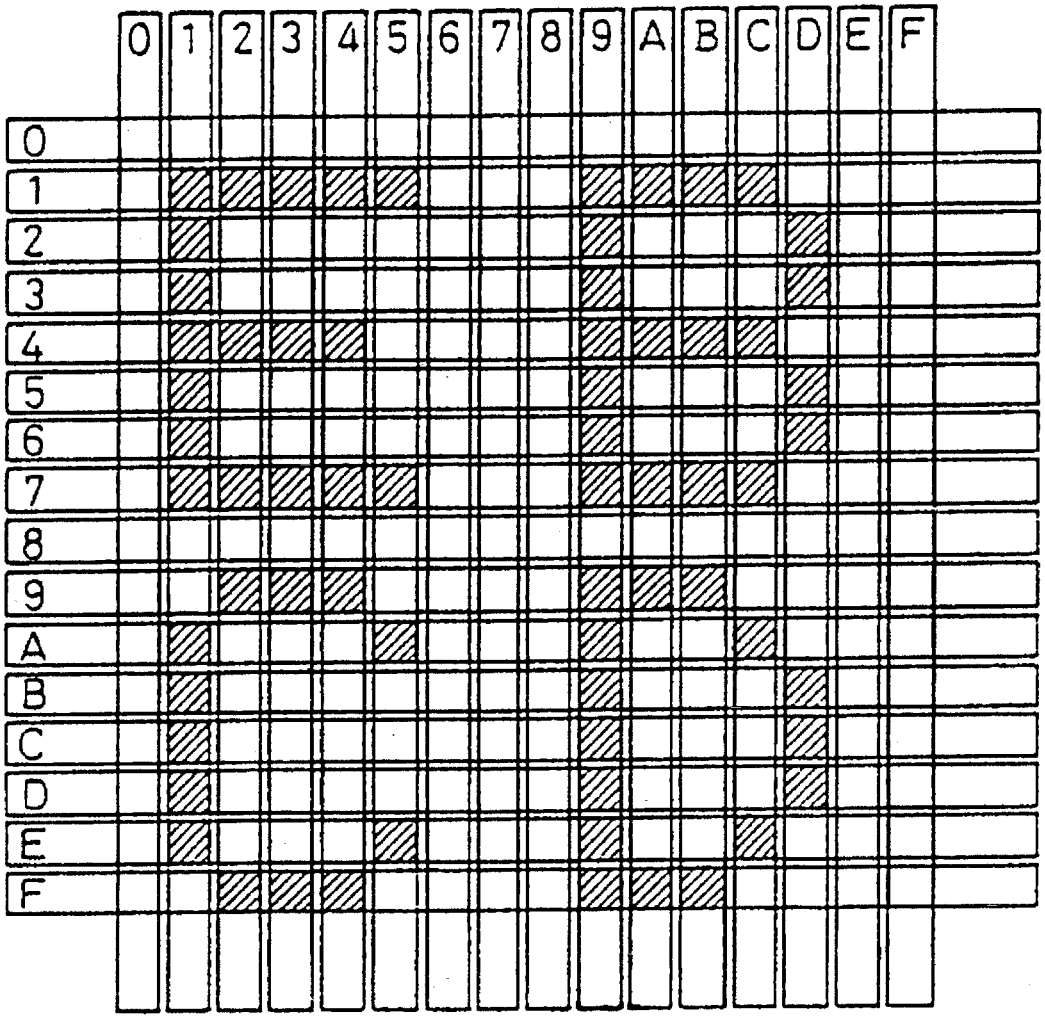
FIG. 7 is a view illustrating in matrix data to be displayed on the FLCD.
Figure 9:
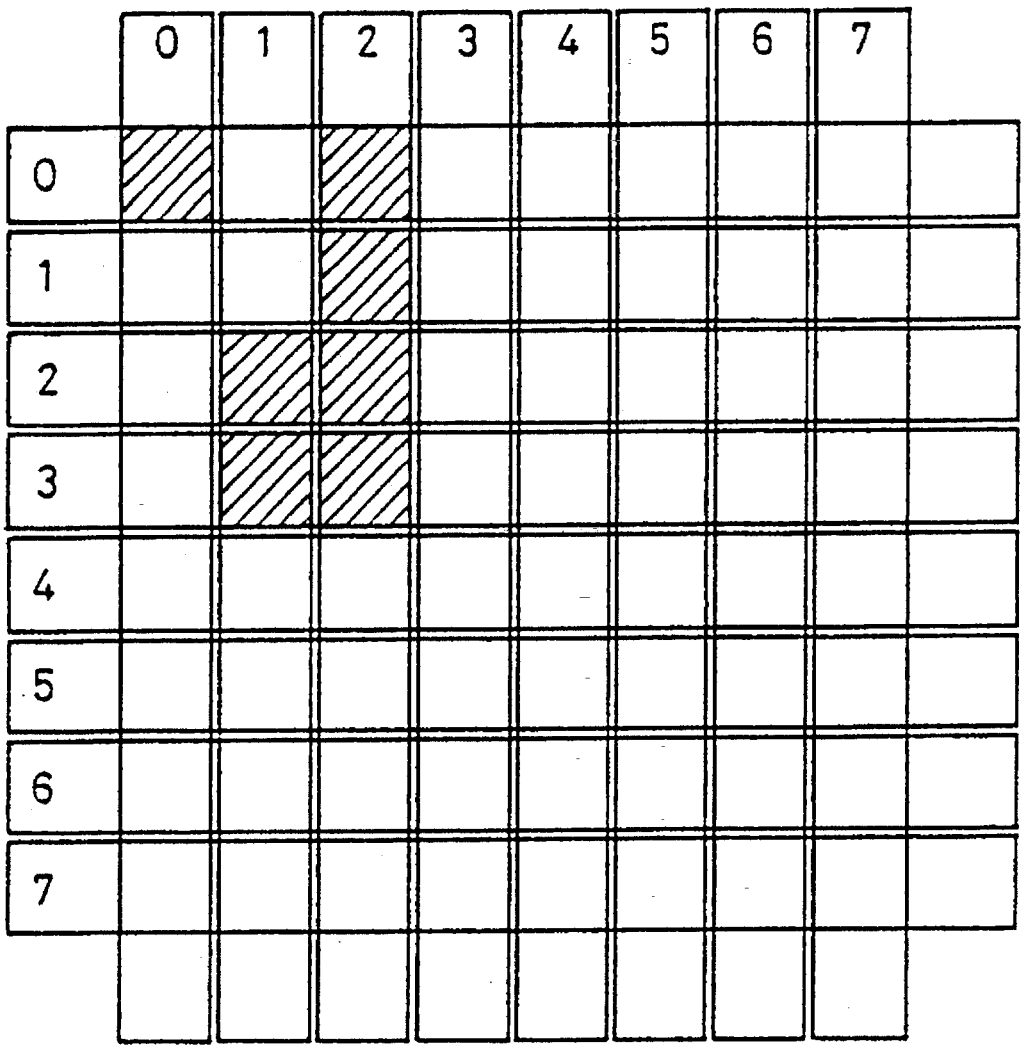
FIG. 9 is a view illustrating in matrix data shown in FIG. 8 by summarizing four pixels into one group.

A display control device 13 according to the prior art comprises a display memory circuit 15 having 16×16 pixels construction as shown in FIG. 7. On the other hand, the identity/non-identity memory circuit 17 has a 8×8 data construction as shown in FIG. 9. The reason for such construction goes as follows. Rewriting a pixel having a difference between a state to be displayed and a state already displayed allows us to detect a variation in the brightness at a portion having such difference without rewriting an adjacent pixel having no difference between the state to be displayed and the state already displayed. Consequently the display quality remains the same. Even still a plurality of pixels can correspond to one transfer data in one package without offering such transfer data to each pixel.

The behavior of the conventional method for driving the ferroelectric liquid crystal will be detailed hereinbelow, the method comprising sequentially selecting scanning electrodes $L_0$ and $L_1$ either to rewrite a pixel into one stable state or to hold the pixel, and then sequentially selecting the same scanning electrode either to rewrite the pixel into another stable state or to hold the pixel;

1) when data in the identity/non-identity memory circuit 17 shown in FIG. 9 shows "the presence of variation", (portion shown by slanted lines in FIG. 9), in the case of pixels $A_{00}$, $A_{01}$, $A_{10}$ and $A_{11}$ shown in FIG. 7, pixels $A_{00}$ and $A_{01}$ are rewritten when scanning electrode $L_0$ is selected for the first time because both pixels are to be converted to a bright display state. The above two pixels are held when scanning electrode $L_0$ is selected the next time. The pixel $A_{10}$ is rewritten when the scanning electrode $L_1$ is selected for the first time because the pixel $A_{10}$ is to be converted to the bright display state. The same pixel $A_{10}$ is held when the scanning electrode $L_1$ is selected the next time. The pixel $A_{11}$ is held when the scanning-electrode $L_1$ is selected for the first time because the pixel $A_{11}$ is to be converted to the dark display state, and the same pixel $A_{11}$ is rewritten when the scanning electrode $L_1$ is selected for the next time.

2) When data in the identity/non-identity memory circuit 17 shown in FIG. 9 shows "the absence of variation" (portion not designated with any mark in FIG. 9), in the case of pixels $A_{02}$, $A_{03}$, $A_{12}$, and $A_{13}$ shown in FIG. 7, pixels $A_{02}$ and $A_{03}$ are held when scanning electrode $L_0$ is selected for the first time because the display state of the two pixels are not to be changed. Pixels $A_{12}$ and $A_{13}$ are also held when the scanning electrode $L_1$ is selected for the first time because the display states of these two pixels are not to be changed and the two pixels are held when the scanning electrode $L_1$ is selected the next time.

Then when data in the identity/non-identity memory circuit 17 shown in FIG. 9 shows "the presence of variation", for example in case of pixels $A_{00}$, $A_{01}$, $A_{10}$ and $A_{11}$ shown in FIG. 7, 1) pixels $A_{00}$ and $A_{01}$ are rewritten when the scanning electrode $L_0$ is selected for the first time because both pixels are to be converted into the bright display state, and the two pixels are held when the scanning electrode $L_0$ is selected for the next time. Pixel $A_{10}$ is also rewritten when the scanning electrode $L_1$ is selected for the first time because the pixel is to be converted into the bright state. The same pixel $A_{10}$ is held when the scanning electrode $L_1$ is selected the next time. Pixel $A_{11}$ is rewritten when the scanning electrode $L_1$ is selected for the first time because the pixel is to be converted into the dark display state. The same pixel $A_{11}$ is rewritten when the scanning electrode $L_1$ is selected the next time. For all that, rewriting a pixel having a difference between the state to be displayed and the state already displayed allows us to detect a variation in the brightness at a portion having such difference without rewriting an adjacent pixel having no difference between the state to be displayed and the state already displayed. Thus the display quality remains the same in that the variation in the brightness can be detected at the portion in the same manner.

Consequently the same will be produced even if after the scanning electrodes $L_0$ and $L_1$ are sequentially selected to perform the scanning method to rewrite the pixel into one stable state or to be held in one stable state (such scanning is called a select partial erasing scanning) by using the data DF of the identity/non-identity circuit 17 shown in FIG. 9, the same electrodes $L_0$ and $L_1$ are selected sequentially to convert the scanning method so as to rewrite pixels into one stable state or to be held in one stable state thereby performing the driving the scanning operation in accordance with the following rules.

In other words, 1) when data in the identity/non-identity (transition) memory circuit 17 shown in FIG. 9 shows "the presence of variation" for example in the case of pixels $A_{00}$, $A_{01}$, $A_{10}$ and $A_{11}$ shown in FIG. 7, pixels $A_{00}$, $A_{01}$, $A_{10}$ and $A_{11}$ are rewritten when scanning electrodes $L_0$, $L_1$ are selected for the first time because pixels $A_{00}$, $A_{01}$, $A_{10}$ and $A_{11}$ include a pixel whose display is to,be changed. Pixels $A_{00}$ and $A_{01}$ are held when scanning electrode $L_0$ is selected next time because the pixels are to be converted into the bright display state. Pixel $A_{10}$ is also held when scanning electrode $L_1$ is selected next time because the pixel is to be converted to the bright state. On the other hand, pixel $A_{11}$ is rewritten when scanning electrode $L_1$ is selected the next time because the pixel is to be converted into the dark state.

2) When data in the identity/non-identity (transition) memory circuit 17 shown in FIG. 9 shows "the absence of variation", for example pixels in the case of $A_{02}$, $A_{03}$, $A_{12}$ and $A_{13}$ shown in FIG. 7, pixels $A_{02}$, $A_{03}$, $A_{12}$ and $A_{13}$ are held when scanning electrodes $L_0$ and $L_1$ are selected for the first time because the pixels do not include a pixel whose display is to be changed. Pixels $A_{02}$ and $A_{03}$ are held when scanning electrode $L_0$ is selected next time. Pixels $A_{12}$ and $A_{13}$ are held when scanning electrode $L_1$ is selected next time.

Incidentally, in the above description one identity/non-identity data is held corresponding to four pixels comprising two scanning electrodes and two signal electrodes for simplicity. When one identity non-identity data is held corresponding to eight pixels comprising four scanning electrodes and two signal electrodes, a select voltage may not be always applied simultaneously to the four scanning electrodes in the first scanning process. When the select voltage is applied to two scanning electrodes in two times, the same effect can be produced. In addition, it may be possible to perform alternately the first and the second scanning of one group of scanning electrode and the first and the second scanning of another group of scanning electrode.

EMBODIMENTS

Figure 2:
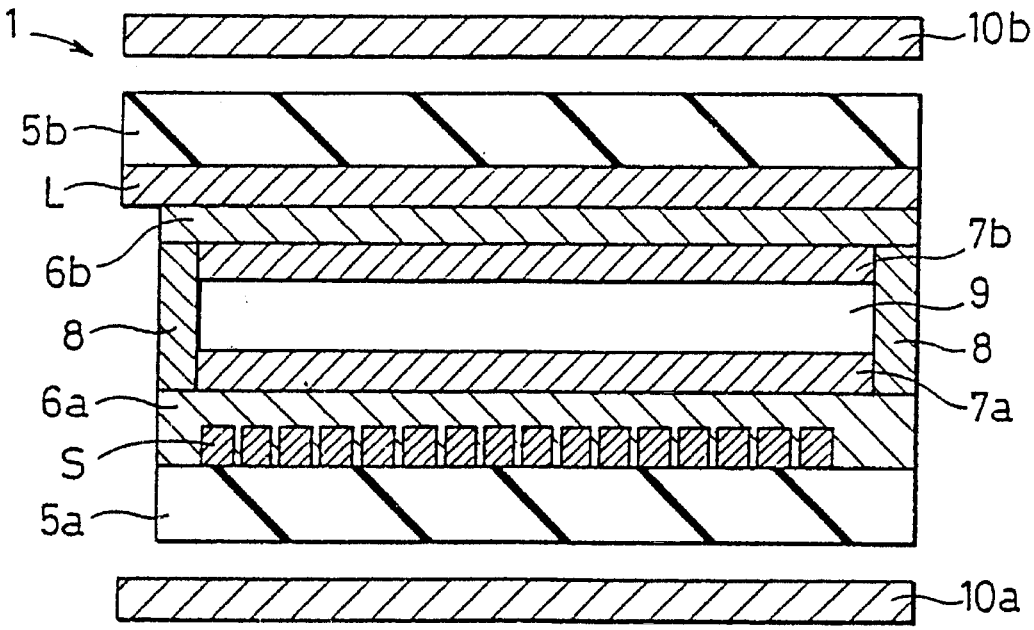
FIG. 2 is a sectional view showing a general construction of a FLC panel.
Figure 16:
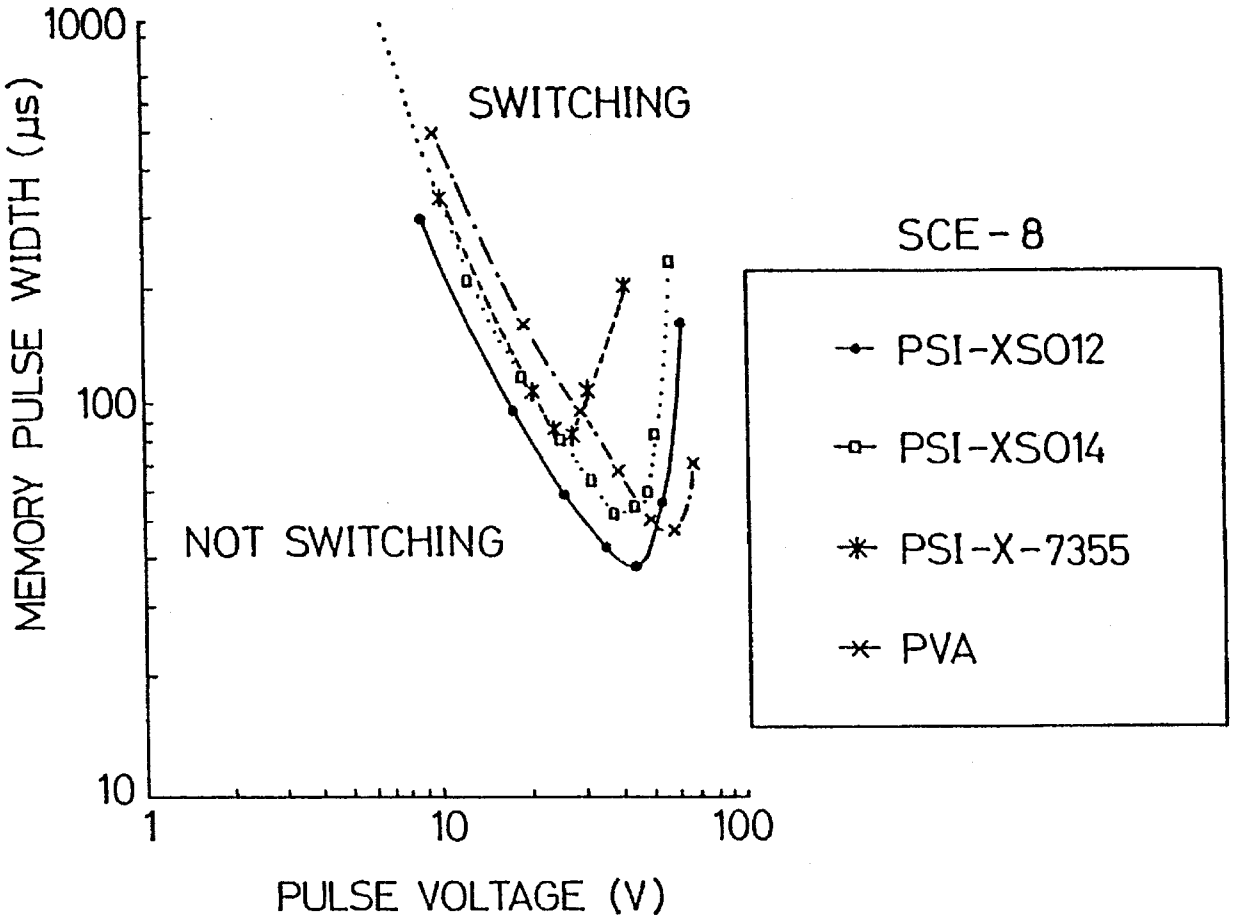
FIG. 16 is a view showing a voltage-to-memory pulse width properties of the ferroelectric liquid crystal SCE-8 manufactured by BDH Co. used in the embodiment according to the present invention.

The construction of a FLC panel used in the present invention is the same as the conventional counterpart shown in FIG. 2. Detailed description of the construction is omitted here. However, the ferroelectric liquid crystal used in an embodiment in the present invention is SCE-8 manufactured by BDH Co. whereas the orientation film used is PSI-C-7355 manufactured by Chisso. The panel voltage-to-pulse width properties are shown in FIG. 16. (In FIG. 16 data is described when orientation films PSI-XS012, PSI-XS014 and PVA manufactured by Chisso are used in the place of PSI-X-7355.)

Figure 10:
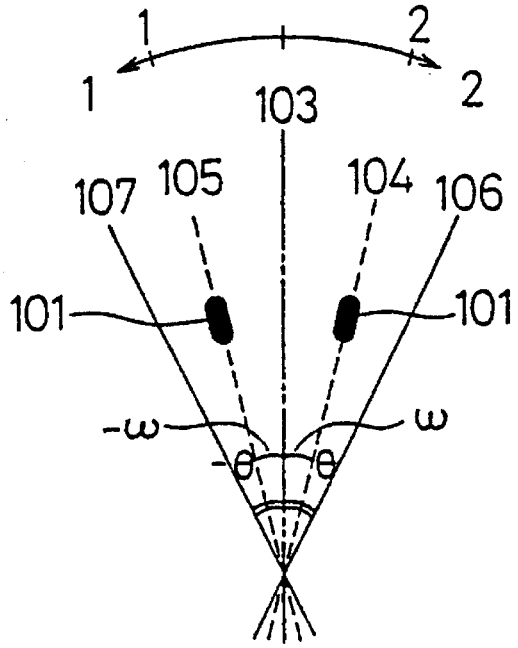
Figure 10:
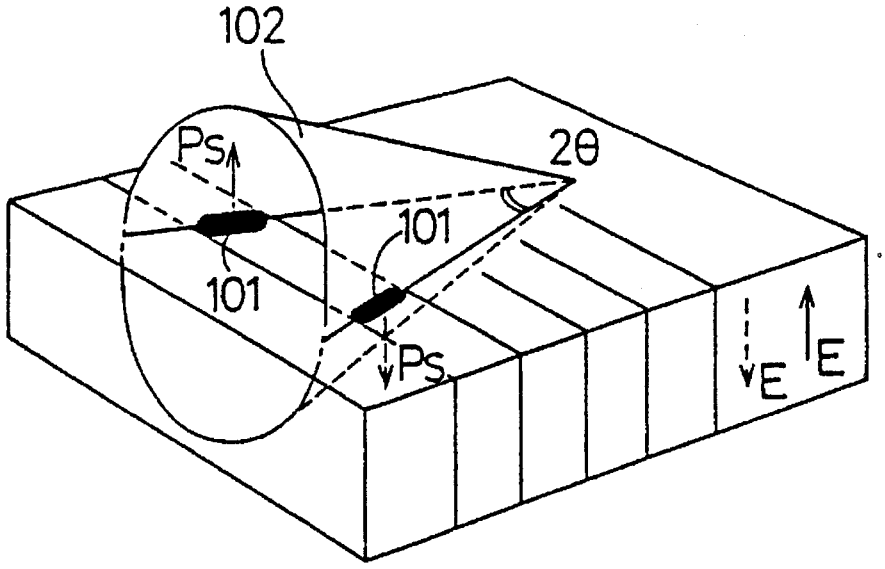

The [therefor] reason why the voltage-to-memory pulse width properties assume such minimum value is that the FLC molecule 101 shown in FIG. 10 is affected by a force proportional to the product of the difference in dielectric rate between the longitudinal direction and the transverse direction of the molecule and the square of the electric field E in addition to the force resulting from the vector product of the spontaneous polarization and the electric field E. The force working on the FLC molecule is described in the following equation;

$$F=K_0\times P_s\times E+K_1\times\Delta\epsilon\times E^2 \quad (1)$$

When the dielectric anisotropy $\Delta\epsilon$ of the FLC molecule assume a negative value, the force working on the FLC molecule assumes the maximum at a certain voltage. Since the response rate and the memory pulse width are considered to be inversely proportional to the force working on the FLC molecule, it is interpreted that the memory pulse width assumes the minimum value in the electric field where the force working on the FLC molecule assumes the maximum value.

Figure 17:
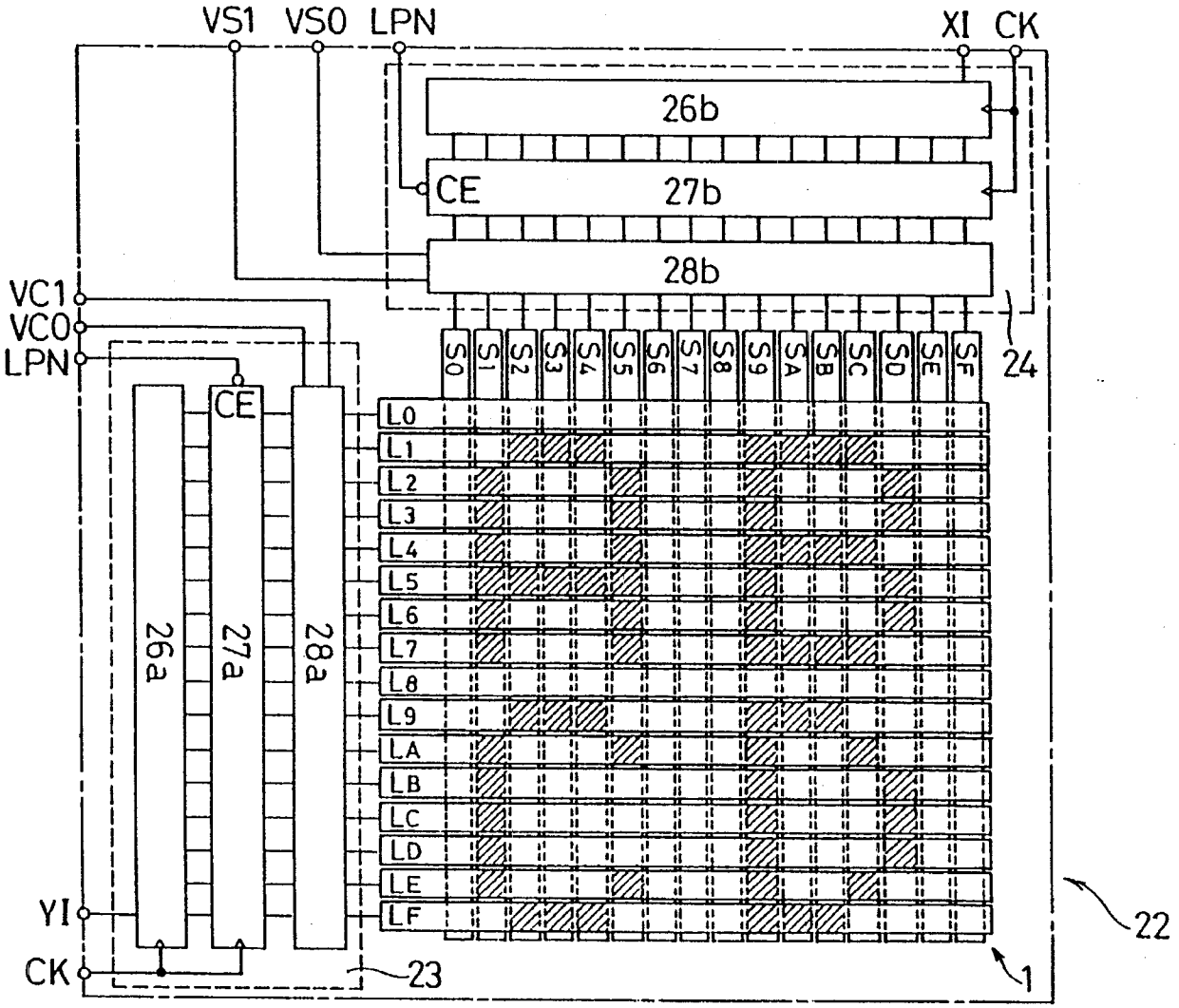
FIG. 17 is a plane view showing a general construction of the FLCD used in an embodiment according to the present invention.

The construction of the driving circuit in the FLCD 22 used in the present invention is schematically shown in plan view in FIG. 17. In other words, to the scanning electrode L of the FLC panel is connected a scanning side driving circuit 23 whereas to the signal electrode S is connected a signal side driving circuit 24. The scanning side driving circuit 23 serves as a circuit for applying a voltage to the scanning electrode L. The circuit comprises a shift register **26*a*, a latch 27*a*, and an analog switch array 28*a*. The select voltage $V_{c1}$ is applied to the scanning electrode $L_i$ where data YI to be entered corresponds to the value "1" whereas the non-select voltage $V_{co}$ is applied to scanning-electrode $L_k$ (k=i) where data YI to be entered corresponds to the value "0". On the other hand, the signal side driving circuit 24 serves as a circuit for applying a voltage to the signal electrode S. The circuit 24 comprises a shift register 26*b*, a latch 27*b* and a switch array 28*b***. An active voltage $V_{s1}$ is applied to the signal electrode $S_j$ where data. XI to be entered corresponds to the value "1" whereas a non-active voltage $V_{s0}$ is applied to the signal electrode $S_h$ (h=j) where data YI to be entered corresponds to the value "0".

By the way, application of a voltage $V_{C1}$ to the scanning electrode $L_1$ from the scanning side driving circuit 23, the voltage is given as a voltage at the end of the connection of the driving circuit with the scanning electrode $L_i$. At the far end of the scanning electrode L, the voltage decreases to provide a voltage $U_{cl}$ as described hereinbelow;

$U_{C1}<V_{C1}$.

Then in order to set to a definite level the electric field applied to the FLC molecule on the scanning electrode $L_i$, preferably the end of the scanning electrode is made thicker than other portions so that a distance $d_{V1}$ between the signal electrode and a proximal end of the scanning electrode connected with the driver and a distance $d_{U1}$ between the signal electrode and a distal end of the scanning electrode.

$$U_{c1}/d_{U1}=V_{C1}/d_{v1} \quad (2)$$

When the above condition is satisfied the decrease rate of the voltage is not so different at the application of the voltage $V_{C1}$ from at the application of the voltage $V_{C0}$. Consequently, when the voltage $V_{C0}$ is applied from the scanning side driving circuit 23 to the scanning electrode $L_i$, the electric field applied to the FLC molecule on the scanning electrode $L_i$ becomes definite. In the same way preferably the end of the signal electrode $S_j$ is made thicker than any other portion so that the electric field is set at the same level when the voltages. $VS_1$ and $VS_0$ are applied to the signal electrodes $S_j$ from the signal side driving circuit 24.

In the foregoing passage, explanation is given to a case in which one pixel comprises one signal electrode and one scanning electrode. However the present invention is also applicable to Japanese Laid-Open Patent No. SHO 63 (1988)-229430 which discloses that one pixel comprises one scanning electrode and a plurality of signal electrode as well as to Japanese Laid-Open Patent No. HEI 2 (1990)-96118 which discloses that one pixel comprises a plurality of scanning electrodes and a plurality of signal electrodes.

Figure 1:
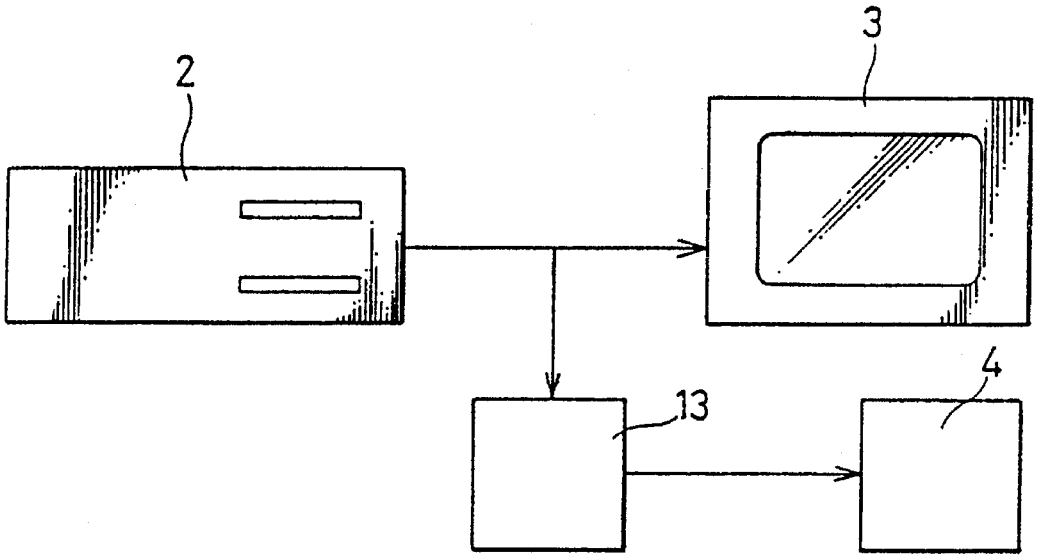
FIG. 1 is a block diagram showing a general construction of a display system using a FLCD.
Figure 18:
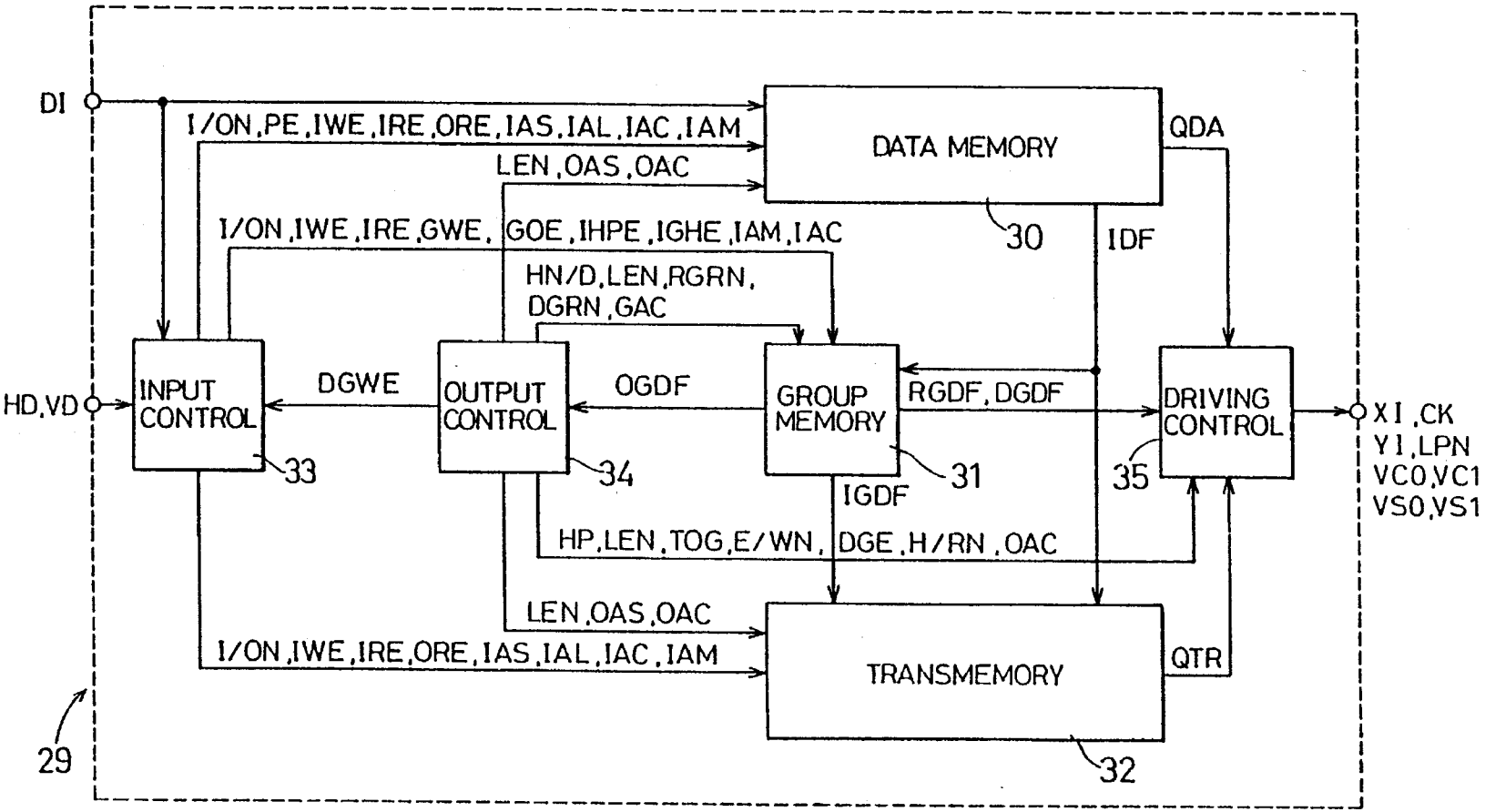
FIG. 18 is a block diagram showing a general construction of the display control device used in an embodiment according to the present invention.

A display control device 29 for performing the driving method of the present invention will be detailed hereinbelow. The general construction of the display control device 29 for embodying the method for driving the ferroelectric liquid crystal according to the present invention is shown in FIG. 18. The display control device 29 like the conventional device generates the data to be displayed on the FLCD 22 with digital RGB (attached with a clock) signals transmitted, from the personal computer 2 shown in FIG. 1 to the CRT display 3. RBG signals are already detailed with respect to the conventional devices. They will not be detailed any more hereinbelow.

Along with the input of the digital RGB signal into the display control device 29 the display data Data is entered into a data memory circuit 30 and an input control circuit 33 as data DI. The synchronizing signal HD and VD are entered into the input control circuit 33 and the clock CLK is entered into the input control circuit 33. The clock CLK is entered into the input control circuit 33, the data memory circuit 30 and the group memory circuit 31 and the transmemory circuit 32.

Figure 3:
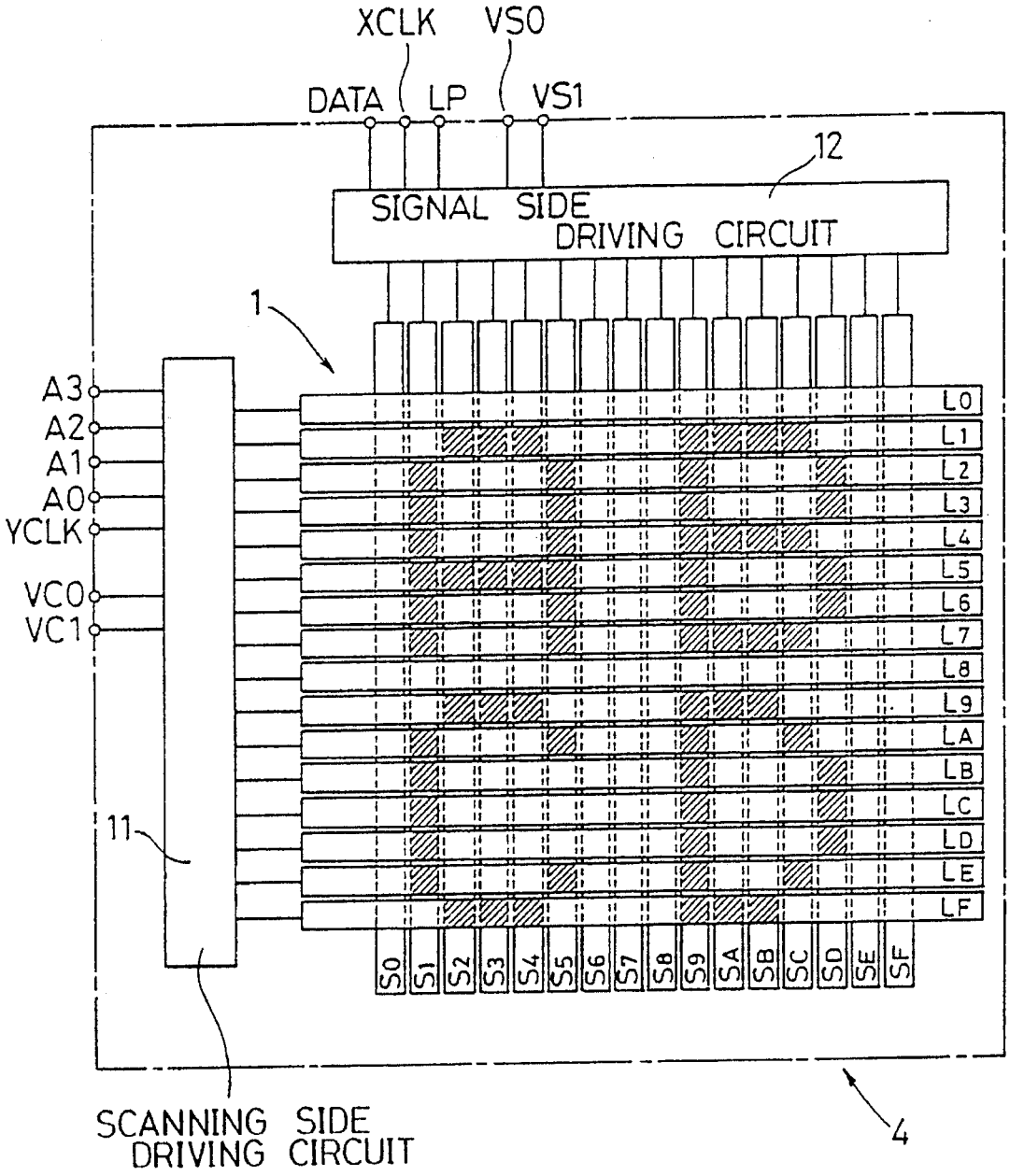
FIG. 3 is a plane view showing a general construction of the FLCD.
Figure 4:
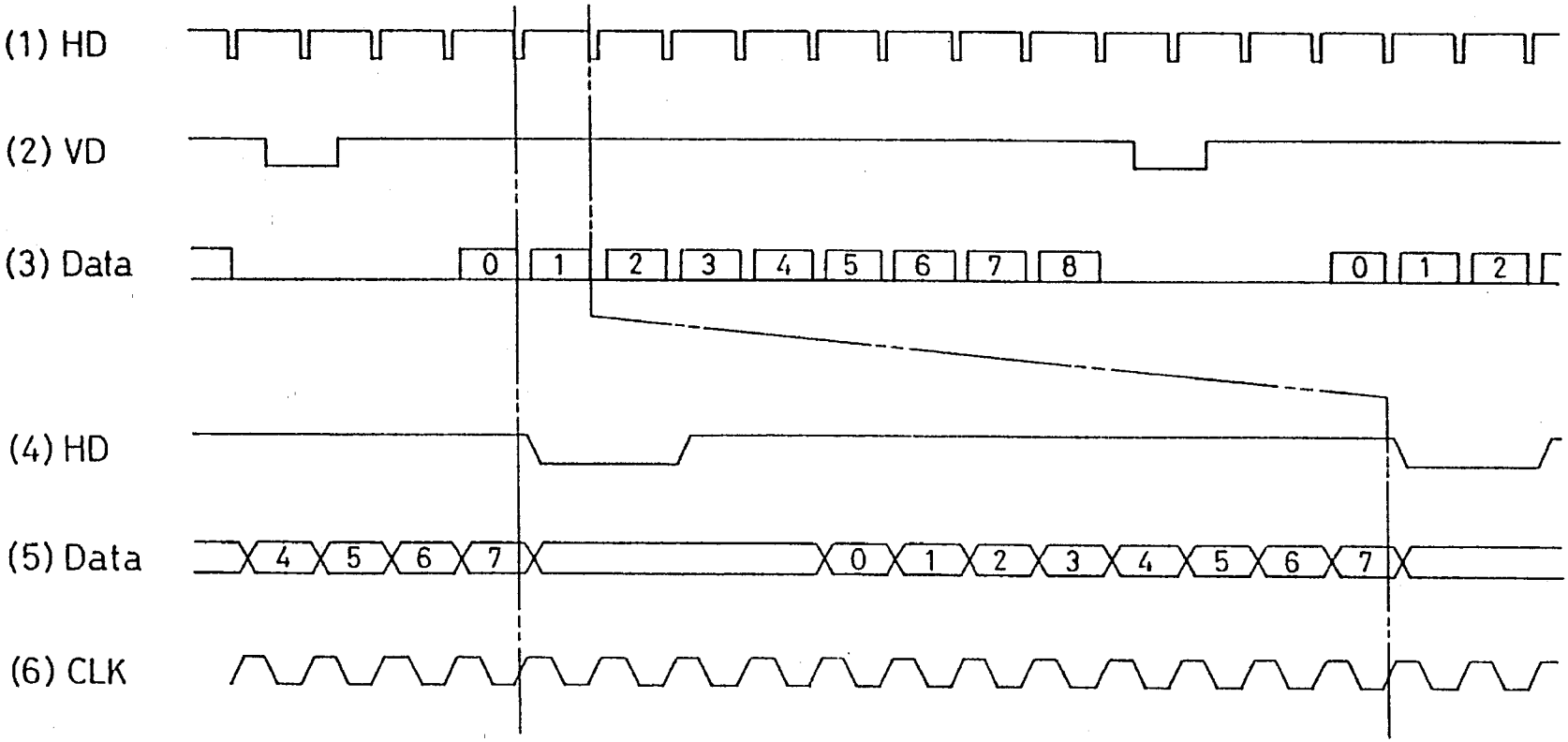
FIG. 4 is a waveform view showing an output signal of personal computers that is entered into the display system.
Figure 5:
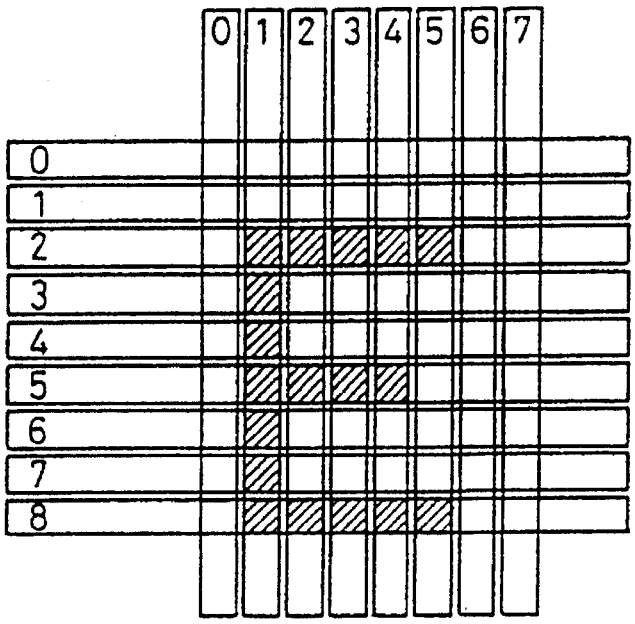
FIG. 5 is a view illustrating in matrix display data shown in FIG. 4.
Figure 6:
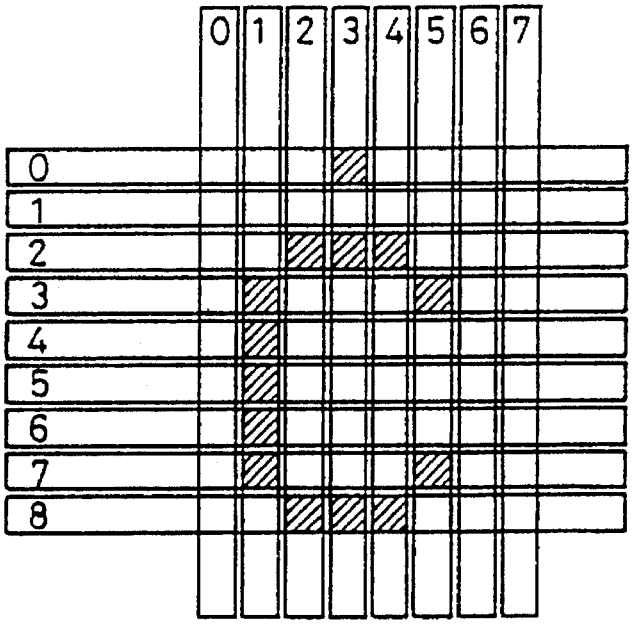
FIG. 6 is a view illustrating in matrix display data shown in FIG. 4.
Figure 8:
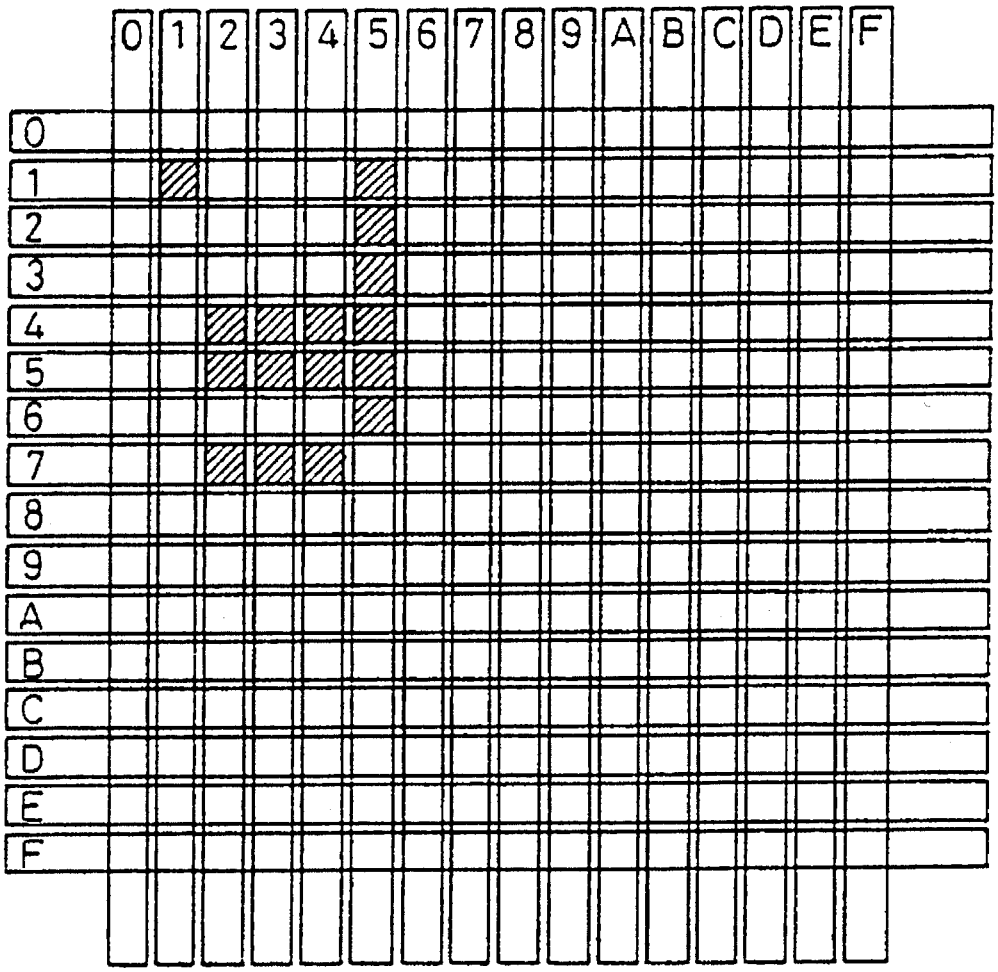
FIG. 8 is a view illustrating in matrix a difference between data displayed on the FLCD and data to be displayed thereon.

In the data memory circuit 30 "ABCD" data already displayed in the FLCD 22 and shown in FIG. 3 is recorded. Entering the display data DI of "E" shown in FIG. 5 results in newly recording "EBCD" data shown in FIG. 7. In addition, the data variation in the data memory circuit 32 at this time in every pixel is shown in FIG. 8. The data variation in the data memory circuit 32 is summarized in every two pixels (when there is a variation in one pixel the presence of the variation is recorded). The variation is output to the group memory circuit 31 and the transmemory circuit 32.

In the group memory circuit 31, scanning electrodes $L_0$ and $L_1$ correspond to group $G_0$ whereas scanning electrodes $L_E$ and $L_F$ corresponds to group $G_7$. When even one data item in the transition data IDF corresponding to the above group assumes the value "1" (suggesting the presence of a variation), the identification data GDFI and GDFO assumes "1" (suggesting the presence of a variation). When all the data items in the transition data IDF assumes the value "0" (suggesting the absence of a variation), the identification data GDFI and GDFO corresponding to the group remain the same. Besides, the identification data GDFI is output to the transmemory circuit 32.

In the transmemory circuit 32, four pixels in the longitudinal and transverse directions of the two electrodes are recorded as one data item (when the transmemory circuit 32 is applied to Japanese Laid-Open Patent No. HEI 2 (1990)-96118 in which one pixel comprises two scanning electrodes, in some cases one data item in the transmemory circuit corresponds to one pixel whereas in some cases four data items correspond to one pixel). Data items recorded in the transmemory circuit 32 corresponding to the transition data IDF are read to calculate the logic product of the data item and the transition data IG and then further calculates the logic sum of the logic product and the transition data IDF. The logic sum is summarized as shown in FIG. 9 and recorded (representing the presence of a variation when either of the sums of four pixels exhibits the presence of variation).

The above behavior on the input side is controlled with the control circuit 33 on the input side.

Furthermore, the output control circuit 34 outputs the group address GAC to the group memory circuit 31 and receives the corresponding identification data GDFO as an identification data OGDF. When the-data assumes the value "1" (suggesting the presence of a variation), the scanning electrode corresponding to the group is driven for partial rewriting operation. When the data assumes the value "0" (suggesting the absence of a variation) the operation continues for investigating Whether or not the output identification data OGDF to the next group assumes the value either "1" or "0".

To the driving control circuit 35 is entered a display data QDA from the data memory circuit 30, state data RGDF and DGDF from the group memory circuit 31, transition data QTR from the transmemory circuit 32, the address OAC, timing pulse HP, LEN, a voltage mode E/WN, a driving mode H/RN, control signals ROG, DGE from the output control circuit 34. Upon receipt of these data items, the driving control circuit 35 outputs scanning side data YI for controlling the behavior of the FLCD 22, signal side data XI, a transfer clock FLCK, a timing signal LPN, and driving voltages $V_{CO}$, $V_{C1}$, $V_{SO}$ and $V_{S1}$.

Figure 19:
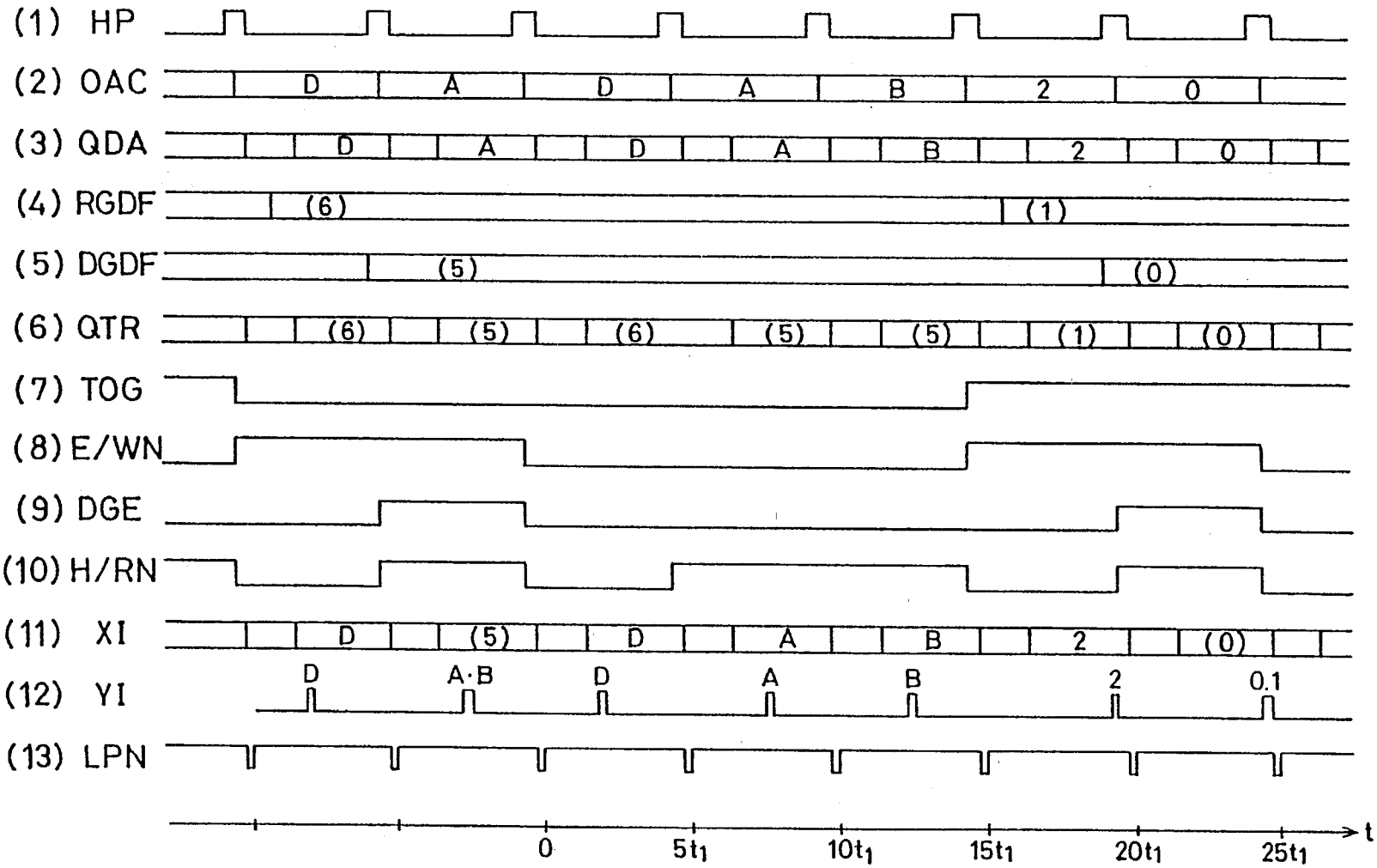
FIG. 19 is a timing chart for illustrating the behavior of the display control device of an embodiment according to the present invention.
Figure 20:
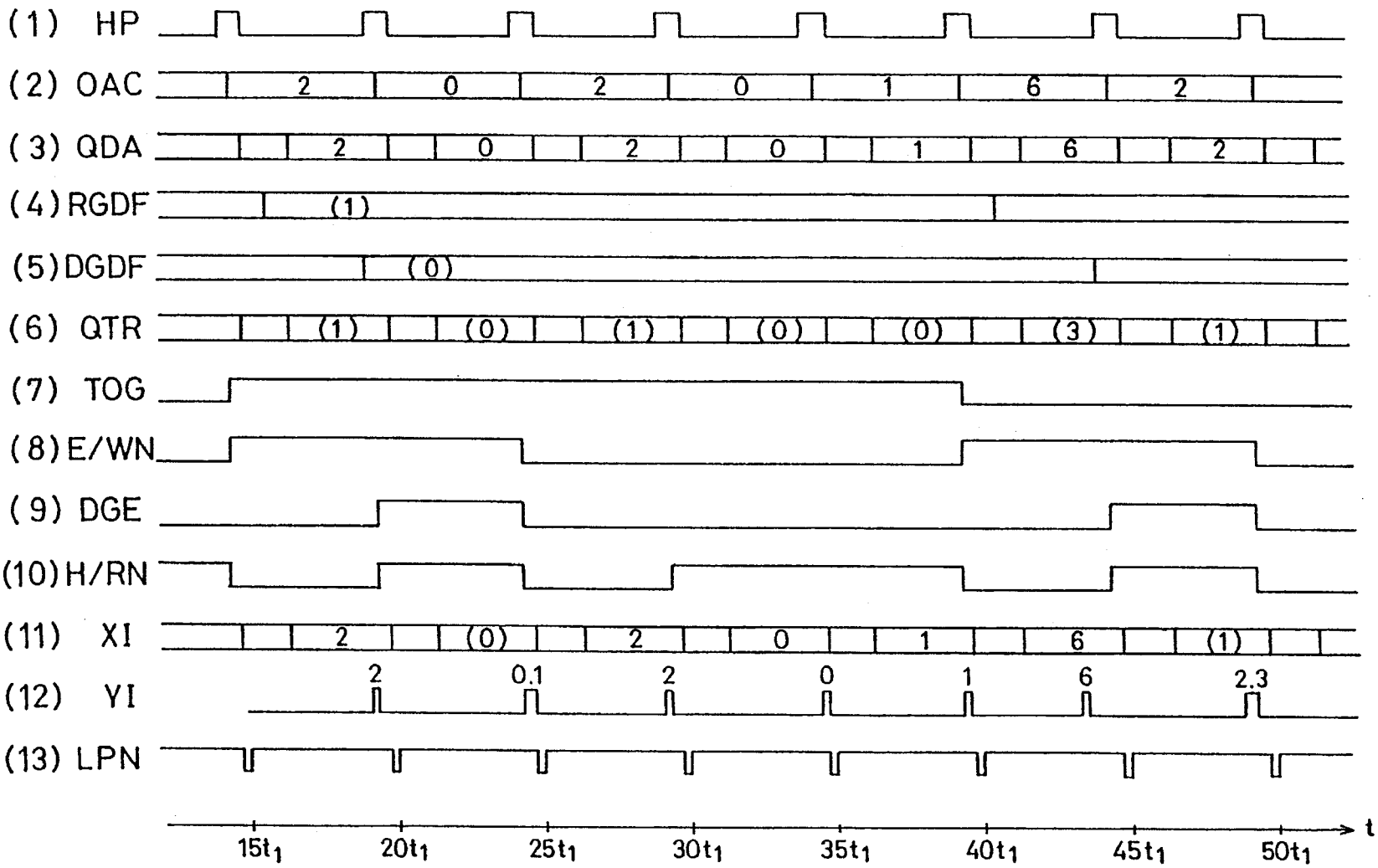
FIG. 20 is a timing chart for illustrating the behavior of the display control device of an embodiment according to the present invention.

FIG. 19 and FIG. 20 area timing chart for concretely illustrating the behavior of the display control device 29. Reference Numeral (1) in FIG. 19 and (1) in FIG. 20 designate a horizontal synchronous pulse HP output to the driving control circuit 35 from the output control circuit 34. The horizontal synchronous pulse HP assumes "1" in each one select period $5t_1$. Reference Numeral (2) in FIG. 19 and (2) in FIG. 20 designate a display address OAC output from the output control circuit 34 to, the data memory circuit 30, the transmemory circuit 32, and the driving control circuit 35. After one scanning electrode (for example $L_D$) is designated for interlaced scanning, one scanning electrode (for example $L_A$) is designated for select partial erasing scanning. After one scanning electrode (for example $L_D$) is again designated for interlaced scanning, one electrode, (for example $L_A$) is designated for select partial erasing scanning whereas one scanning electrode (for example $L_B$) is selected for partial rewriting scanning, Reference Numeral (3) in FIG. 19 and (3) in FIG. 20 designate a display data QDA output from the data memory circuit 30 to the driving control circuit 35 in correspondence to the display address OAC. Reference Numeral (4) in FIG. 19 and (4) in FIG. 20 designate a state data RGDF for interlaced scanning output from the group memory circuit 31 to the driving control circuit 35, Reference Numeral. (5) in FIG. 19 and (5) in FIG. 20 designate a state data DGDF for partial scanning (partial rewriting scanning and partial erasing scanning) output from the group memory circuit 31 to the driving control circuit 35, Reference Numeral (6) in FIG. 19 and (6) in FIG. 20 designate a transition data QTR output from the transmemory circuit 32 to the driving control circuit 35. Reference Numeral (7) in FIG. 19 and (7) in FIG. 20 designate a control data TOG output from the output control circuit 34 to the driving control circuit 35. Reference Numeral (8) in FIG. 19 and in FIG. 20 designate a voltage mode E/WN output from the output control circuit 34 to the driving control circuit 35. The voltage mode E/WN shifts a combination of driving waveform output from the driving control circuit 35 by the exclusive logic sum of the transition data QTR and the control data TOG. Reference Numeral (9) in FIG. 19 and (9) in FIG. 20 designate a control date DGE output from the output control circuit 34 to, the driving control circuit 35. When the control data DGE assumes "1", it corresponds to the select partial erasing scanning. Reference Numeral (10) in FIG. 19 and (10) in FIG. 20 designate a driving mode H/RN output from the output control circuit 34 to the driving control circuit 35. When the driving mode H/RN assumes "0", it corresponds to the interlaced scanning. Reference Numeral (11) in FIG. 19 and (11) in FIG. 20 designate signal side data XI output from the driving control circuit 35 to the FLCD 22. The signal side data XI corresponds to the select partial erasing scanning period during the period embraced with the round brackets. Reference Numeral (12) in FIG. 19 and (12) in FIG. 20 designate scanning side data YI output from the driving control circuit 35 to the FLCD 22. The scanning side data YI assumes 2 pulse width only during the period corresponding to the select partial erasing. Reference Numeral (13) in FIG. 19 and (13) in FIG. 20 designate a timing signal LPN output from the driving control circuit 35 to the FLCD 22. Incidentally, Reference Numerals 0 through F in FIGS. 19 and 20 correspond to scanning electrode $L_i$ whereas Reference Numerals [0] through [7] in FIGS. 19 and 20 correspond to the group $G_m$ of the group memory circuit 31.

The driving control circuit 35 sets the exclusive logic sum of the control data TOG and the voltage mode E/WN to a voltage mode EN/W, the driving control circuit 35 outputs a combination of voltage waveforms $V_{CO}$, $V_{C1}$, $V_{S0}$ and $V_{S1}$ for either rewriting pixels into one stable state or holding pixels when the voltage mode EN/W assumes the value "1". On the other hand, the driving control circuit 35 outputs a combination of voltage waveforms $V_{C0}$, $V_{C1}$, $V_{S0}$ and $V_{S1}$ for either rewriting pixels into another stable state or holding pixels when the voltage mode EN/W assumes the value "0".

According to the rule of formulating data XI, when the driving mode H/RN assumes the value "0", the driving mode corresponds to the interlaced driving.

1) When the state data RGDF exhibits "no variation", the voltage mode EN/W assumes the value "1" and the display data QDA assumes the value "1", the signal side data XI assumes the value "1".

2) When the transition data QTR exhibits "no variation", the voltage mode EN/W assumes the value "1", and the display data QDA assumes the value "1", the signal side data XI assumes "1".

3) When the state data RGDF exhibits "no variation", the voltage mode EN/W assumes the value "0" and the display data QDA assumes "0", the signal side data XI assumes "1".

4) When the transition data QTR exhibits, "no variation", the voltage mode EN/W assumes "0" and the display QDA assumes "0", the signal side, data XI assumes the value "1".

On the other hand, when the driving mode H/RN assumes the value "1" and the control data DGE assumes "1", the driving mode corresponds to a partial rewriting driving.

5) When the control data DGE assumes the value "1", the state data DGDF exhibits the "presence of a variation" the signal side data XI assumes the value "1".

Besides, when the driving mode H/RN assumes "1" and the control data assumes "0", the driving mode corresponds to the partial rewriting driving.

6) When the control data DGE assumes the value "0", the state data DGDF exhibits "the presence of a variation, the voltage mode EN/W assumes the value "1" and the display data QDA assumes the value "1", the signal side data XI exhibits the value "1".

7) When the control data DGE assumes the value "0", the state data DGDF exhibits the "presence of a variation", the transition data QTR exhibits the "presence of a variation", the voltage mode EN/W assumes the value "0", and the display data. QDA assumes the value "0", the signal side data XI assumes the value "1".

On the other hand, when the control data DGE assumes the value "0" the scanning side data YI assumes "1" by one clock width at a timing corresponding to the display address OAC value, and one scanning electrode is selected. When the control data DGE assumes the value "1" the scanning side data YI assumes the value "1" by two clock width at a timing corresponding to the display address OAC and at a timing immediately after the former timing. Consequently a plurality of scanning electrodes belonging to the same group are selected simultaneously.

The behavior of this display device 29 will be explained hereinbelow by way of FIGS. 19 and 20.

During time t=0 through $5t_1$, the output control circuit outputs the display address OAC="D" to the data memory circuit 30, the transmemory circuit 32, and the driving control circuit 35. The data memory circuit 30 outputs-the display data QDA corresponding to the scanning electrode $L_D$. The group memory circuit 31 outputs the state data RGDF indicating the absence of a variation corresponding to the group $G_6$. The transmemory circuit 32 outputs transition data QTR corresponding to the scanning electrode $L_D$ to the driving control circuit 35. The output control circuit 34 outputs the control signal TOG="0" the control signal DGE="0" the driving mode H/RN="0", and the voltage mode E/WN="0" to the driving control circuit 35. Besides, upon receipt of these data items the driving control circuit 35 outputs the signal side data XI to the FLCD 22 in accordance with the rules 1) through 4) and the scanning side data YI at a timing corresponding to the display address. OAC="D".

During this time, the input control circuit 33 changes recorded data items in the data memory circuit 30 from the "ABCD" state shown in FIG. 3 to the "EBCD" state shown in FIG. 7 like the conventional example. On the other hand, the input control circuit 33 changes recorded data items all from the state of the "absence of variation" to the state of the "presence of variation." After that, recorded data in the display memory circuit 30 is kept in the state of "EBCD" as shown in FIG. 7.

During time t=$5t_1$ through $10t_1$, the output control circuit outputs the display address OAC="A" to the data memory circuit 30, the transmemory circuit 32 and the driving control circuit 35. The data memory circuit 30 outputs the display data QDA corresponding to the scanning electrode $L_A$ to the driving control circuit 35. The group memory circuit. 31 outputs the state data DGDF indicating the "absence of variation" corresponding to the group $G_5$. The transmemory circuit 32 outputs the transition data QTR corresponding to the scanning electrode $L_A$ to the driving control circuit 35. The output control circuit 34 outputs the control signal TOG="0", the control signal DGE="0", the driving mode H/RN="1" and the voltage mode E/WN="0" to the driving control circuit 35. Besides, upon receipt of these data items, the driving control circuit 35 output the signal side data XI to the FLCD 22 in accordance with the rules 6) and 7) and the scanning data YI at a timing corresponding to the display address OAC="A".

During time $t=10t_1$ through $15t_1$, the output control circuit outputs the display address OAC="B" to the data memory circuit 30, the transmemory circuit 32 and the driving control circuit 35. The data memory circuit 30 outputs the display data QDA corresponding to the scanning electrode $L_B$ to the driving control circuit 35. The group memory circuit 31 outputs the state data DGDF indicating the "absence of variation" corresponding to the group $G_5$ to the driving control circuit 35. The transmemory circuit 32 outputs the transition data QTR corresponding to the scanning electrode $L_B$ to the driving control circuit 35. The output control circuit 34 outputs the control signal TOG="0", the control signal DGE="0", the driving mode H/RN="1" and the Voltage mode E/WN="0" to the driving control circuit 35. Besides, upon receipt of these data-items, the driving control circuit 35 outputs the signal side data XI to the FLCD 22 in accordance with the rules 6) and 7) and the scanning side data YI at a timing corresponding to the display address OAC="B".

During time $t=15t_1$ through $20t_i$, the output control circuit outputs the display address OAC="2" to the data memory circuit 30, the transmemory circuit 32, and the driving control circuit 35. The data memory circuit 30 outputs the display data QDA corresponding to the scanning electrode $L_2$. The group memory circuit 31 outputs the state data RGDF indicating the "presence of variation" corresponding to the group $G_1$. The transmemory circuit 32 outputs the transition data QTR corresponding to the scanning electrode $L_2$. The output control circuit 34 outputs the control signal TOG="1", the control signal DGE="0", the driving mode H/RN="0" and the voltage mode E/WN="1" to the driving control circuit 35. Besides, upon receipt of these data items, the driving control circuit 35 outputs the signal side data XI to the FLCD 22 in accordance with the rules. 1) through 4) and the scanning side data YI at a timing corresponding to the display address OAC="2". In addition during this time the output control circuit 34 confirms that the output identification data OGDF corresponding to the group $G_0$ assumes the value "1" (indicating the presence of a variation), the identification data GDFO corresponding to the group $G_0$ at this time is brought back to the state of the "absence of a variation", thereby equalizing the identification data GDFI corresponding to the group $G_0$ to the identification data GDFO corresponding to the group $G_5$.

During time $t=20t_1$ through $t=25t_1$ the output control circuit outputs the display address OAC="0" to the data memory circuit 30, the transmemory circuit 32 and the driving control circuit 35. The data memory circuit 30 outputs the display data corresponding to the scanning electrode. $L_0$. The group memory circuit 31 outputs the state data DGDF indicating the "presence of variation" and corresponding to the group $G_0$. The transmemory circuit 32 outputs the transition data QTR corresponding to the scanning electrode $L_0$. The output control circuit 34 outputs the control signal TOG="1", the control signal DGE="1" the driving mode H/RN="1" and the voltage mode E/WN="1" to the driving circuit 35. In addition, upon receipt of these data, the driving control-circuit 35 outputs the signal side data XI in accordance with the rule 5) to the FLCD and the scanning side data YI at a timing corresponding to the display address OAC="0" and "1".

During time $t=25t_1$ through $t=30t_1$, the output control circuit outputs the display address OAC="2" to the data memory circuit 30, the transmemory circuit 32 and the driving control circuit 35. The data memory circuit 30 outputs the display data QDA corresponding to the scanning electrode $L_2$. The group memory circuit 31 outputs the state data RGDF indicating the presence of variation and corresponding to the group $G_1$. The transmemory circuit 32 outputs the transition data QTR corresponding to the scanning electrode $L_2$. The output control circuit 34 outputs the control signal TOG="1" the control signal DGE="0" the driving mode H/RN="0" and the voltage mode E/WN="0" to the driving control 35. In addition, upon receipt of these data items, the driving control circuit 35 outputs signal side data XI in accordance with the rules 1) through 4) to the FLCD 22 and the scanning side data YI at a timing corresponding to the display address OAC="2".

During time $t=30t_1$ through $35t_1$, the output control circuit outputs the display address OAC="2" to the data memory circuit 30, the transmemory circuit 32 and the driving control circuit 35. The data memory circuit 30 outputs the display data QDA corresponding to the scanning electrode $L_0$. The group memory circuit 31 outputs the state data DGDF indicating the "presence of a variation" and corresponding to the group $G_0$. The transmemory circuit 32 outputs the transition data QTR corresponding to the scanning electrode $L_0$. The output control circuit 34 outputs the control signal TOG="1" and the control signal DGE="0", the driving mode H/RN="1" and the voltage mode E/WN="0" to the driving control circuit 35. In addition, upon receipt of these data items the driving control circuit 35 outputs the signal side data XI in accordance with the rules 6) and 7) to the FLCD 22 and outputs the scanning side data YI at a timing corresponding to the display address OAC="0".

During time $t=35t_1$ through $40t_1$, the output control circuit outputs the display address OAC="1" memory circuit 30, the transmemory circuit 32 and the driving control circuit 35. The data memory circuit 30 outputs the display data QDA corresponding to the scanning electrode $L_1$. The group memory circuit 31 outputs the state data DGDF indicating the presence of a variation and corresponding to group $G_0$. The transmemory circuit 32 outputs the transition data QTR corresponding to the scanning electrode $L_1$. The output control circuit 34 outputs the control signal TOG="1" the control signal DGE="0" the driving mode H/RN="1" and the voltage mode E/WN="0" to the driving control circuit 35. In addition, upon receipt of these data items, the driving control circuit 35 outputs the signal side data XI to the FLCD 22 in accordance with the rules 6) and 7) and the scanning side data YI at a timing corresponding to the display address OAC="1".

By the way, in case of corresponding to the partial rewriting driving, when the driving mode H/R assumes "1" in FIGS. 19 and 20 the state data DGDF in the group memory circuit 31 corresponding to the scanning electrode $L_i$ that is to be partially rewritten exhibits the absence of a variation, the signal side data XI does not assume "1" in accordance with the rules 5 through 7). Since the pixel $A_{ij}$ on the scanning electrode $L_i$ is not rewritten, the scanning side data YI need not to rewrite intentionally the value to "1". However, a case will be detailed where the scanning side data YI is intentionally set to "1".

Figure 11:
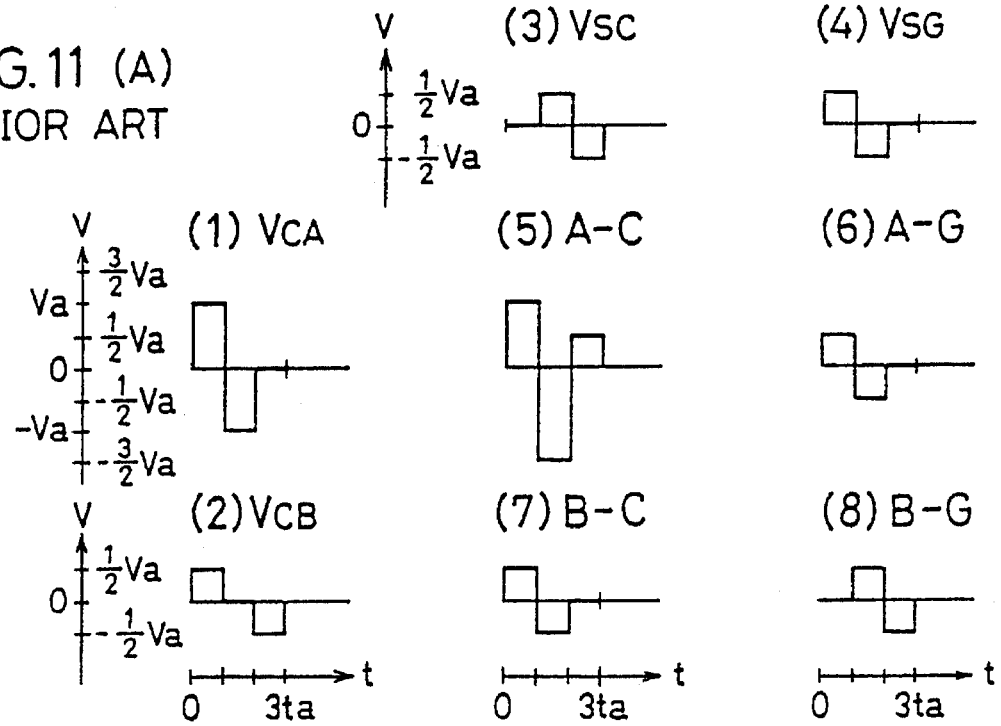
FIG. 11 (A) PRIOR ART
FIGS. 11(A) and 11(B) are views showing a voltage waveform applied to the scanning electrodes, the signal electrodes and the pixels used in the conventional panel.
Figure 11:
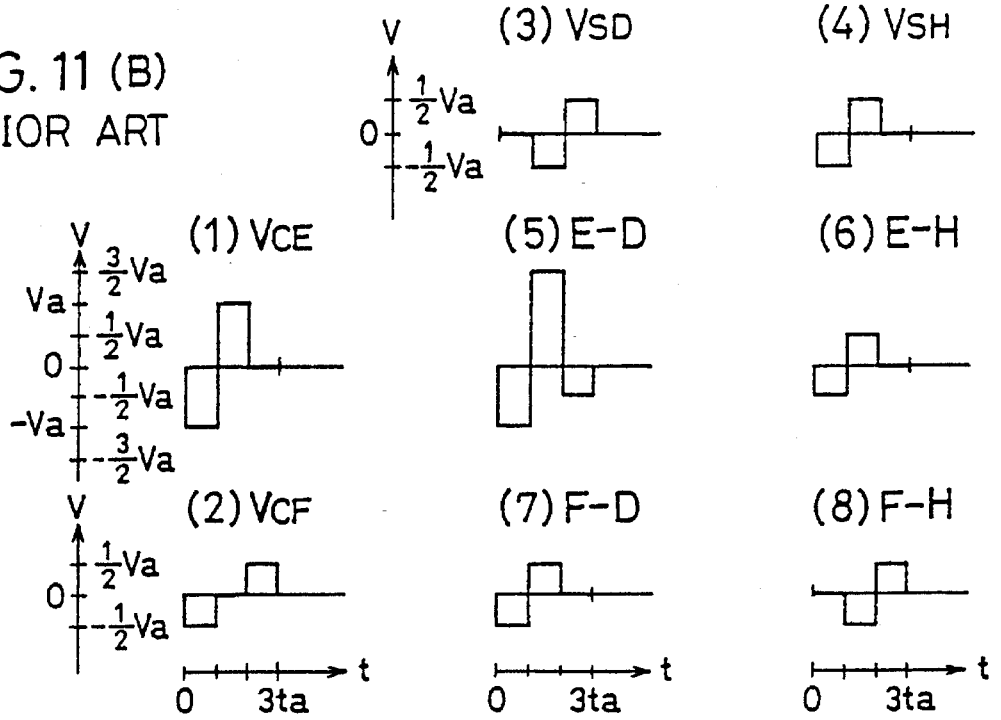
FIG. 11 (B) PRIOR ART
Figure 12:
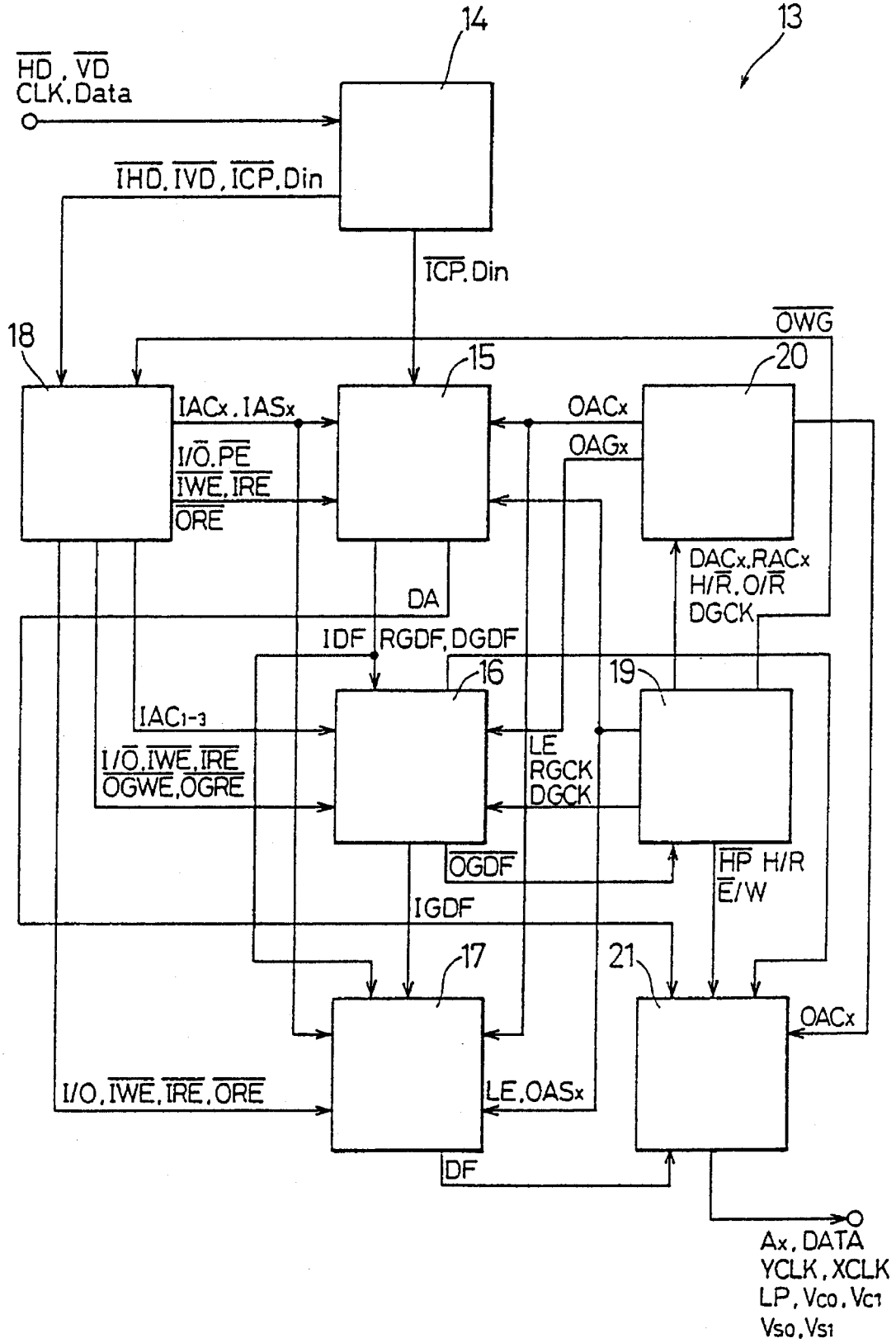
FIG.12 PRIOR ART
FIG. 12 is a block diagram showing a general construction of the display control device used in the conventional display system.
Figure 13:
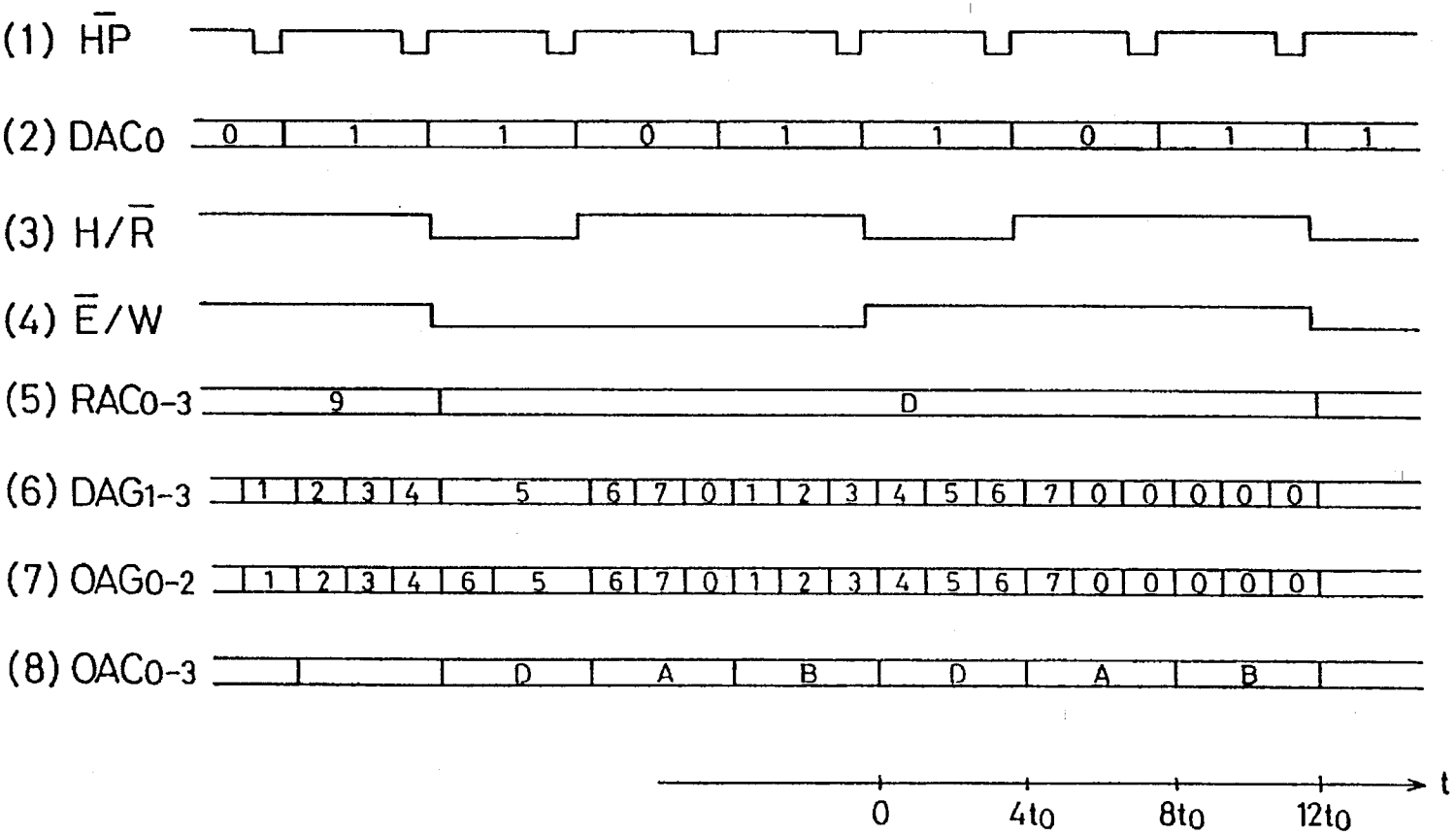
FIG.13 PRIOR ART
FIG. 13 is a timing chart for illustrating the behavior of the display control device used in the conventional display system.
Figure 14:
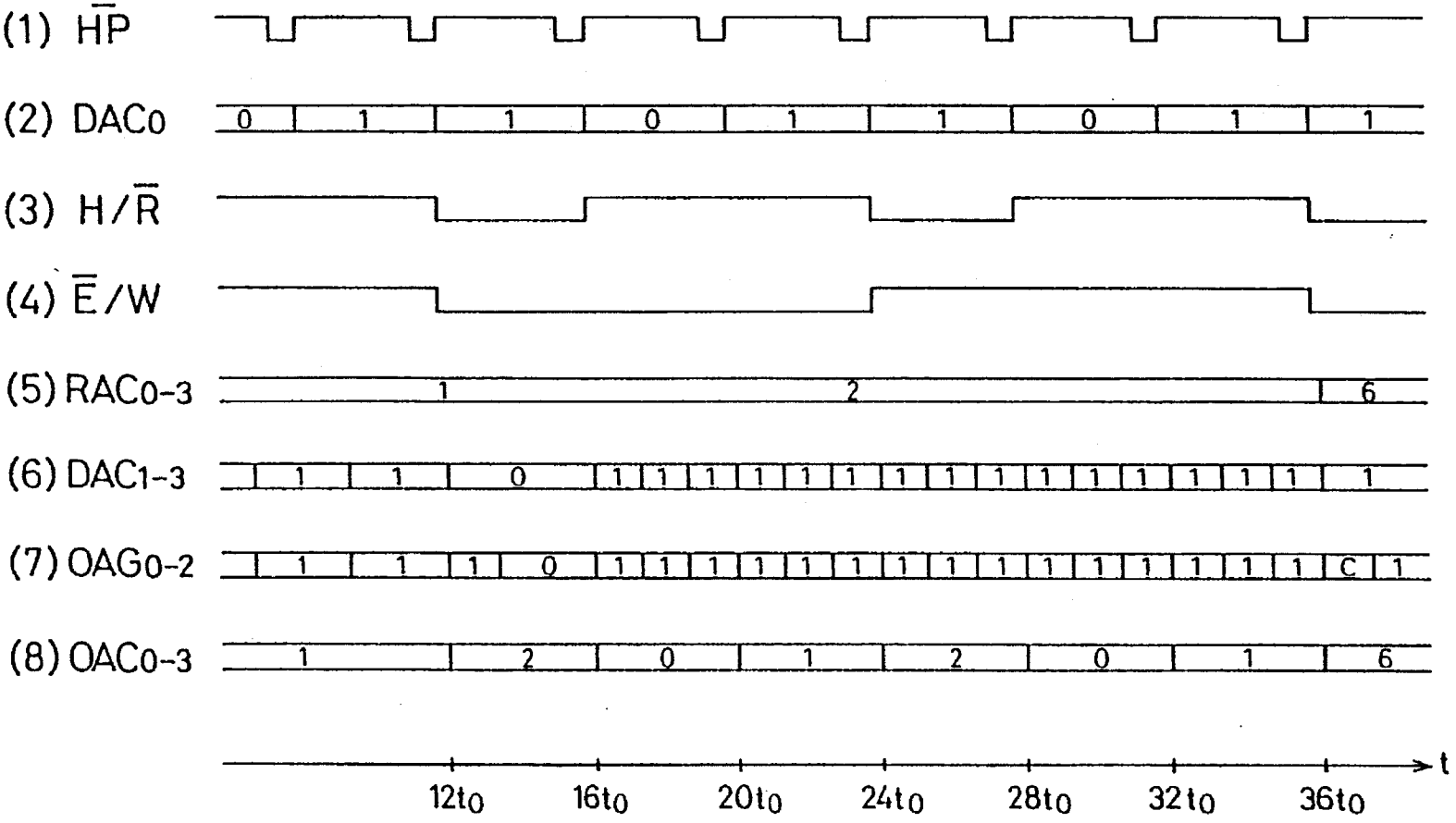
FIG.14 PRIOR ART
FIG. 14 is a timing chart for illustrating the behavior of the display control device used in the conventional display system.
Figure 15:
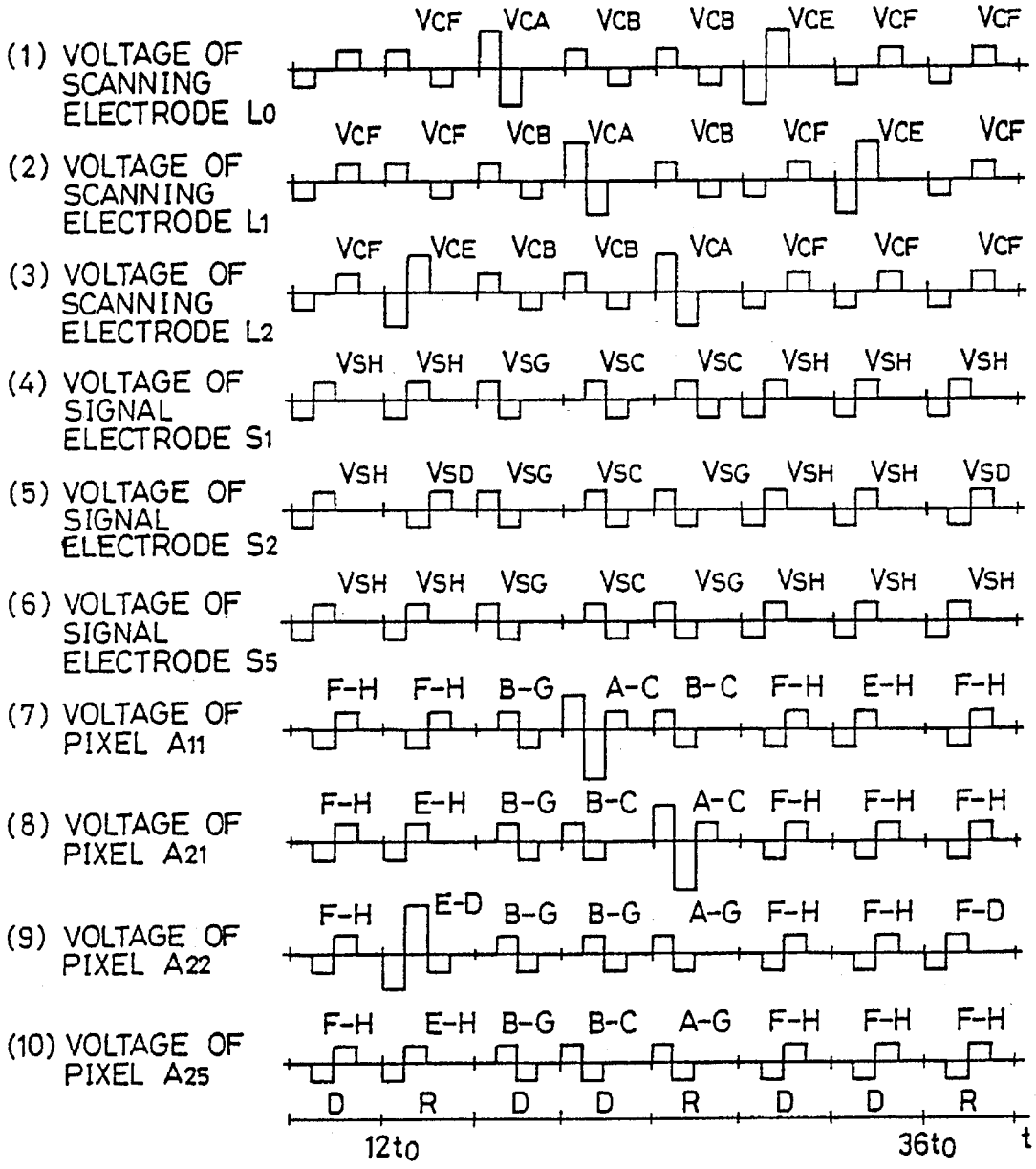
FIG.15 PRIOR ART
FIG. 15 is a waveform view showing voltage waveforms applied to several scanning electrodes, signal electrodes and pixels in the prior art.

It is possible to use the combination of voltage waveforms shown in FIGS. 11A and 11B illustrating conventional embodiments. However, since a liquid crystal exhibiting the voltage-to-memory pulse width properties shown in FIG. 16, the combination of voltage waveforms shown in FIGS. 21A and 21B will be used here.

In other words, the waveform shown by (1) in FIG. 21A is applied to the scanning electrode $L_i$. The waveform constitutes a select voltage $V_{CA}$ that rewrites the display state of the pixel $A_{ij}$ on the scanning electrode into one display state. The waveform shown by (2) in FIG. 21A is applied to another scanning electrode $L_k(k \neq 1)$. The waveform constitutes anon-select voltage $V_{CB}$ that prevent rewriting the display state of the pixel $Ak_i$. The waveform shown by (3) in FIG. 21A is applied to the signal electrode $S_j$ and constitutes a rewriting voltage $V_{sc}$ that rewrites into one display state the display state of the pixel $A_{ij}$ on the scanning electrode $L_i$ to which the select voltage $V_{CA}$ is applied. On the other hand, the waveform shown by (4) in FIG. 21A is applied to the signal electrode $S_j$. The waveform constitutes a holding voltage $V_{SG}$ that does not rewrite the display state of the pixel $A_{ij}$ on the scanning electrode $L_i$ to which the select voltage $V_{CA}$ is applied. Reference Numerals (5) through (8) designate the waveforms of the voltage actually applied to the pixel. Out of the above waveforms, the waveform shown by (5) in FIG. 21A constitutes the voltage waveform A-C applied to the pixel $A_{ij}$ when the select voltage $V_{CA}$ is applied to the scanning electrode $L_i$, and a rewriting voltage $V_{SC}$ is applied to the signal electrode $S_j$. The waveform shown by (6) in FIG. 21A designates the waveform of the voltage A-G applied to the pixel $A_{ij}$ when the select voltage is applied to the scanning electrode $L_1$ and the holding voltage $V_{SG}$ is applied to the signal electrode $S_j$. The waveform shown by (7) in FIG. 21A designates the voltage waveform B-C applied to the pixel $A_{kj}$ when the non-select voltage $V_{CB}$ is applied to the scanning electrode $L_k$ and the rewriting voltage $V_{SC}$ is applied to the signal electrode $S_j$. The waveform shown by (8) in FIG. 21A designates the voltage waveform B-G applied to the pixel $A_{kj}$ when the non-select voltage $V_{CB}$ is applied to the scanning electrode $L_k$ and the holding voltage $V_{SG}$ is applied to the signal electrode $S_j$.

On the other hand, the waveform shown by (1) in FIG. 21B is the select voltage $V_{CE}$ applied to the scanning electrode $L_i$ to permit rewriting the display state of the pixel $A_{ij}$ into another display state. The waveform shown by (2) in FIG. 21B designates the non-select voltage $V_{CE}$ applied to other scanning electrodes $L_K$ to prevent rewriting the display state of the pixel $A_{kj}$. The waveform shown by (3) in FIG. 21B designates the rewriting voltage $V_{SD}$ applied to the signal electrode $S_j$ to permit the rewriting into another state the display state of the pixel $A_{ij}$ on the scanning electrode $L_i$ to which the select voltage $V_{CE}$ is applied. The waveform shown by (4) in FIG. 21B designates the holding voltage $V_{SH}$ applied to the signal electrode $S_j$ to prevent rewriting the display state of the pixel $A_{ij}$ on the scanning electrode $L_A$ to which the select voltage $V_{CE}$ is applied. Reference Numerals (5) through (8) in FIG. 21B designate voltage waveforms actually applied to pixels. Out of them, the waveform shown by (5) in FIG. 21B designates the voltage waveform E-D applied to the pixel $A_{ij}$ when the select voltage $V_{CE}$ is applied to the scanning electrode $L_i$ and the rewriting voltage $V_{SD}$ is applied to the signal electrode $S_j$. The waveform shown by (6) in FIG. 21B designates the voltage waveform E-H applied to the pixel $A_{ij}$ when the select voltage $V_{CE}$ is applied to the scanning electrode $L_i$ and the holding voltage $V_{SH}$ is applied to the signal electrode $S_j$. The waveform shown by (7) in FIG. 21B designates the voltage waveform F-D applied to the pixel $A_{kj}$ when the non-select voltage $V_{CF}$ is applied to the scanning electrode $L_k$ and the rewriting voltage $V_{SD}$ is applied to the signal electrode $S_j$. The waveform shown by (8) in FIG. 21B designate the voltage waveform F-H applied to the pixel $A_{kj}$ when the non-select voltage $V_{eF}$ is applied to the scanning electrode $L_k$ and the holding voltage $V_{SH}$ is applied to the signal electrode $S_j$.

Figure 21:
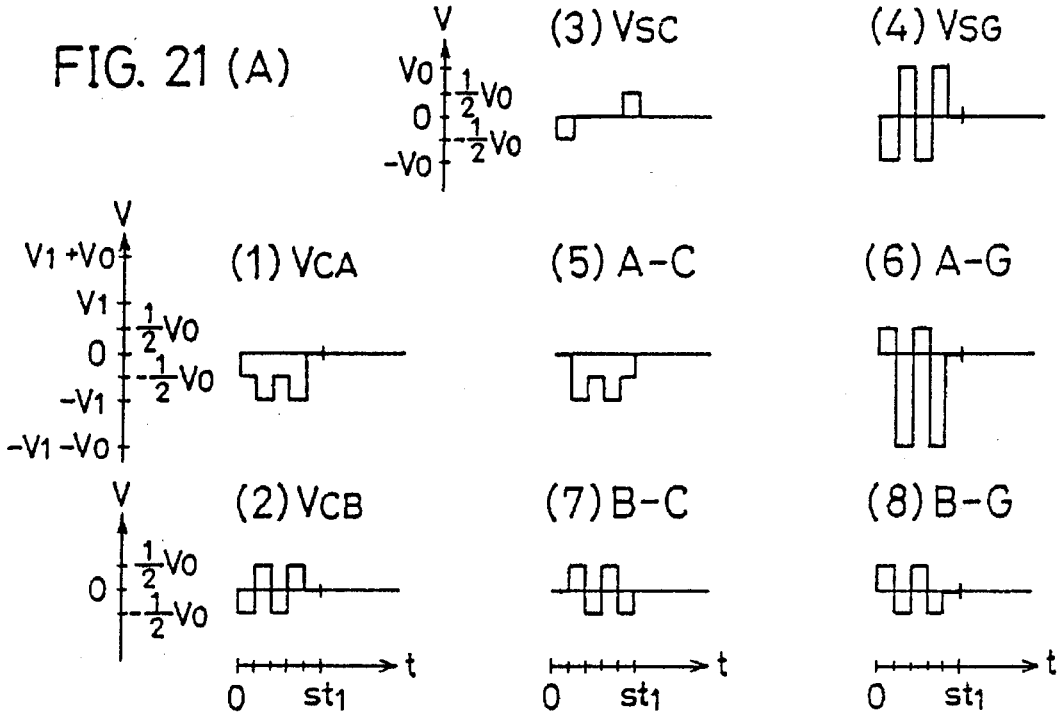
FIGS. 21(A) and 21(B) are waveform-views showing waveforms applied to scanning electrodes, signal electrodes and pixels used in an embodiment according to the present invention.
Figure 21:
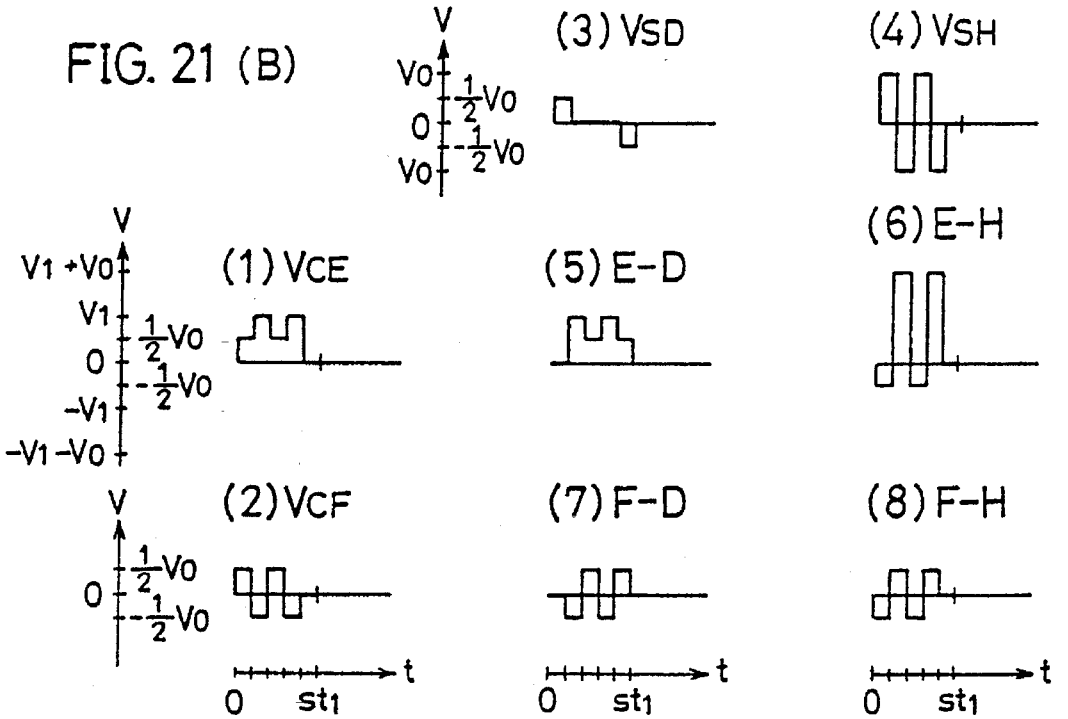
Figure 22:
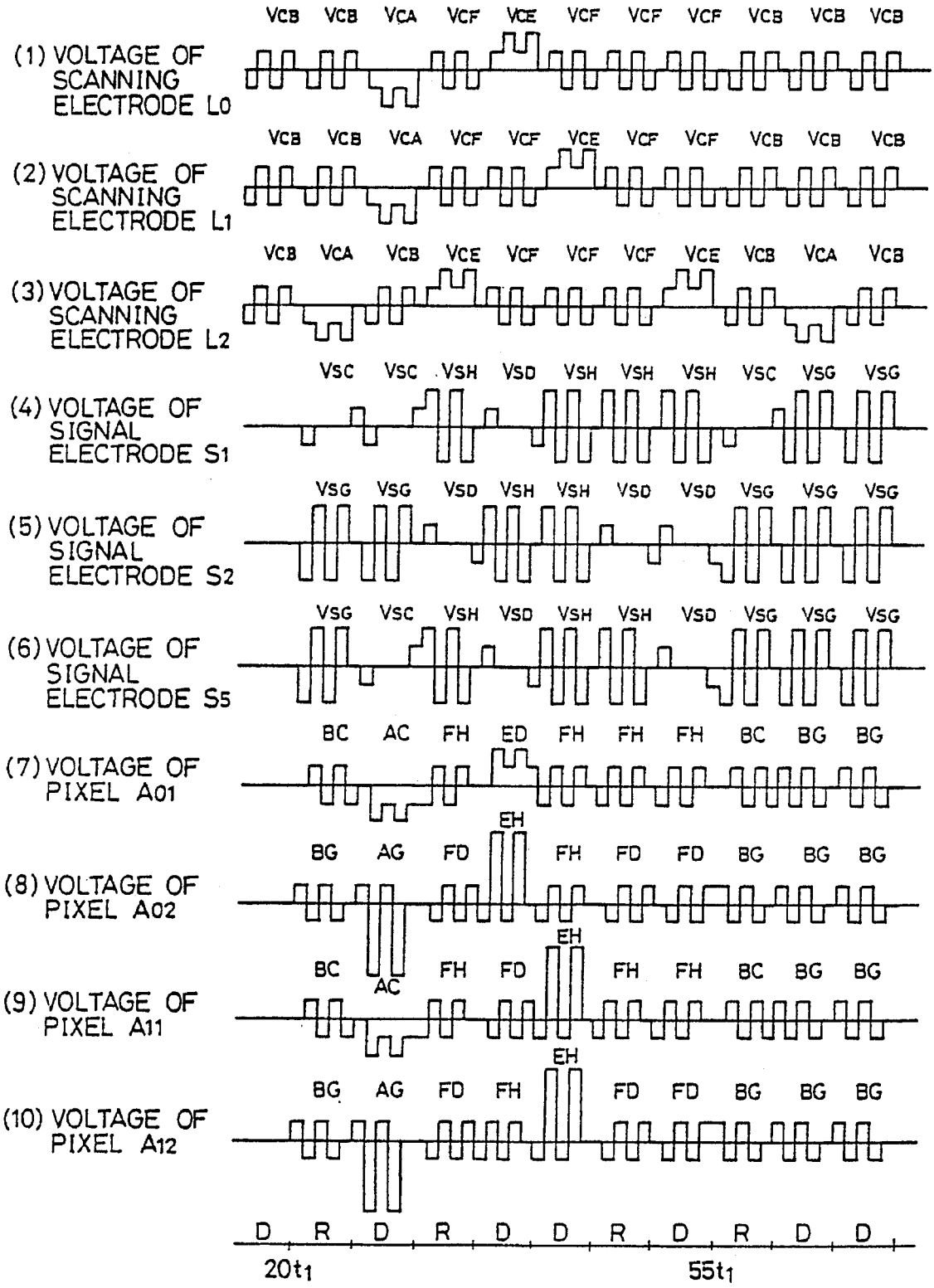
FIG. 22 is a waveform view showing several voltage waveforms applied to scanning electrodes, signal electrodes and pixels used in an embodiment according to the present invention.

FIG. 22 shows voltages applied to scanning electrodes $L_0$, $L_1$ and $L_2$, signal electrodes $S_1$, $S_2$ and $S_5$, and pixels $A_{01}$, $A_{11}$ and $A_{12}$ by using a combination of this driving method and the driving waveforms. The waveform shown by (1) in FIG. 22 is the voltage waveform applied to the scanning electrode $L_0$, the waveform shown by (2) in FIG. 22 is the voltage waveform applied to the scanning electrode $L_1$, and the waveform shown by (3) in FIG. 22 is the voltage waveform applied to the scanning electrode $L_2$. After the scanning electrode $L_2$ is subjected to the interlaced scanning by using a combination of the voltage waveforms of FIG. 21 (A), the scanning electrodes $L_0$ and $L_1$ are simultaneously subjected to select partial erasing scanning. Then after the scanning electrode $L_2$ is subjected to the interlaced scanning by using a combination of voltage waveforms of FIG. 21 (B), the scanning electrode $L_0$ is subjected to partial rewriting scanning and the scanning electrode $L_1$ is subjected to partial rewriting scanning. The waveform shown by (4) in FIG. 22 is the voltage waveform applied to the signal electrode $S_1$, and the waveform shown by (5) in FIG. 22 is the voltage waveform applied to the signal $S_2$. The waveform shown by (6) in FIG. 22 is the voltage waveform applied to the signal electrode $S_5$. As a consequence, to the pixel $A_{01}$ is applied the waveform shown by (7) in FIG. 22 whereas to the pixel $A_{02}$ is applied the voltage waveform shown by (8) in FIG. 22. To the pixel $A_{11}$ is applied the voltage waveform shown by (9) in FIG. 22. To the pixel $A_{12}$ is applied the voltage waveform shown by (0) in FIG. 22. In other words, to the pixel $A_{01}$ shown by (7) in FIG. 22 in which the data of the transmemory circuit 32 shown in FIG. 9 exhibits "the presence of variation" and the data of the data memory 30 shown in FIG. 7 exhibits the bright state, is applied the voltage waveform A-C shown in FIG. 22(A) during the select partial erasing period. After the dark state is thus given, the voltage waveform E-D shown in FIG. 22(B) is applied during the partial rewriting period to provide the bright state. On the other hand, to the pixel $A_{11}$ shown by (9) in FIG. 22 in which the data of the transmemory circuit 32 shown in FIG. 9 exhibits the presence of variation and the data of the data memory 30 shown in FIG. 7 assumes the dark state is applied the voltage waveform A-C shown in FIG. 22 (A) during the select partial rewriting period. After the dark state is given, the voltage waveform E-H shown in FIG. 22(B) is applied during the partial rewriting period to hold the display state. Further to the pixel $A_{02}$ shown by (8) in FIG. 22 and to the pixel. $A_{12}$ shown by (10) in FIG. 22 in which the data of the transmemory circuit 32 shown in FIG. 9 exhibits the absence of variation is applied the voltage waveform A-G shown in FIG. 22(B) during the select partial erasing period to hold the display state. During the partial rewriting period, the voltage waveform E-H shown in FIG. 22(B) is applied to hold the display state. In this way, to the pixel $A_{02}$ and $A_{12}$ in which the data of the transmemory circuit 32 shown by FIG. 9 exhibits the absence of data is applied only the voltage waveform A-G shown by FIG. 22(A) for holding the display or the voltage waveform E-H shown by FIG. 22(B). Consequently, no flicker is generated which results from rewriting a pixel whose display is not changed. In addition, even when no change occurs in the display of the pixel, the pixel $A_{01}$ having an adjacent pixel whose display is changed can be rewritten. Flickers generated by such pixel becomes obscure due to change in the display state of adjacent pixel $A_{11}$. Because of such principle, simultaneous-selection of a plurality of scanning electrodes does not produce flickers which results from rewriting pixels whose display does not change. Besides, applying a select voltage simultaneously to the plurality of scanning electrodes enables driving that can shorten the partial scanning period. Incidentally with respect to the voltages $V_{C1}$, $V_{C0}$, $V_{S1}$ and $V_{S0}$ output from the driving control circuit 33, when the voltage mode EN/W assumes the value "1", as a combination of voltage waveforms for rewriting the pixel into another stable state, the voltage waveform $V_{CE}$ shown in FIG. 21(B) is output as $V_{C1}$, $V_{CF}$ as $V_{CO}$, $V_{SD}$ as $V_{SI}$, $V_{SH}$ as $V_{SO}$. When the voltage mode EN/W assumes the value "0", as a combination of voltage waveforms for either rewriting the pixel into another stable state or holding it, the voltage waveform $V_{CA}$ shown in FIG. 21(A) is output as $V_{CI}$, $V_{CB}$ as $V_{CO}$, $V_{SC}$ as $V_{SI}$, and $V_{SG}$ as $V_{SO}$.

In the above embodiment, thee voltage waveform A-C shown in FIG. 22(A) is treated as a voltage that generates the dark display state of pixels. However, the dark display state and the bright display state depends on the combination of polarizing plates. The voltage waveform A-C shown in FIG. 22(A) can be a voltage that can provide a bright display state of the pixel.

Figure 23:
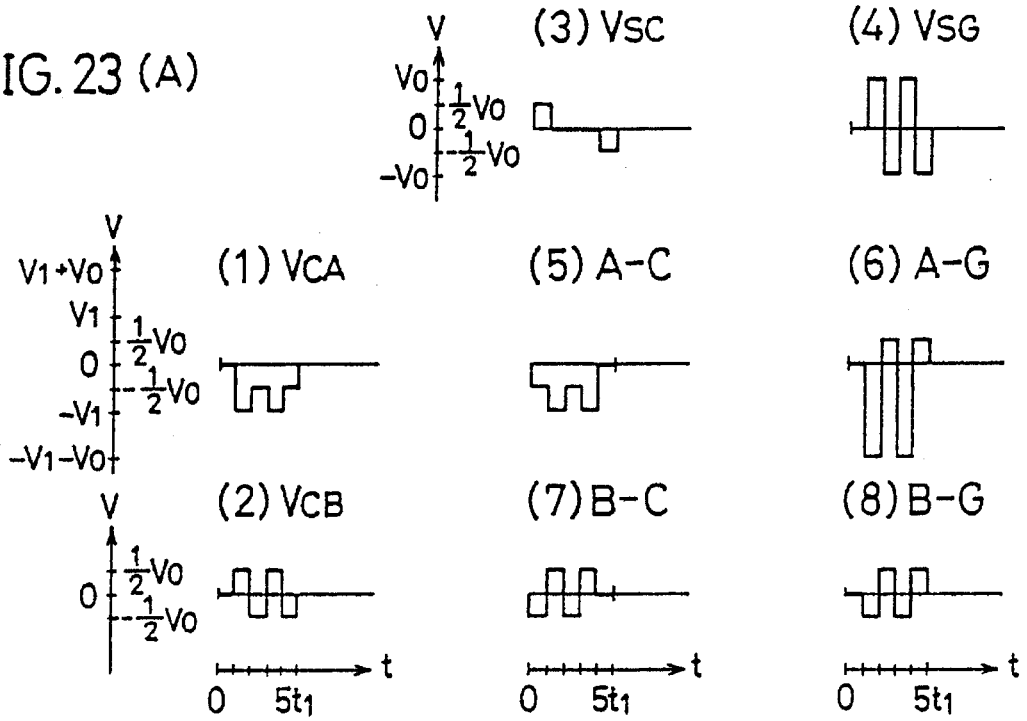
FIGS. 23(A) and 23(B) are waveform views showing several examples of voltage waveforms applied to several scanning electrodes, signal electrodes and pixels in an embodiment according to the present invention.
Figure 23:
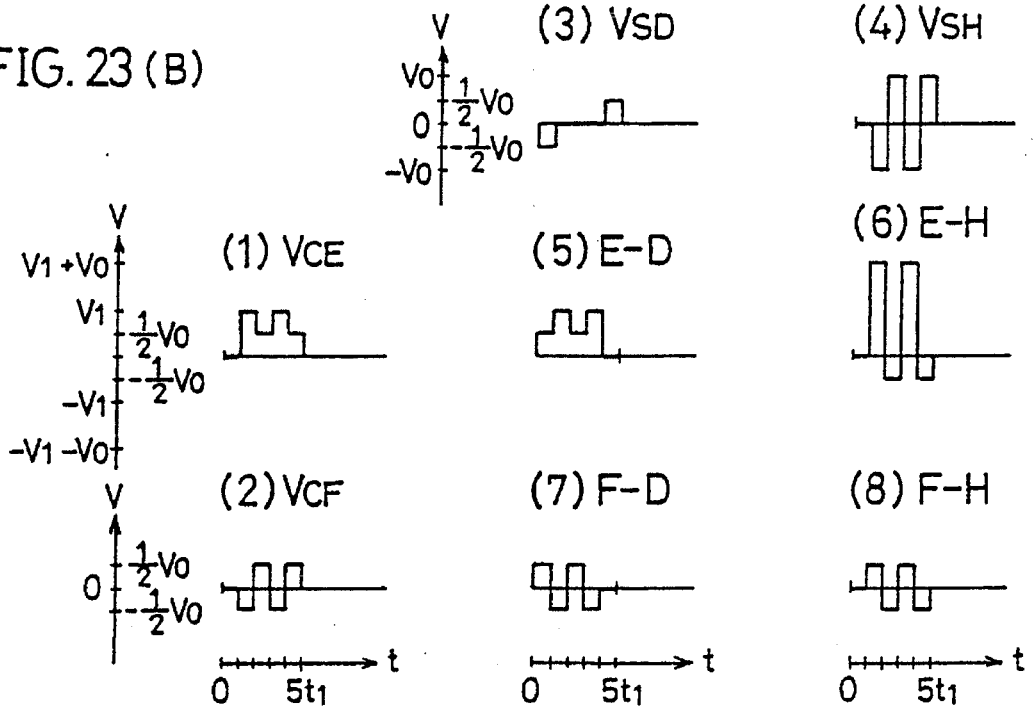
Figure 24:
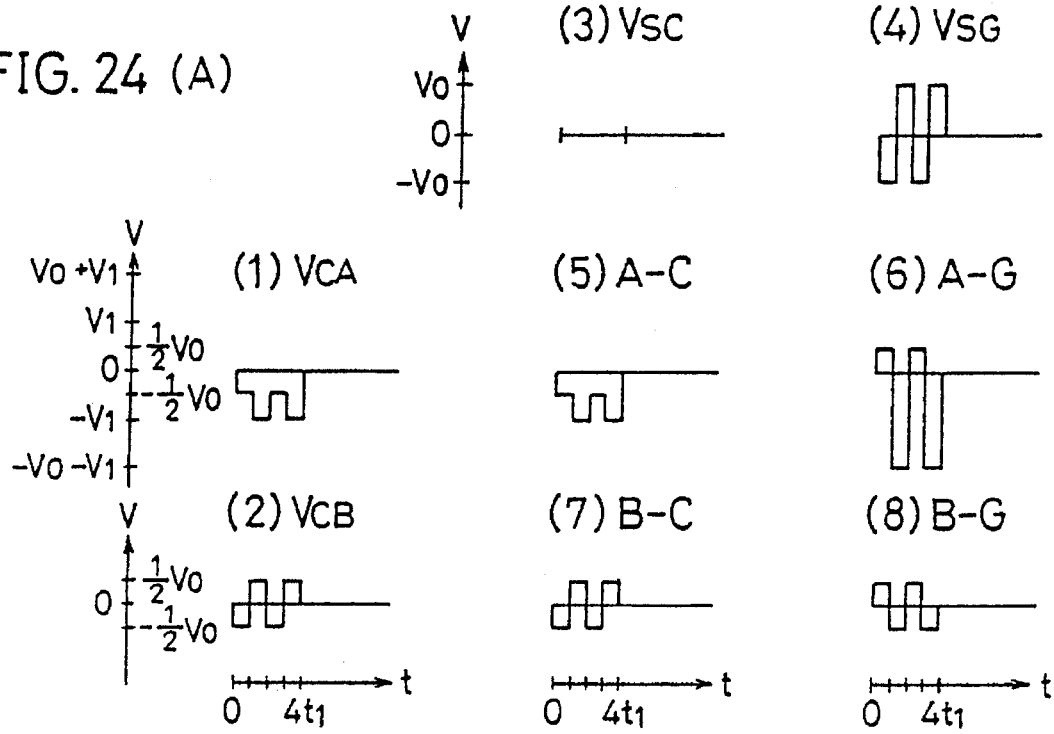
FIGS. 24(A) and 24(B) are waveform views showing several examples of voltage waveforms applied to scanning electrodes, signal electrodes and pixels that can be used in an embodiment according to the present invention.
Figure 24:
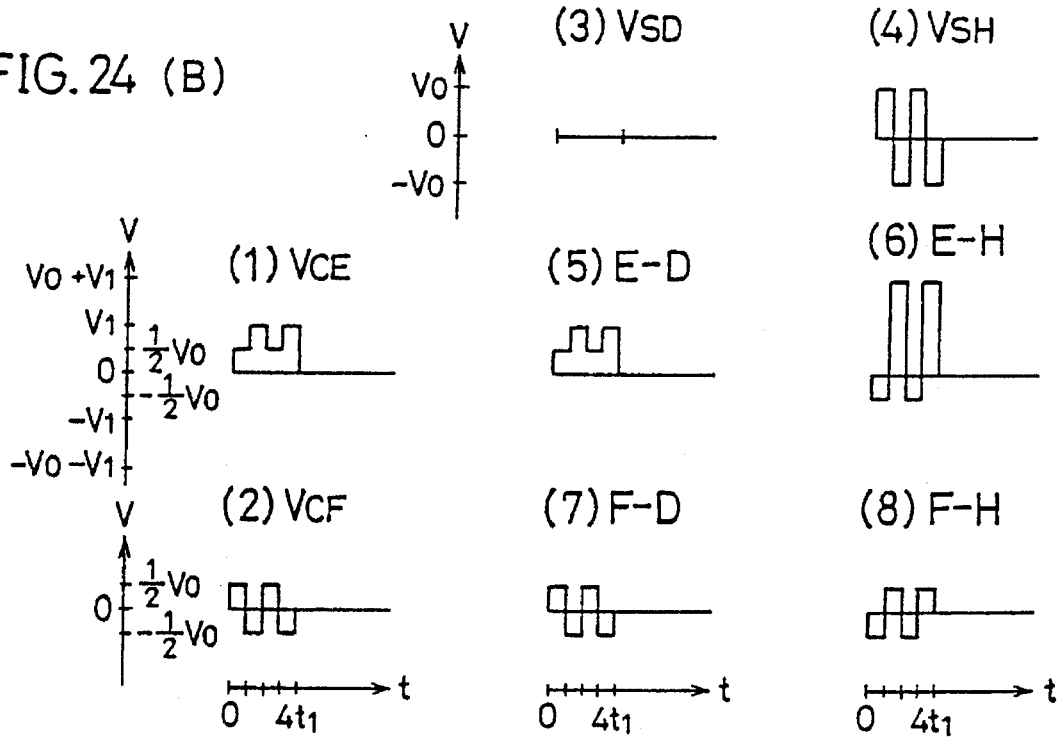
Figure 25:
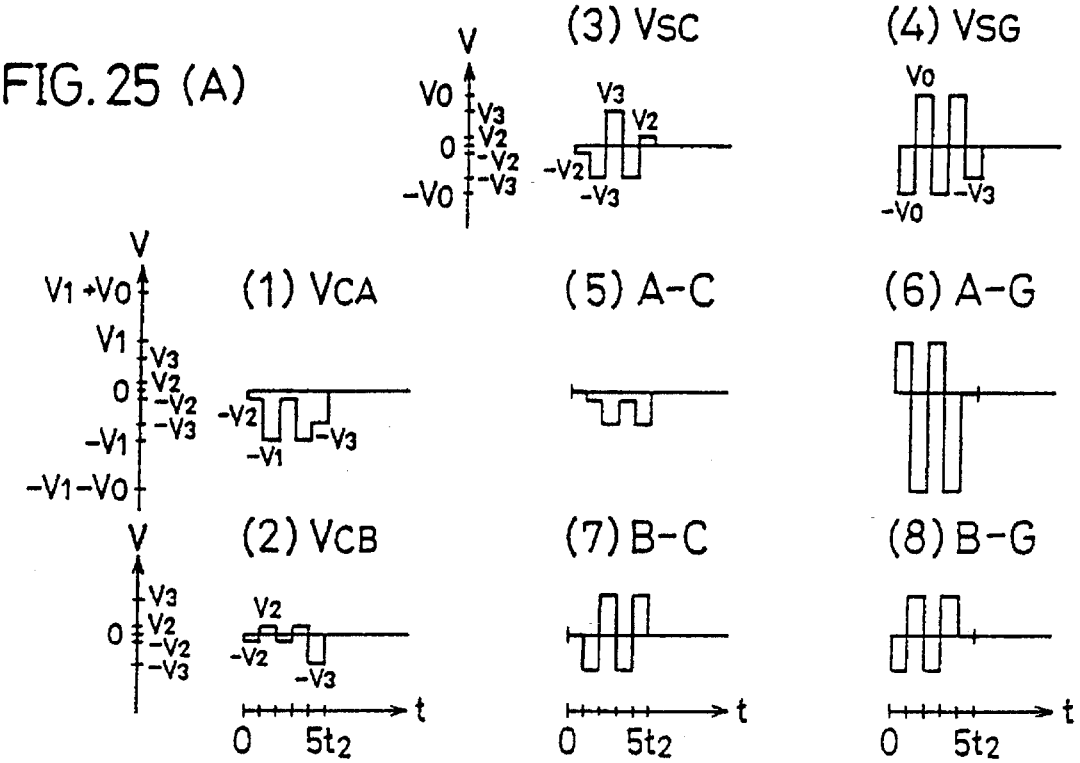
FIGS. 25(A) and 25(B) are waveform views showing several examples of voltage waveforms applied to scanning electrodes, signal electrodes and pixels that can be used in an embodiment according to the present invention.
Figure 25:
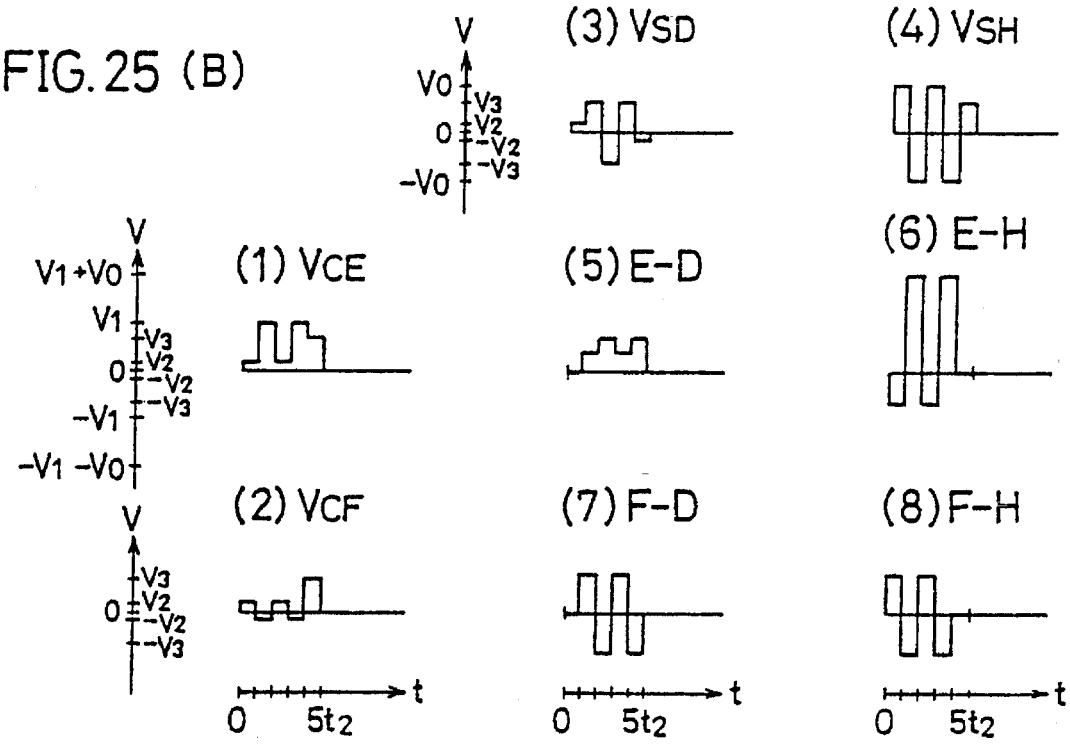
Figure 26:
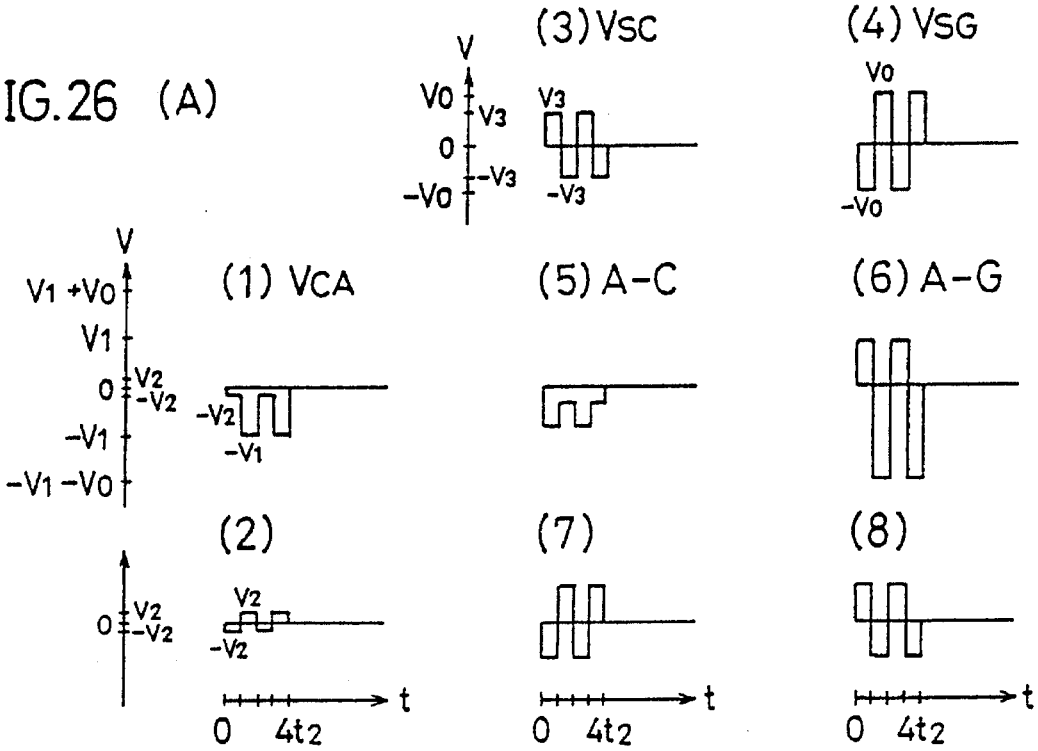
FIGS. 26(A) and 26(B) are waveform views showing several examples of voltage waveforms applied to scanning electrodes, signal electrodes and pixels that can be used in an embodiment according to the present invention.
Figure 26:
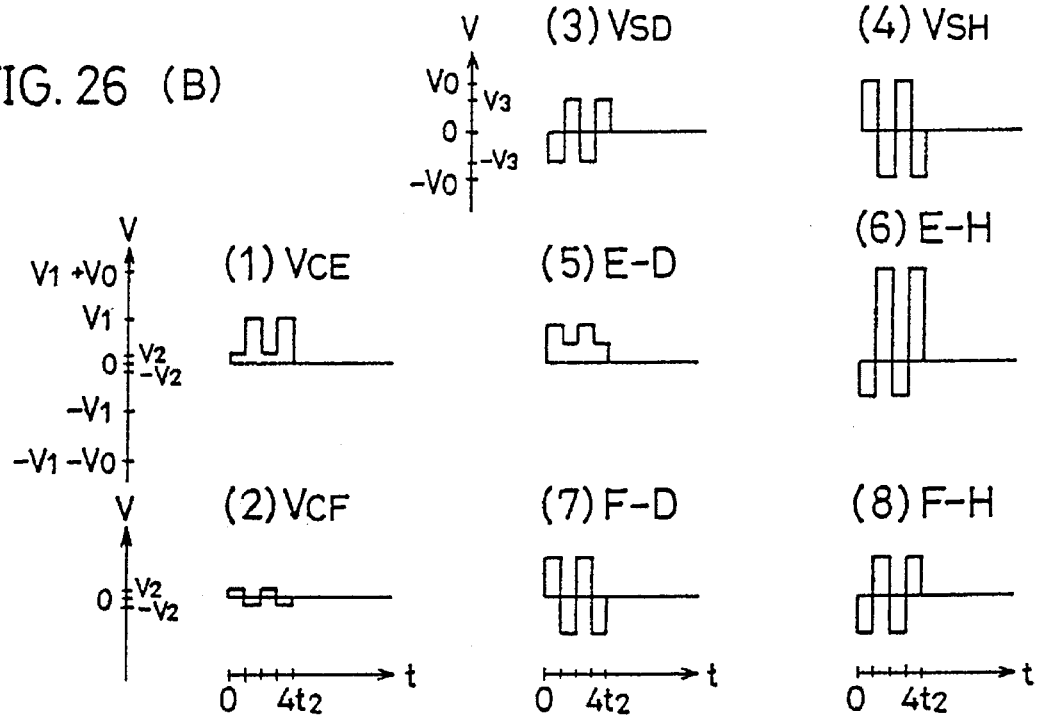

Quite naturally the combination of voltage waveforms shown in-FIGS. 23 through 261 may be used in the place of the combination of voltage waveforms shown in FIG. 21. Since the effect of the combination of voltage waveforms shown in FIGS. 23 through 26 is identical-to the counterpart of the combination of voltage waveforms shown in FIG. 21, the description will be omitted. Besides in the combination of voltage waveforms shown in FIG. 21 as well as in FIGS. 23 through 26, the waveforms are repeated twice. Overlapping the waveform that is shifted from each waveform by time 4t forms a combination of voltage waveforms with four times repetition. Thus the repetition number of times can be determined quite voluntarily. For simplicity of the drawings, a combination of voltage waveforms having a repetition time of twice.

By the way, the quantity of transmitted light in a pixel to which is applied a voltage waveform comprising voltages $V_0/2$ and $-V_1-V_0$ shown by 6) in FIG. 21A is determined to be equal to the quantity of transmitted light in a pixel to which is applied a Voltage waveform comprising voltages $V_0/2$ and $-V_0/2$ shown by 7) and 8) in FIG. 21A. That is because when a liquid crystal material exhibiting voltage-to-memory pulse width properties of FIG. 16 force given to the FLC molecules remains approximately the same both at the application of the combination of voltages $V_0/2$ and $V_0/2$ and at the application of the combination of voltages $V_0/2$ and $-V_1-V_0$ owing to the presence of the voltage. $V_1+V_0$ that gives the same force to the FLC molecules as the voltage $V_O/2$, thereby moving the FCL molecules in the same manner to result in an approximately equal quantity of transmitted light.

Figure 46:
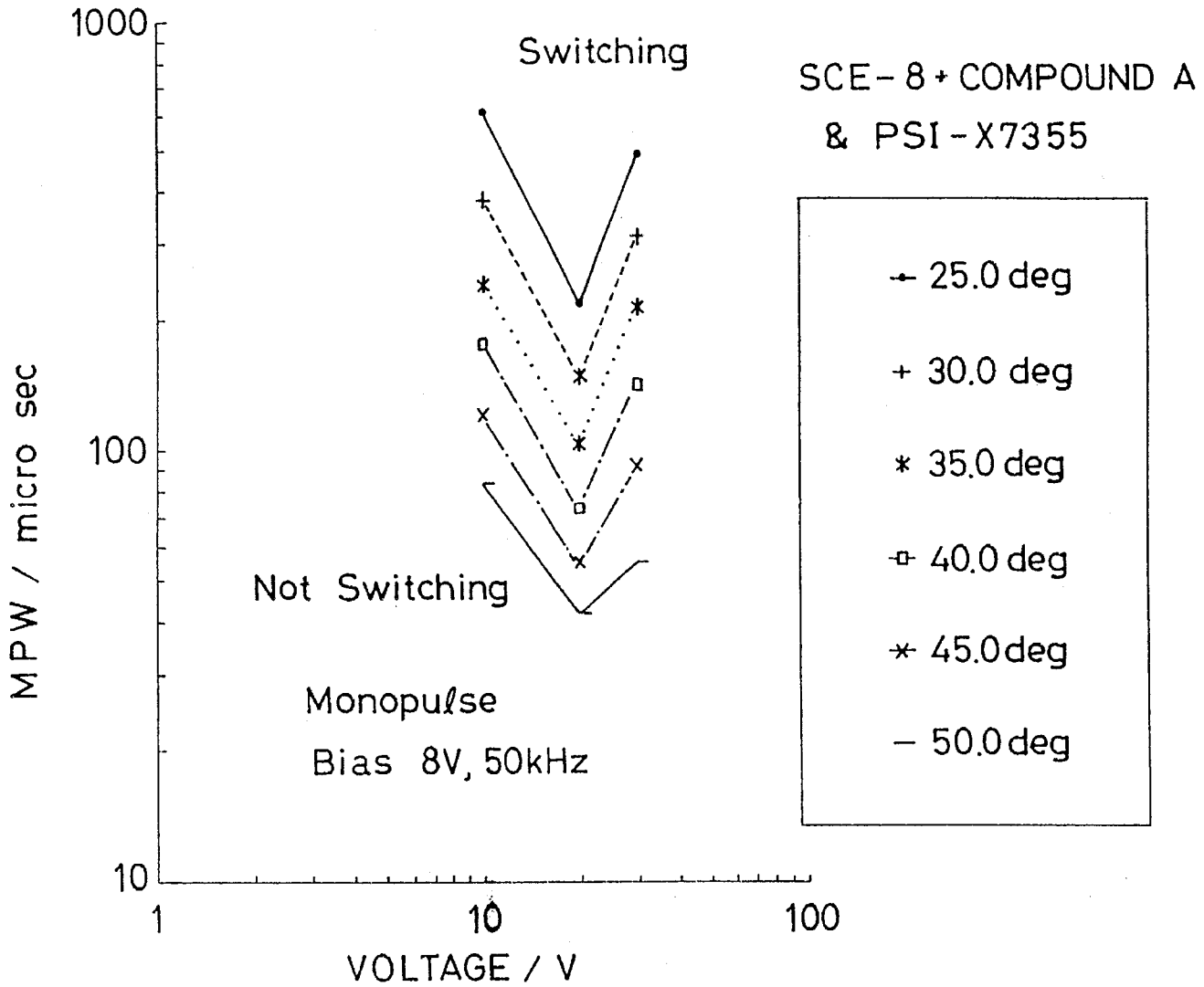
FIG. 46 is a view showing a temperature dependence of the voltage-to-memory pulse width properties in a ferroelectric liquid crystal having a negative dielectric anisotropy.

Furthermore, the memory pulse width of the FLCD largely depends on temperature. Consequently, it is necessary to change the time width $t_1$ of the combination of voltage waveforms of FIG. 21 or the number of times of pulse application in accordance with the temperature dependency. However, the temperature dependency of the voltage at which the memory pulse width is minimized is not so large as shown in FIG. 46. Incidentally, FIG. 46 shows a case in which 20% of compound. A is added to the above SCE-8 as a liquid crystal material. However, the same thing holds true of a case in which SCE-8 was used alone. Then changing the voltage $V_0/2$ with the temperature with the voltage $V_1+V_0$ set at a predetermined value regardless of temperature equalizes the quantity of transmitted light in a pixel to which the voltage waveform of 6 in FIG. 21A with the quantity of transmitted light in a pixel to which the voltage waveform of 7) and 8) in FIG. 21A. This holds true of FIG. 21B, FIG. 23 and FIG. 24. In addition, referring to FIGS. 25 and 26, changing the voltage $V_0-V_2$ provides a display that-makes flickers obscure in the place of the voltage $V_0/2$.

An embodiment of the construction of a display control device 29 for embodying the driving method of the present invention will be shown hereinbelow.

Figure 27:
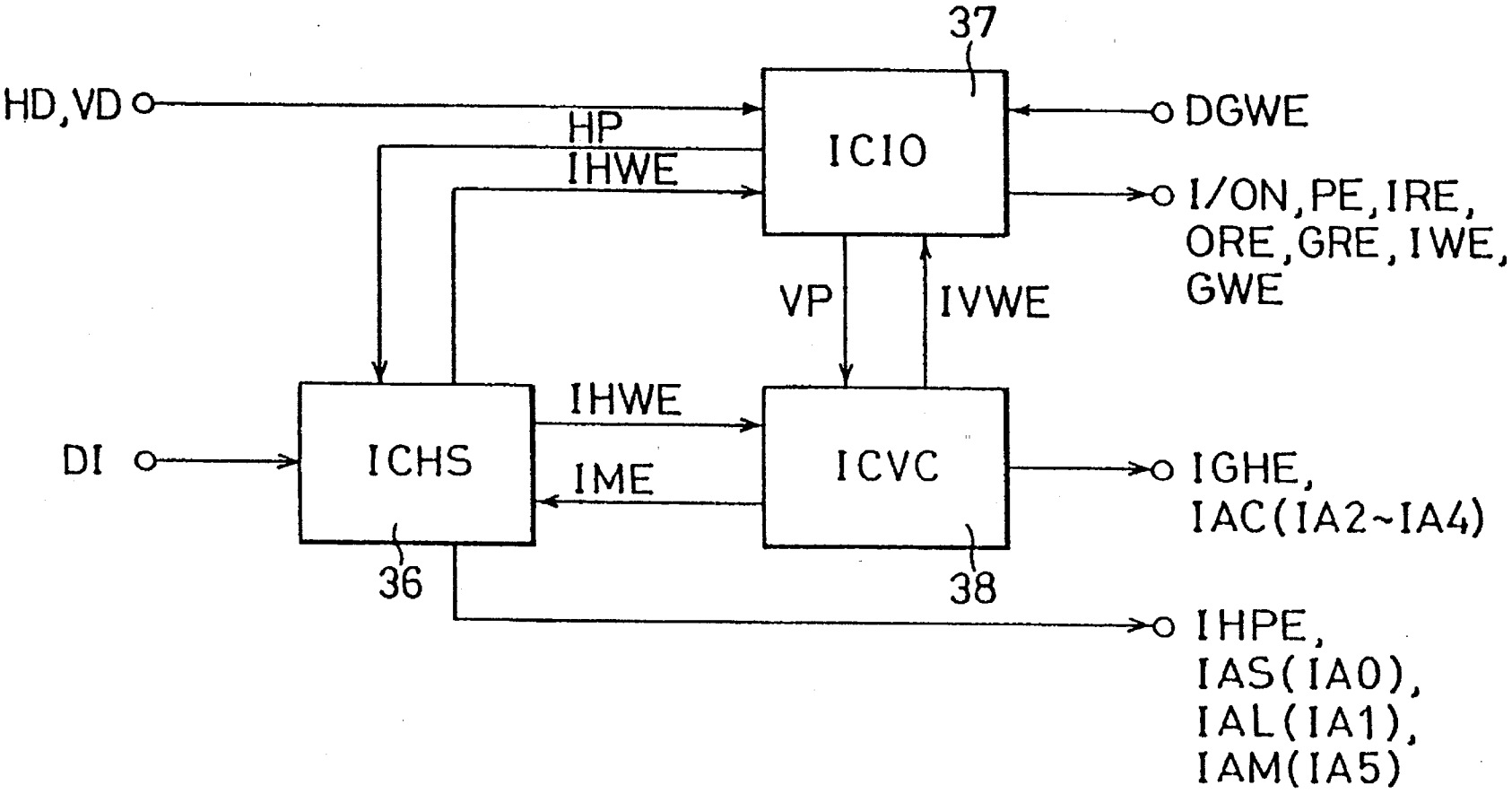
FIG. 27 is a block diagram illustrating a general construction of an input control circuit in the display control device according to the present invention.

FIG. 27 is a block diagram showing a general construction of an input control circuit 33. The input control circuit 33 comprises an ICHS circuit 36, an ICIO circuit 37, and an ICVC circuit 38.

Figure 28:
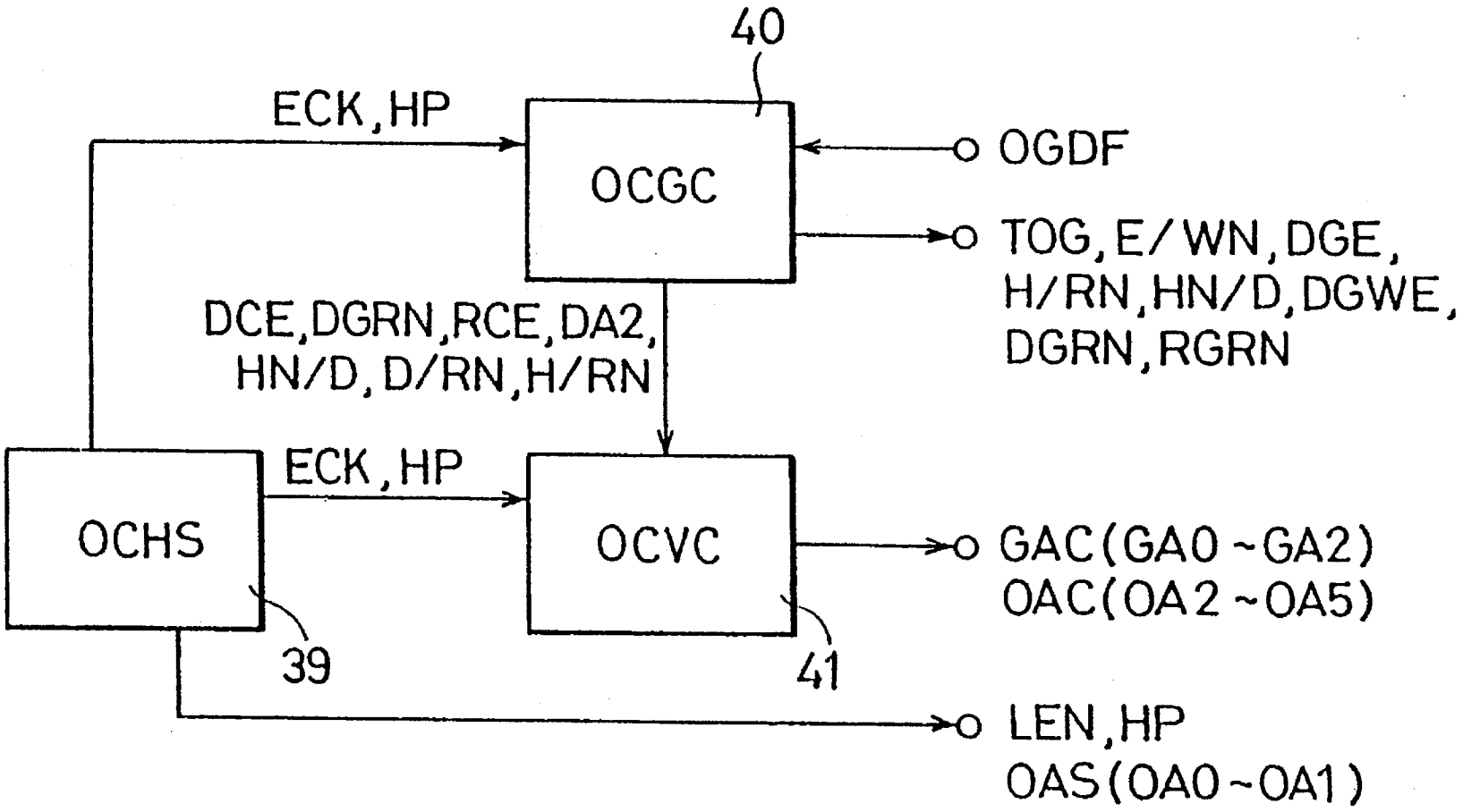
FIG. 28 is a block diagram illustrating a general construction of an output control circuit in a display device according to the present invention.

FIG. 28 is a block diagram showing the general construction of an output control circuit 34. The output control circuit 34 comprises an OCHS circuit 39, an OCGC circuit 40 and an OCVC circuit 41.

Figure 29:
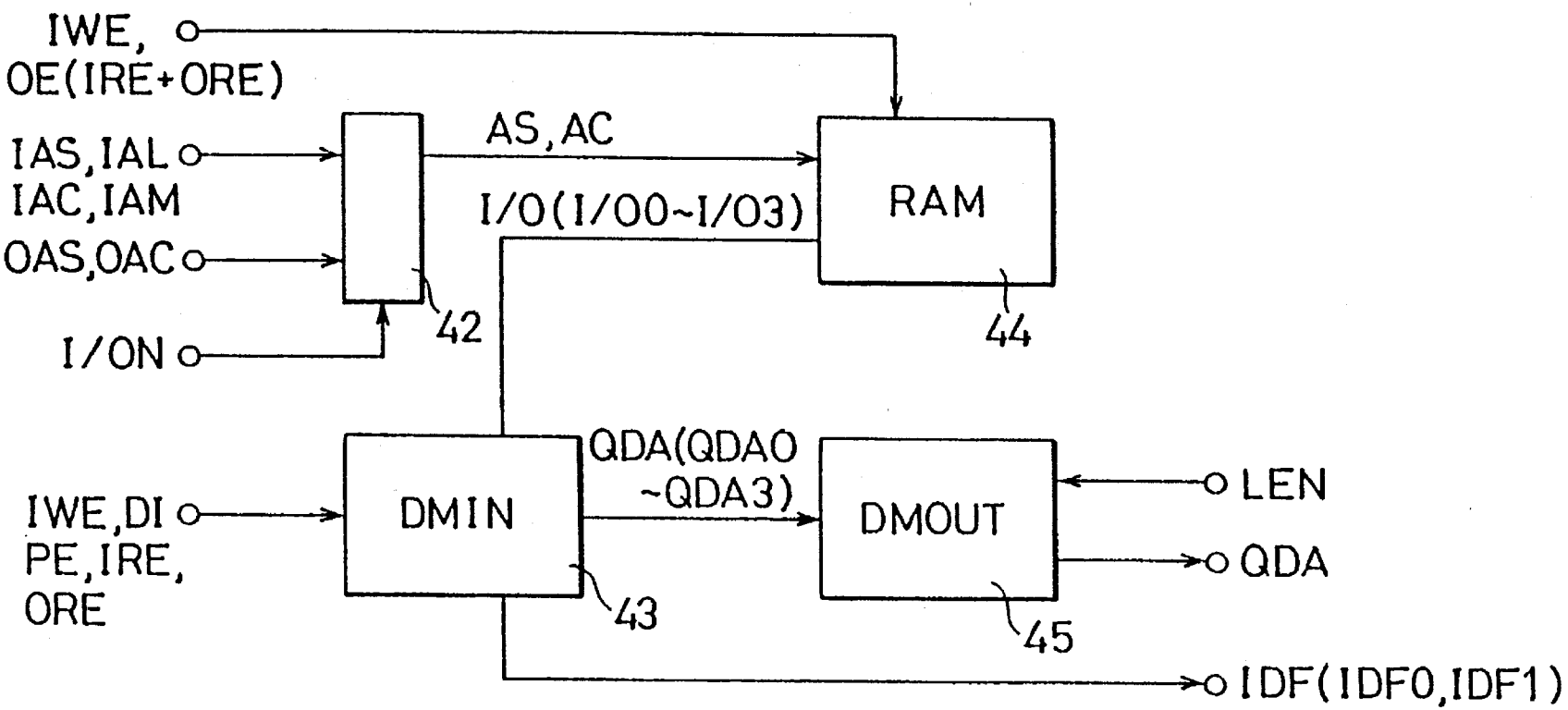
FIG. 29 is a block diagram illustrating a general construction of a data memory circuit in a display device used in an embodiment according to the present invention.

FIG. 29 is a block diagram showing the general construction of a data memory circuit 30. The data memory circuit 30 comprises an address shift-over circuit 42, a DMIN circuit 43, a random access memory (hereinafter referred to as RAM) circuit 44 and a DMOUT circuit 45.

Figure 30:
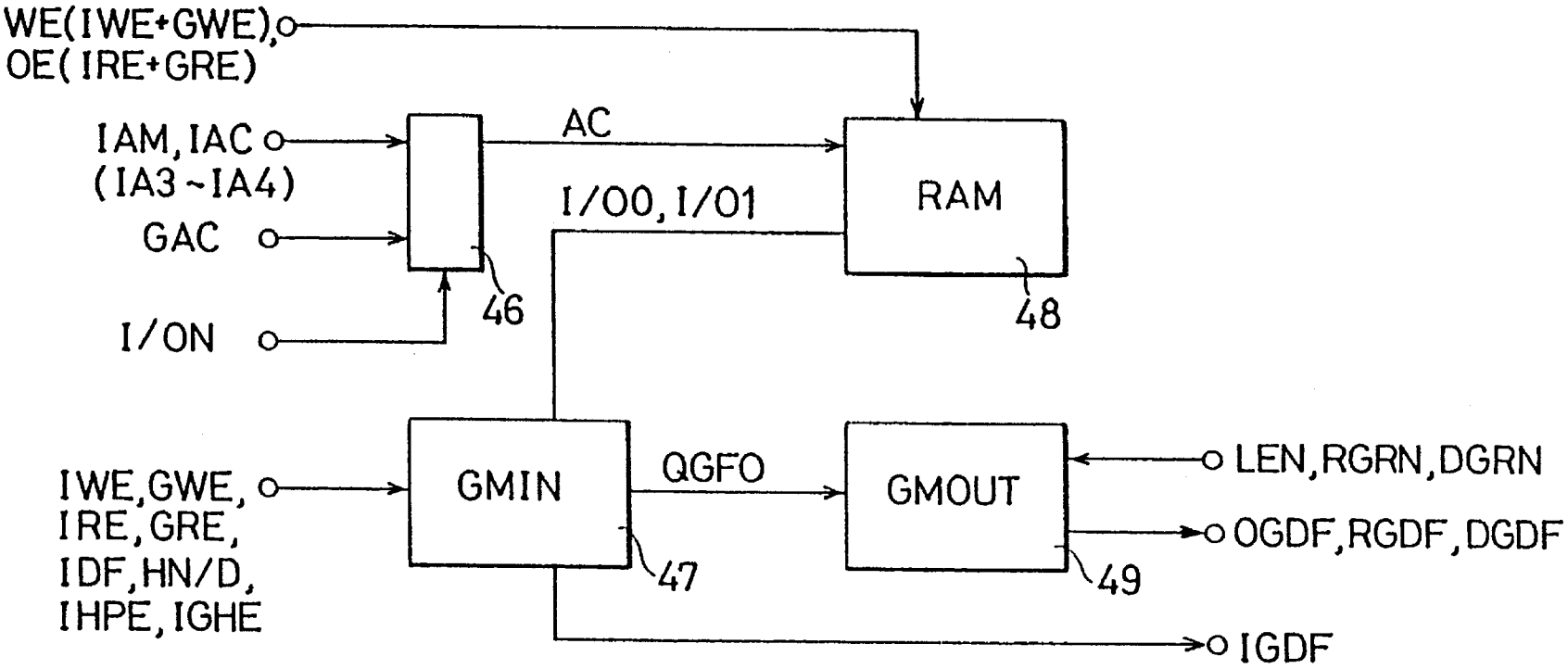
FIG. 30 is a block diagram illustrating a general construction of a group memory circuit in a display device used in an embodiment according to the present invention.

FIG. 30 is a block diagram showing a general construction of a group memory circuit 31. The group memory circuit 31 comprises an address shift-over circuit 46, an GMIN circuit 47, a RAM circuit 48 and a GMOUT circuit 49.

Figure 31:
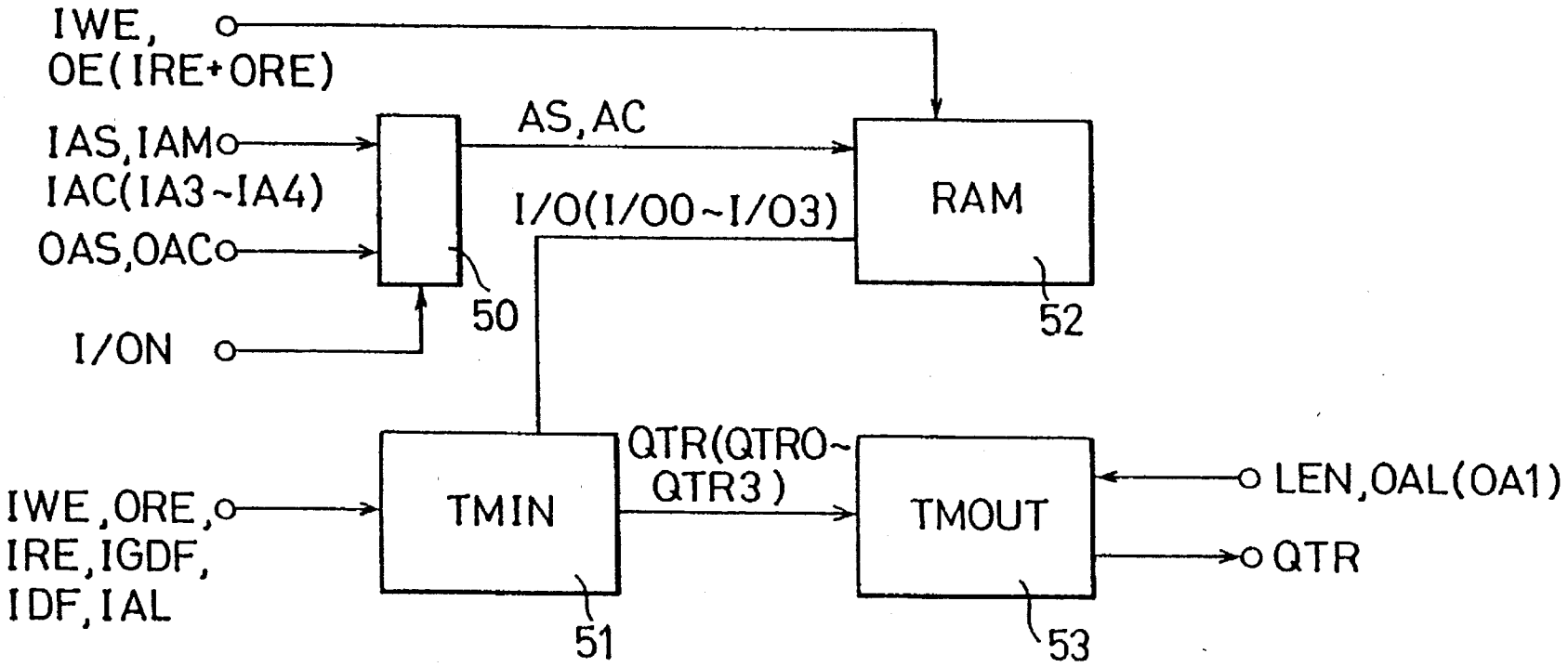
FIG. 31 is a block diagram illustrating a general construction of a transmemory circuit in the display control device according to the present invention.

FIG. 31 is a block diagram showing a general construction of a transmemory circuit 32. The transmemory circuit 32 comprises an address shift-over circuit 50, a TMIN circuit 51, a RAM circuit 52 and a TMOUT circuit 53.

Figure 32:
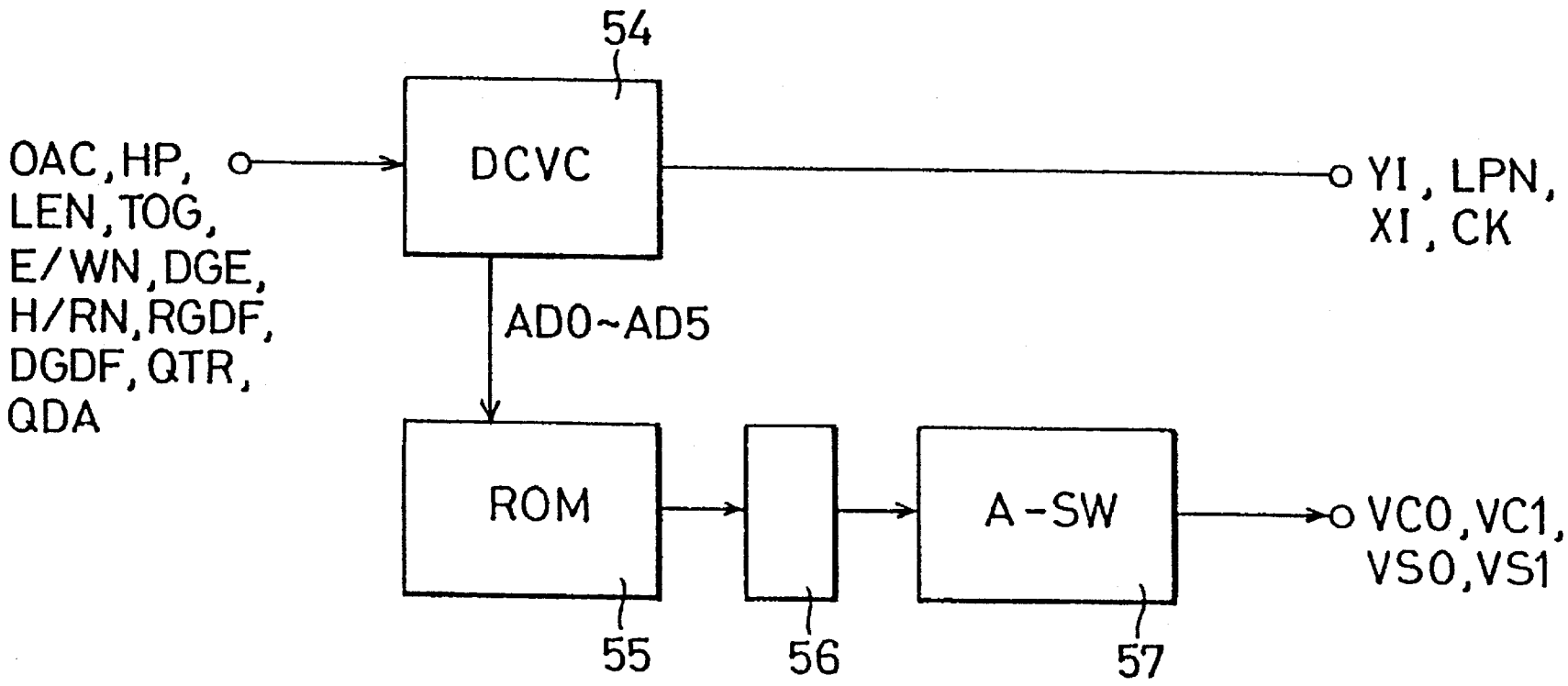
FIG. 32 is a block diagram illustrating a general construction of a driving control circuit in the display control device used in an embodiment according to the present invention.

FIG. 32 is a block diagram showing a general construction of a driving control circuit 35. The driving control circuit 35 comprises a DCVC circuit 54, a read only memory (hereinafter referred to as ROM) circuit 55, a latch circuit 56 and an analog switch array circuit 57.

Figure 33:
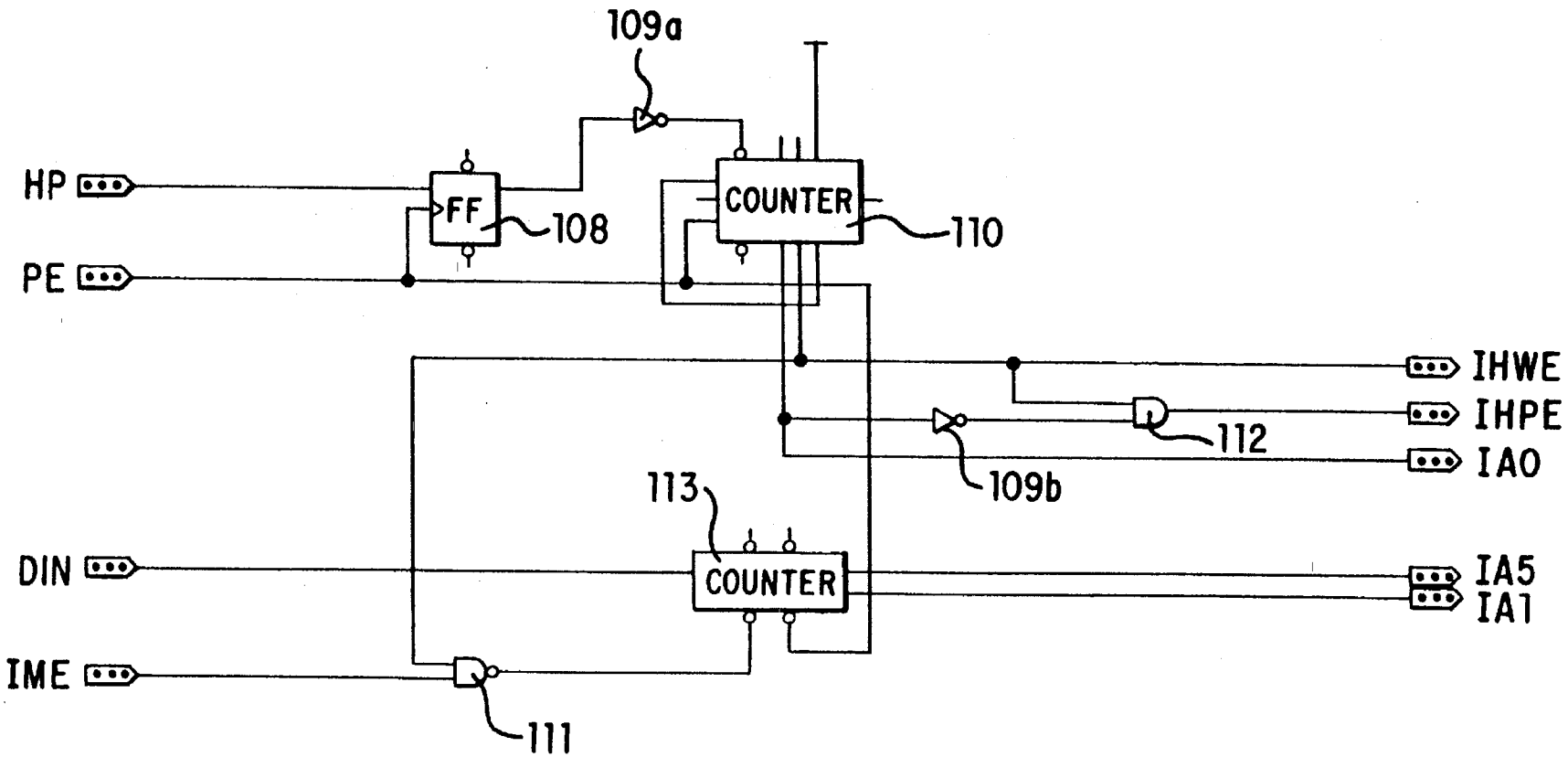
FIG. 33 is a circuit diagram illustrating the construction of an ICHS circuit in the input control circuit of FIG. 27.

Furthermore, a concrete construction of each circuit manufactured for 16×16 pixel FLCD 22. The construction of the: ICHS circuit 36 is shown in FIG. 33. The ICHS circuit 36 comprises one D type flip-flop (hereinafter abbreviated as DFF) 108, two NOT gates 109*a*, 109*b*, one counter 110, one. NAND gate 111, and one AND gate 112.

Figure 34:
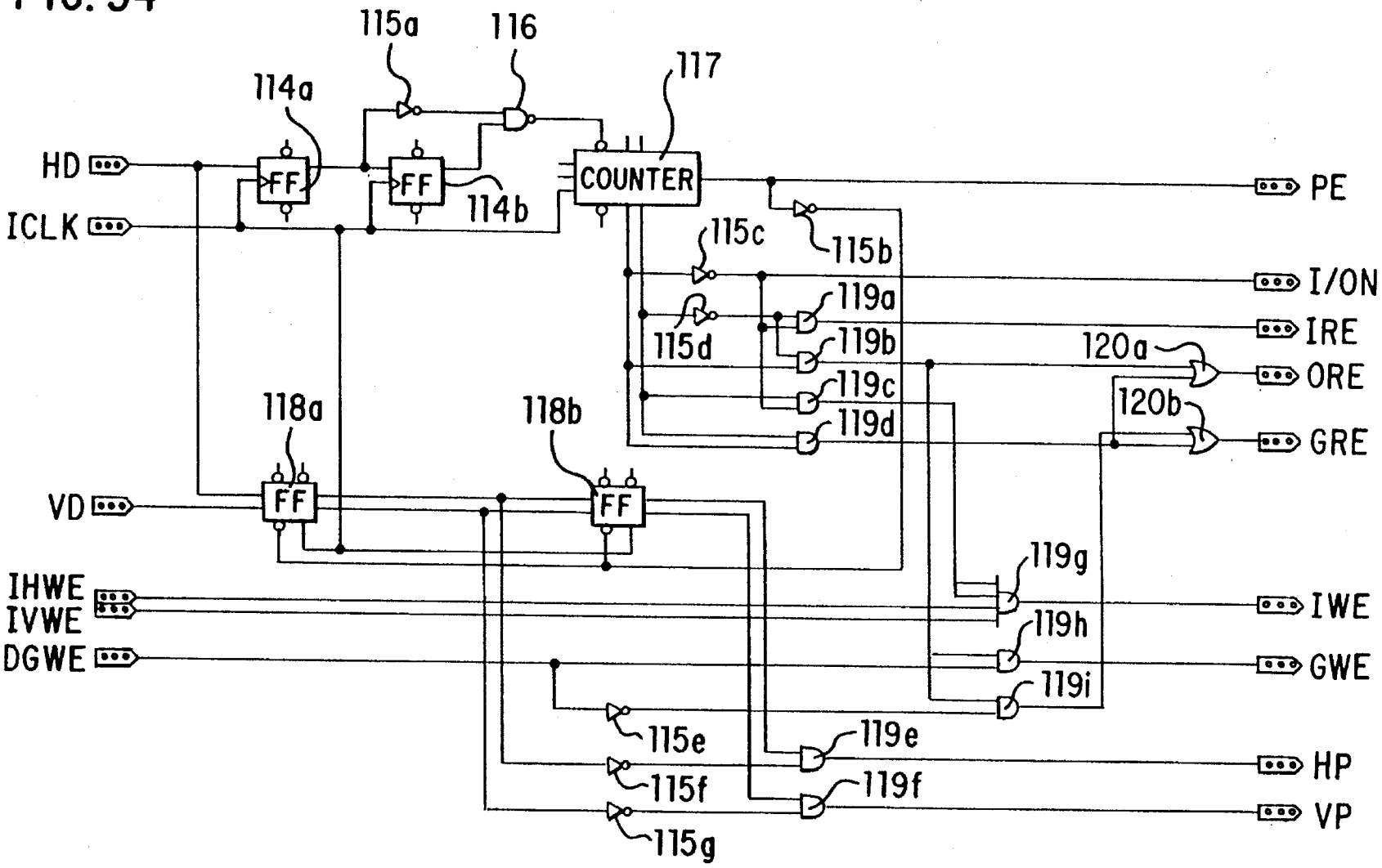
FIG. 34 is a circuit diagram illustrating the construction of the ICIO circuit in the input control circuit of FIG. 27.

The construction of the ICIO circuit 37 is shown in FIG. 34. The ICIO circuit 37 comprises two DFF 114*a*, 114*b*, seven NOT gate 115*a* through 115*g*, one NAND gate 116, one counter 117, two DFF's attached with enable terminal 118*a*, 118*b* (hereinafter abbreviated as EDFF's), nine AND gates 119*a* through 119*i* and two OR gates 120*a*, 120*b*.

Figure 35:
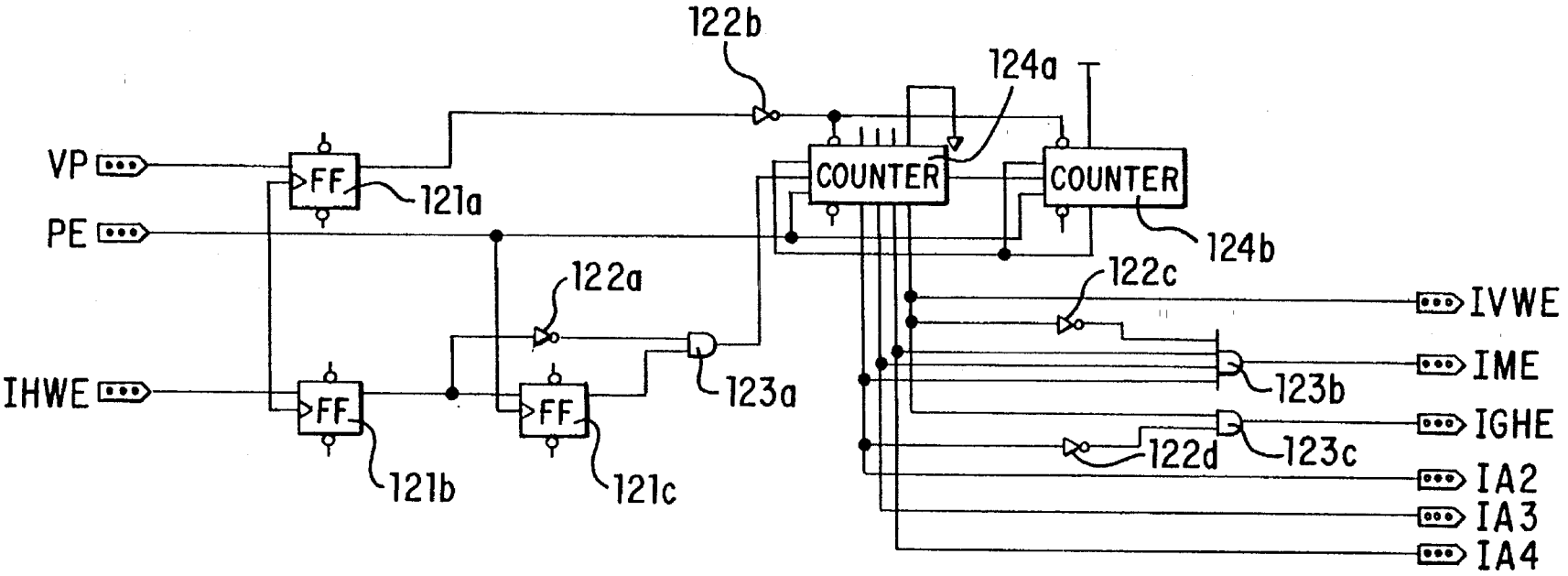
FIG. 35 is a circuit diagram illustrating the construction of an ICVC circuit in the input control circuit of FIG. 27.

The construction of the ICVC circuit 38 is shown in FIG. 35. The ICVC circuit 38 comprises three DFF's 121*a* through 121*c*, four NOT gates 122*a* through 122*d* three AND gates 123*a* through 123*c* and two counters 124*a* through 124*b*.

Figure 36:
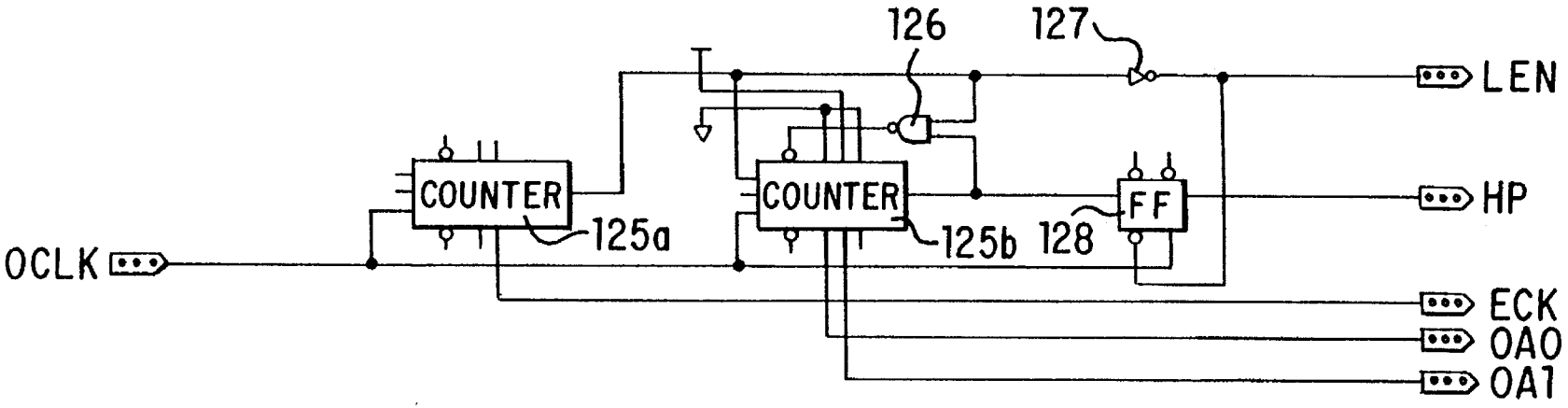
FIG. 36 is a circuit diagram illustrating the construction of an OCHS circuit in an output control circuit of FIG. 27.

The construction of the OCHOS circuit 39 is shown in FIG. 36. The OCHOS circuit 39 comprises two counters 125*a*, 125*b*, one NAND gate 126, one NOT gate 127, and one EDFF 128.

Figure 37:
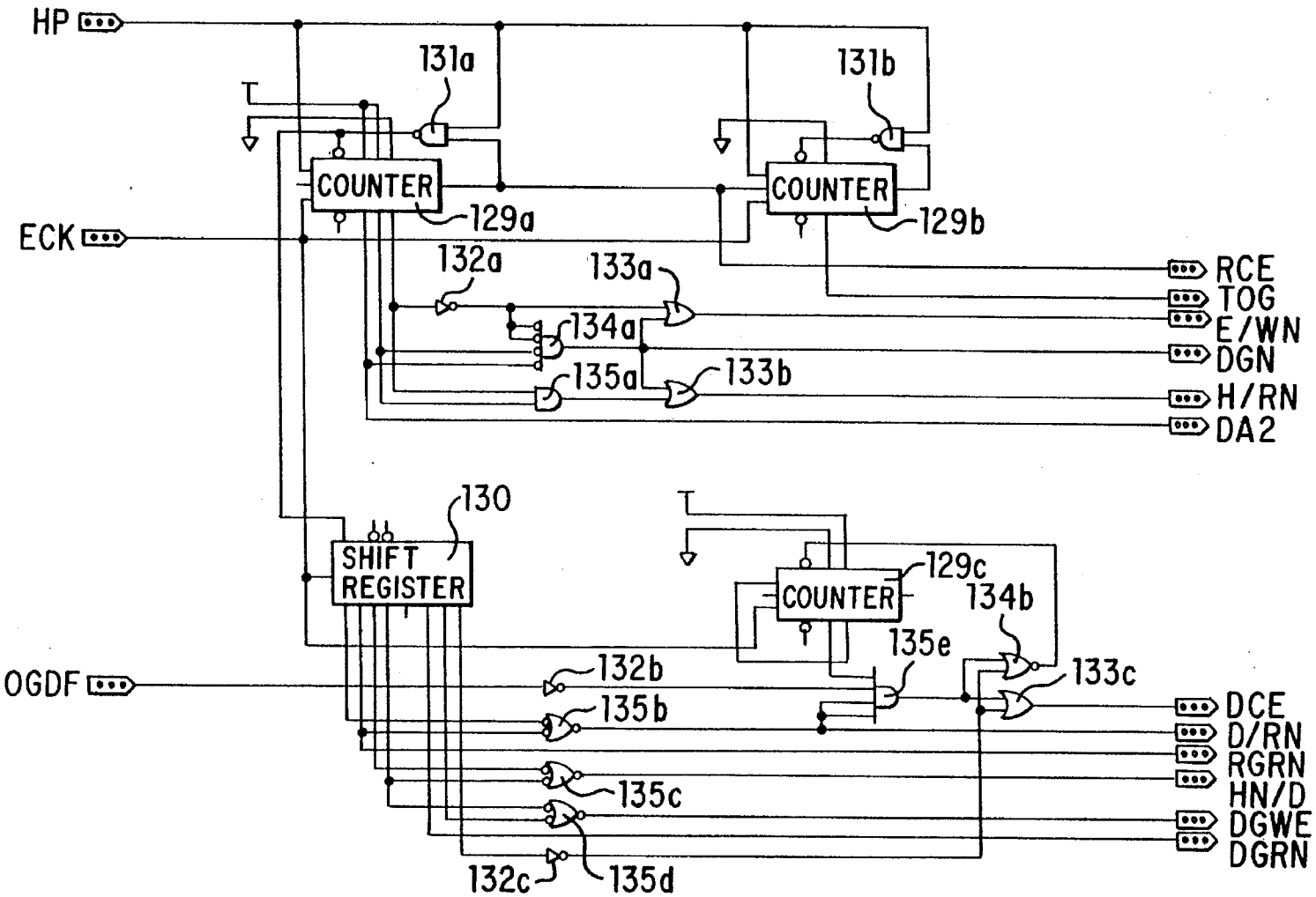
FIG. 37 is a circuit diagram illustrating the construction of an OCGC circuit in the output control circuit of FIG. 27.

The construction of the OCGC circuit 40 is shown in FIG. 37. The OCGC circuit 40 comprises two counters 129*a*, 129*b*, one shift register 130, two NAND gates 131*a*, 131*b*, three NOT gates 132*a* through 132*c*, three OR gates 133*a* through 133*c*, two NOR gates 134*a*, 134*b* and five AND gates 135*a* through 135*e*.

Figure 38:
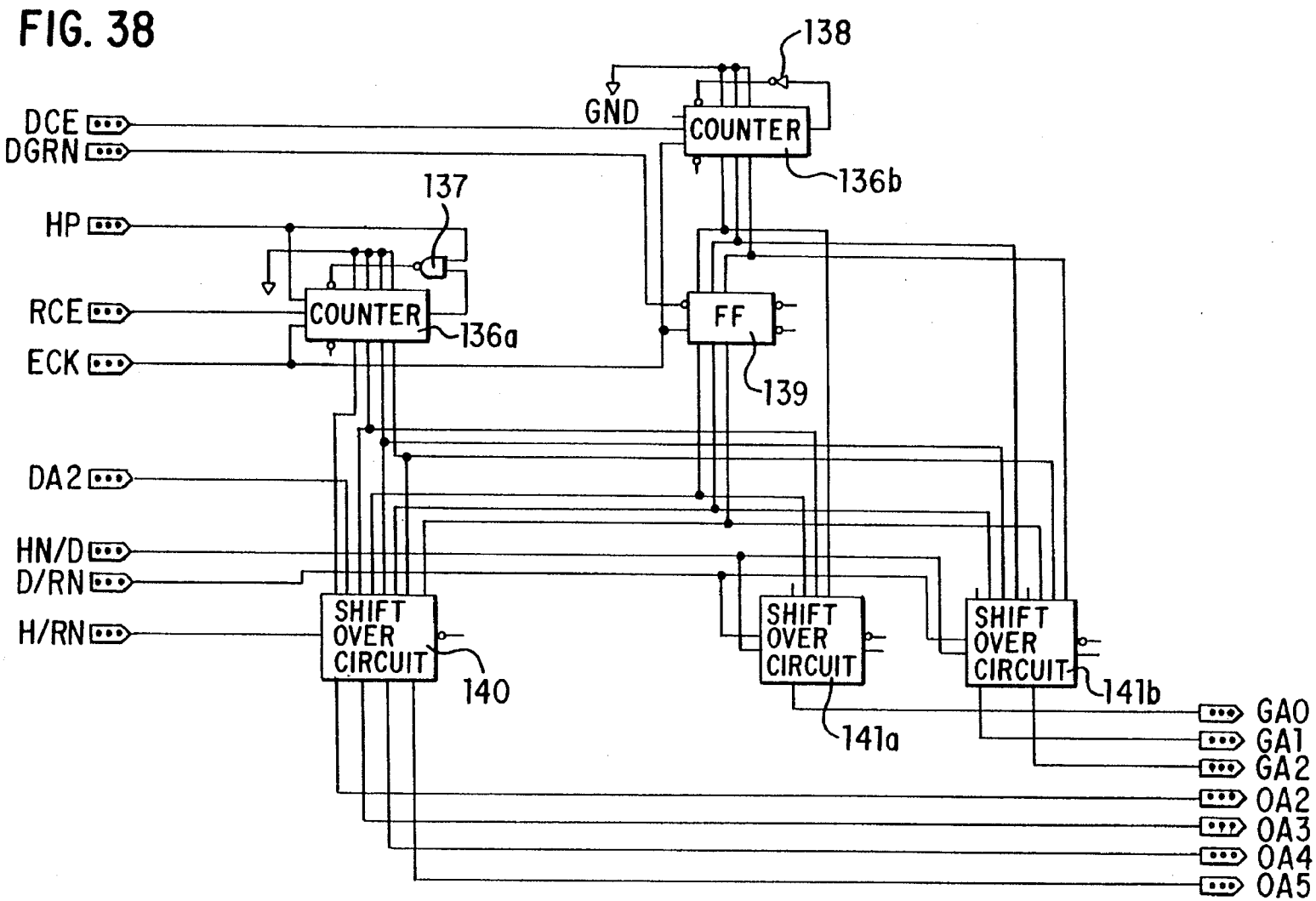
FIG. 38 is a circuit diagram illustrating the construction of an OCVC circuit in the output control circuit of FIG. 27.

The construction of the OCVC circuit 41 is shown in FIG. 38. The OCVC circuit comprises two counters 136*a*, 136*b*, one NAND gate 137, one NOT gate 138, one EDFF 139, one two-input shift-over circuits 140, and two four-input shift-over circuits 141*a*, 141*b*.

Figure 39:
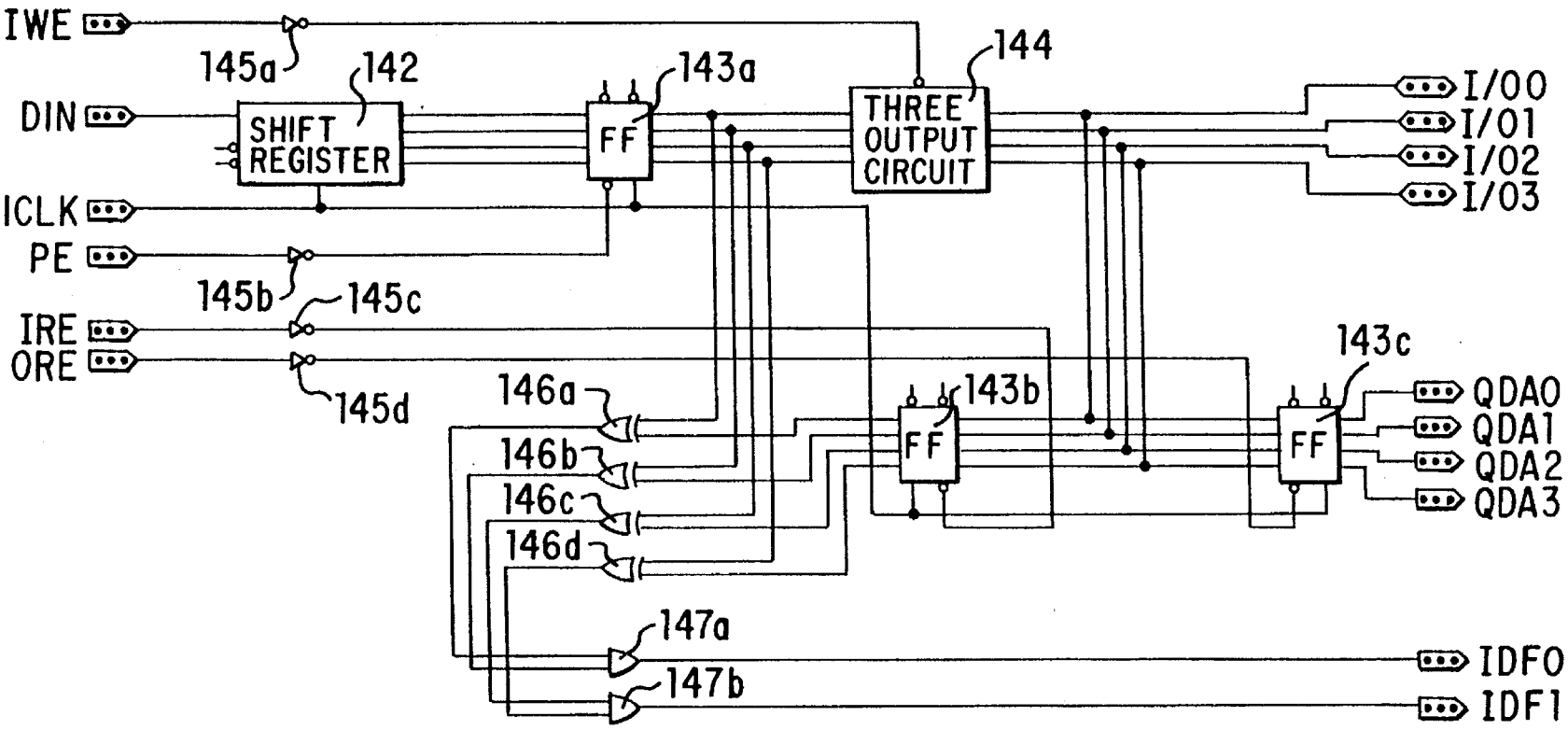
FIG. 39 is a circuit diagram illustrating the construction of the MIN circuit in the data memory circuit of FIG. 29.

The construction of the DMIN circuit 43 is shown in FIG. 39. The DMIN circuit 43 comprises one shift register 142, three EDFF's 143*a* through 143*c*, one three-output circuits 144, four NOT gates 145*a* through 145*d*, four exclusive logic sums (hereinafter abbreviated as XOR gate) 146*a* through 146*d*, and two OR gates 147*a*, 147*b*.

Figure 40:
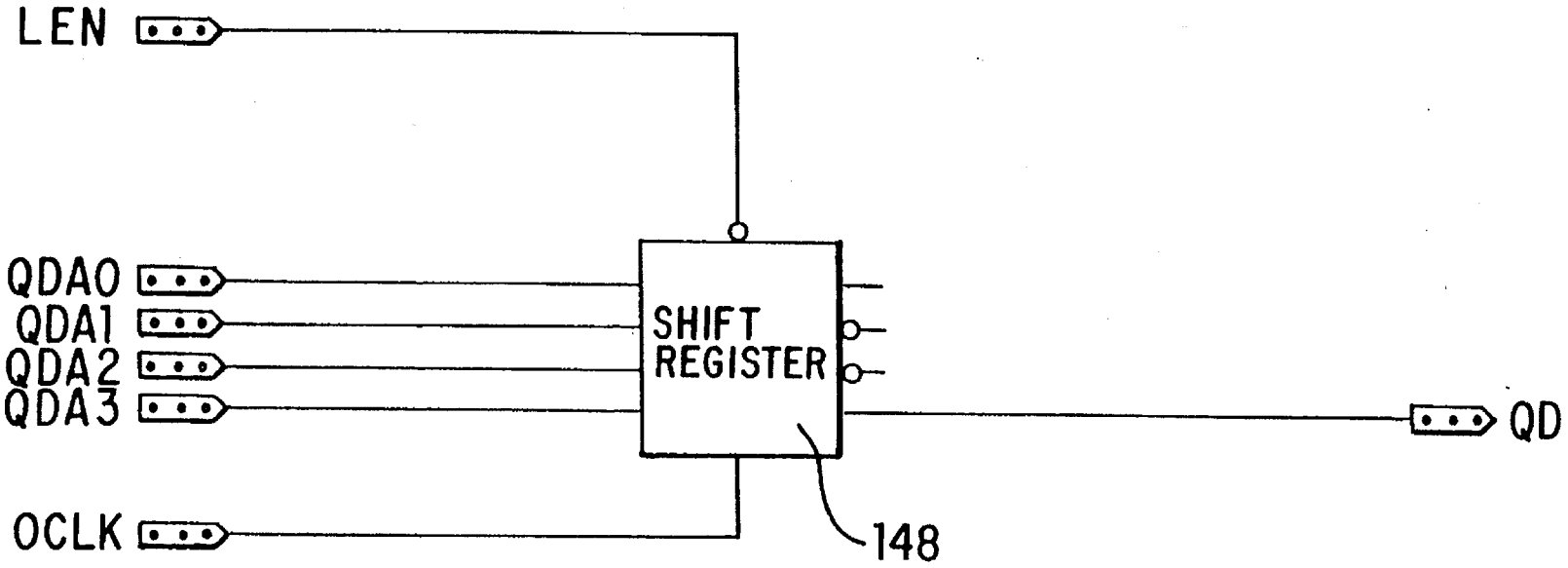
FIG. 40 is a circuit diagram illustrating the construction of the DMOU circuit in the data memory circuit of FIG. 29.

The construction of the DMOUT circuit 45 is shown in FIG. 40. The DMOUT circuit comprises one shift register 148 attached with a load function.

Figure 41:
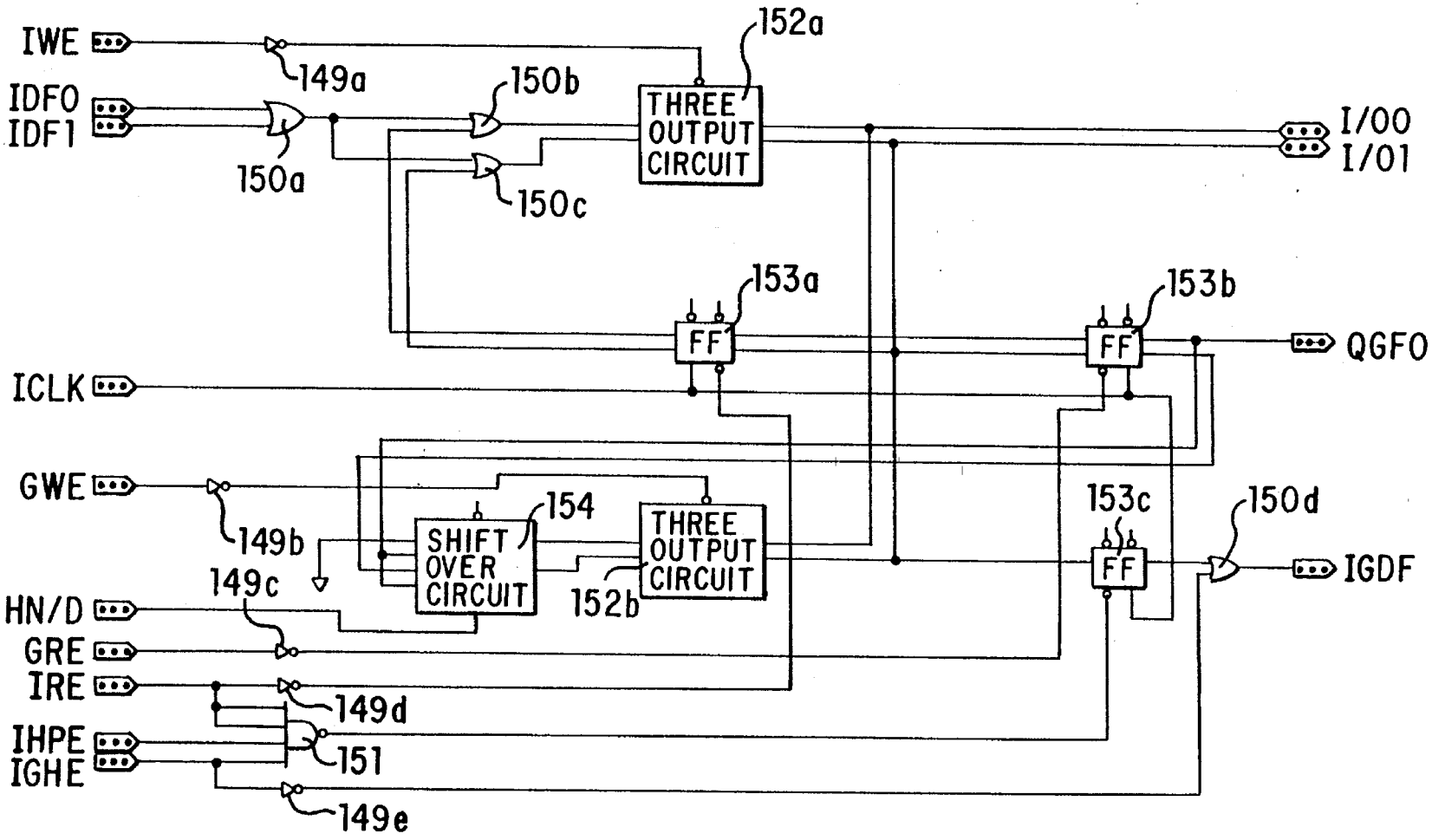
FIG. 41 is a circuit diagram illustrating the construction of the GMIN circuit in a group memory circuit of FIG. 30.

The construction of the: GMIN circuit 47 is shown in FIG. 41. The GMIN circuit comprises five NOR gates 149*a* through 149*e*, four OR gates 150*a* through 150*d*, one NAND gate 151, two three-output circuits 152*a*, 152*b*, three EDFF's 153*a* through 153*c*, one two-input shift-over circuit 154.

Figure 42:
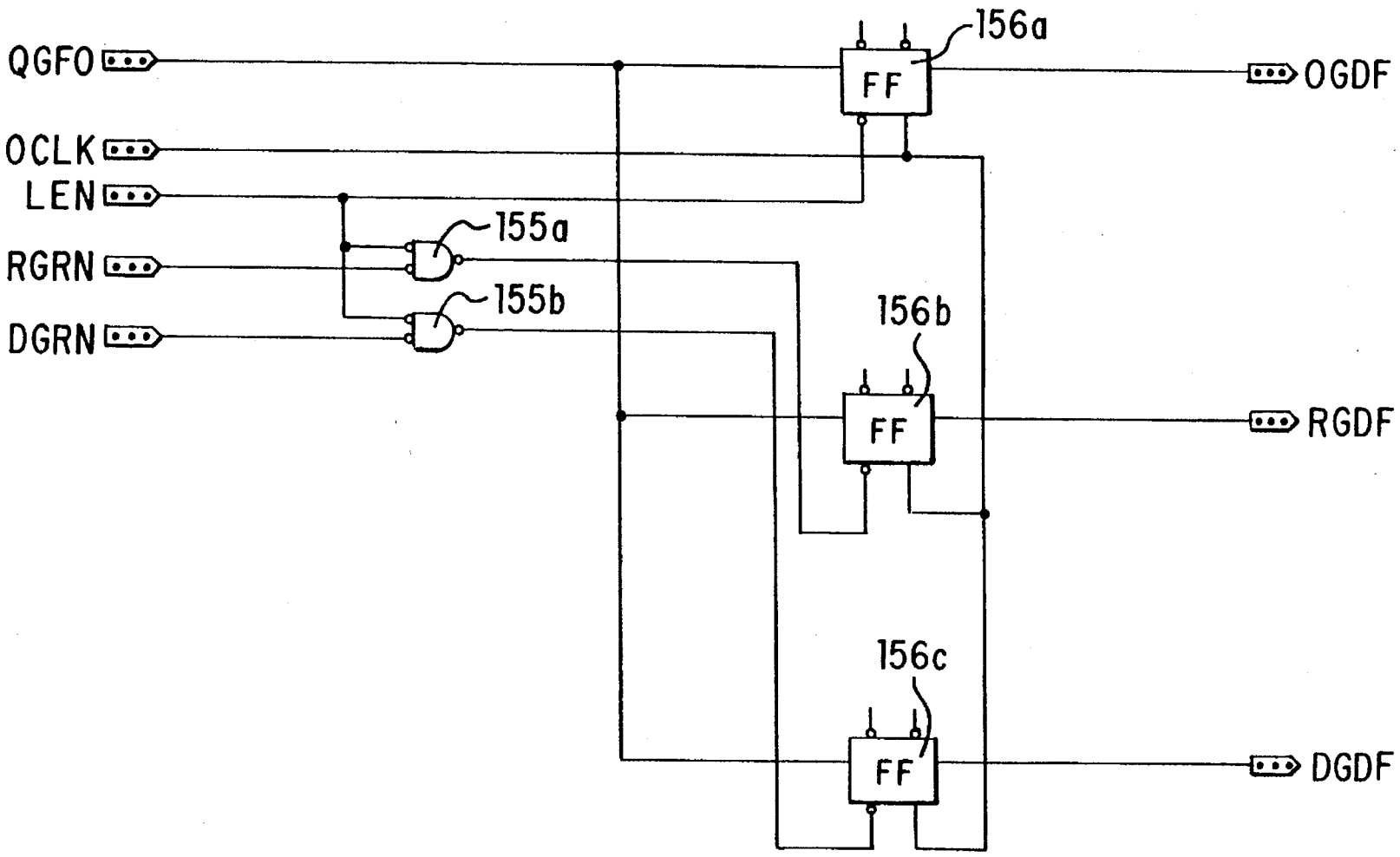
FIG. 42 is a circuit diagram illustrating the construction of the GMOUT circuit in the group memory circuit of FIG. 31.
Figure 43:
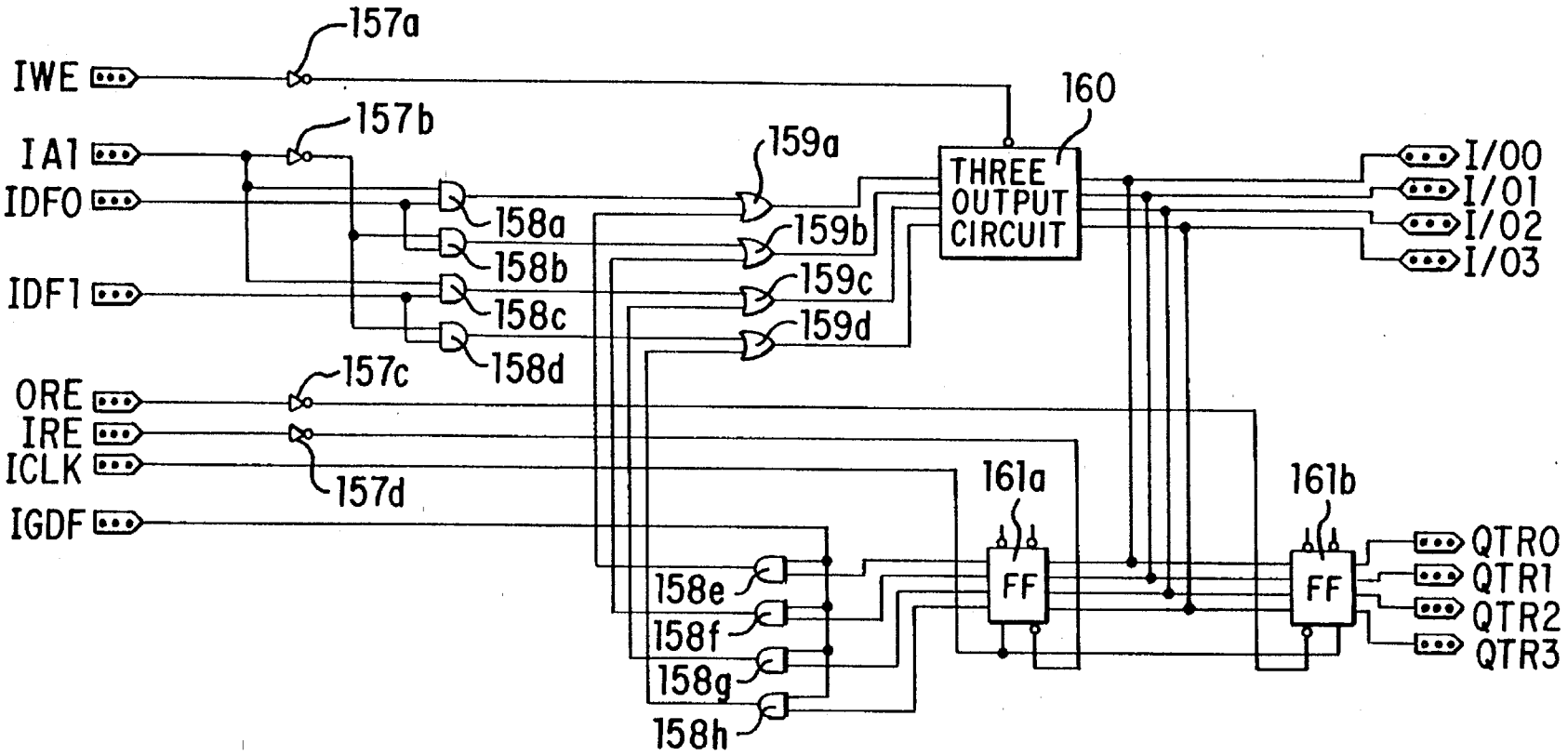
FIG. 43 is a circuit diagram illustrating the construction of the TMIN circuit in the transmemory circuit of FIG. 31.

The construction of the GMOUT circuit 49 is shown in FIG. 42. The GMOUT circuit 49 comprises two OR gates 155*a*, 155*b*, and three EDFF'S 156*a* through 156*c*. The construction of the TMIN circuit 51 is shown in FIG. 43. The TMIN circuit 51 comprises four-NOT gates 157*a* through 157*d*, eight AND gates 158*a* through 158*h*, two OR gates 159*a* and 159*b*, one three-output circuit 160 and two EDFF's 161*a* and 161*b*.

Figure 44:
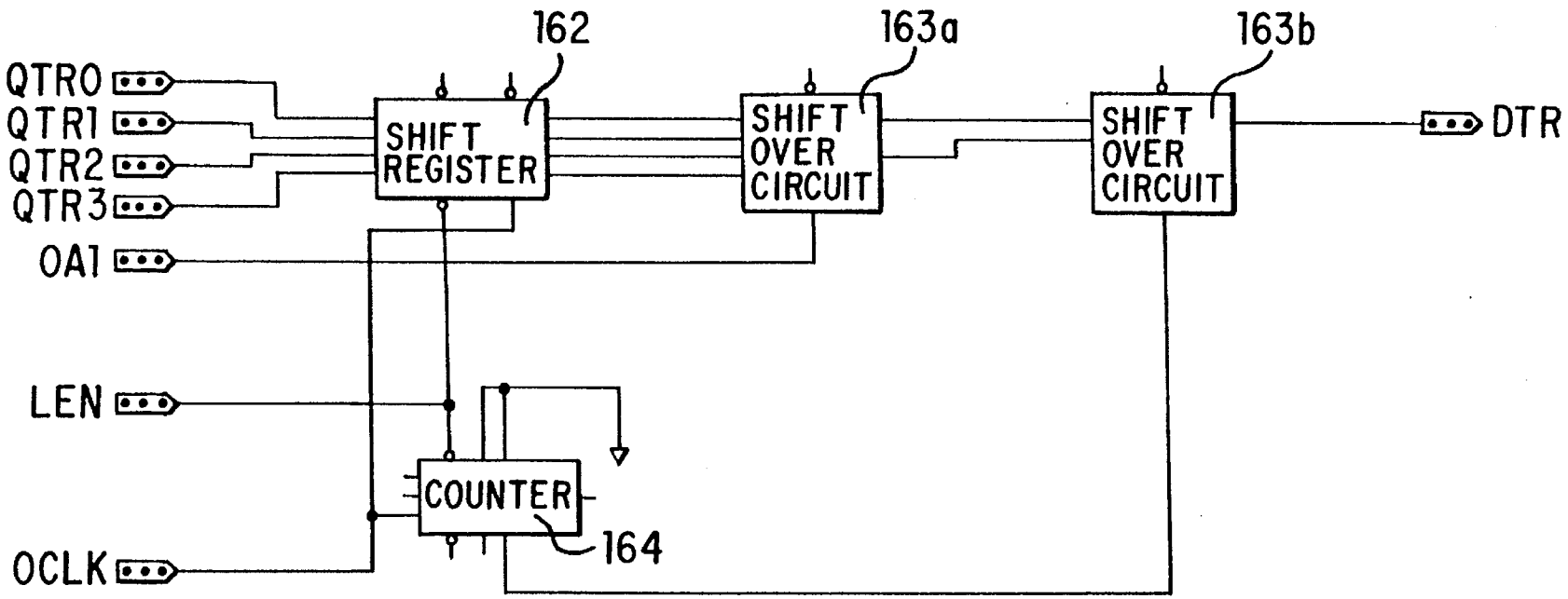
FIG. 44 is a circuit diagram illustrating the construction of the TMOUT circuit in, the transmemory circuit of FIG. 31.

The construction of the TMOUT circuit 53 is shown in FIG. 44. The TMOUT circuit comprises one shift register 162 attached with a load function, two two-input shift-over circuits 163*a* and 163*b* and one counter 164.

Figure 45:
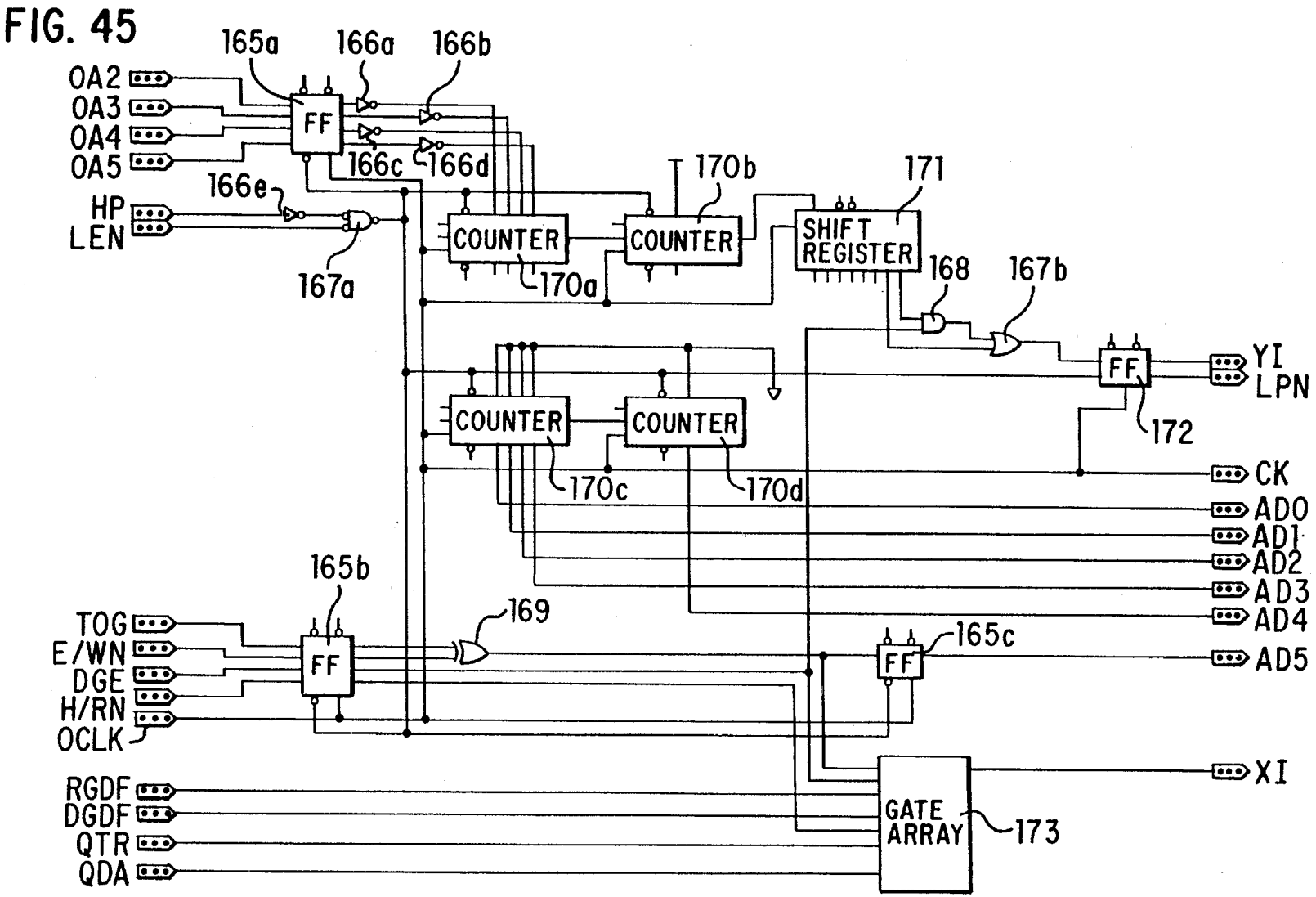
FIG. 45 is a circuit diagram illustrating the construction of the DCVC circuit in the driving control circuit of FIG. 32.

The construction of DCVC circuit 54 is shown in FIG. 45. The DCVC circuit 54 comprises three EDFF 165*a* through 165*c*, five NOT gates 166*a* through 166*e*, two OR gates 167*a* and 167*b*, one AND gate, 168, one XOR gate 169, four counters 170*a* through 170*d*, one shift register 171, one DFF 172 and gate array 173 that satisfies the following logic equation.

| | |
|---|---|
| DATA = | _H/RN × _RGDF × EN/W × QDA + |
| | _H/RN × _RGDF × _EN/W × _QDA + |
| | _H/RN × _QTR × EN/W × QDA + |
| | _H/RN × _QTR × _EN/W × _QDA + |
| | H/RN × DGE × DGDF × QTR + |
| | H/RN × _DGE × DGDF × QTR × EN/W × QDA + |
| | H/RN × _DGE × DGDF × QTR × _EN/W × _QDA |

However, when H/RN assumes the value "1" when H/RN assumes the value "0". RGDF, DGDF and, QTR assume the value "1" in the presence of a variation.

The above embodiments have been described with respect to the FLCB 22 having 16×16 pixels for, simplicity. One transition data item is forced to correspond to 16 pixels composed of 4 scanning electrodes and 4 signal electrodes. Every time four scanning electrodes are partially rewritten, one scanning electrode is interlaced by at a rate of 16:1. Incidentally, in this particular case, four scanning electrodes correspond to one group. However, eight scanning electrodes can correspond to one group.

In addition, when the number of times of repeating the voltage waveforms shown in FIG. 21 and FIGS. 23 through 26 is increased to four times or more and the frequency of the bias waveforms shown by 7) and 8) in each FIG. is heightened, the bistable state of the FLCD will be more perfect since the dielectric anisotropy of the FLCD is negative. As a consequence, a FLCD free-from the failure in the memory state of pixels could be obtained without interlaced scanning.

In accordance with the present invention, when one transition data item corresponds to pixels on the N scanning electrodes, time $T_N$ required for driving the liquid crystal panel for partially rewriting N scanning electrodes using the driving method of the present invention can be described in the following equation when the length of selection time for rewriting pixels on the scanning electrode into one stable state is set to $t_L$;

$$T_N=(1+N)\times t_L \tag{3}$$

Thus time $T_N$ can be made shorter than $T_p$ required for partially rewriting N scanning electrode-using the conventional driving method as shown in the following equation;

$$T_p=2\times N\times t_L \tag{4}$$

The present invention being thus described, it will be obvious that the samemay be valid in many ways. Such variations are not to be regarded as a departure from the spirit and scope of the invention, and all such modification as would be obvious to one skilled in the art are intended to be included within the scope of the following claims.

What is claimed is:

1. A method for driving a ferroelectric liquid crystal panel in which a ferroelectric liquid crystal is disposed between a plurality of scanning electrodes formed on a substrate and a plurality of signal electrodes formed on a opposite substrate and arranged in a direction of running crosswise relative to each other, and either a select voltage or a non-select voltage is selectively applied to the scanning electrodes whereas either a rewriting voltage or a holding voltage is selectively applied to the signal electrodes to change the display of each pixel defined where each scanning electrode and each signal electrode run cross-wise relative to each other, which comprises:

dividing all the scanning electrodes into a plurality of groups comprising a plurality of scanning electrodes;

selecting a group of the scanning electrodes to be changed on display from the divided groups, based on a first display data currently displayed and a second display data to be subsequently displayed; and performing a first and a second scanning processes with respect to the selected group to rewrite the display by the second display data whereas applying the non-select voltage to the other groups to maintain the current display;

the first scanning process comprising:

applying the select voltage to all the scanning electrodes of selected group substantially at once; and applying-the rewriting voltage to the signal electrodes corresponding to the pixels whose displays are to be changed to place in a first stable state the liquid crystal of the pixels whereas applying the holding voltage to the other signal electrodes to place in the current stable state the liquid crystal of the pixels;

the second scanning process comprising:

applying the select voltage to each scanning electrode successively with respect to the group in which the first scanning process is completed; and applying the rewriting voltage to the signal electrodes corresponding to the pixels whose liquid crystal is to be placed in a second stable state whereas applying the holding voltage to the other signal electrodes to place in the current stable state the liquid crystal of the corresponding pixels.

2. A method according to claim 1 wherein the pixel defined between the scanning electrode to which the select voltage is applied and the signal electrode to which the holding voltage is applied is approximately equal to the pixel defined between the scanning electrode to which the non-select voltage is applied and the signal electrode to which either the holding voltage or the rewriting voltage is applied, in transmitted light intensity.

3. A method according to claim 2 wherein the ferroelectric liquid crystal comprises a liquid crystal whose voltage to response rate properties asses the minimum value at a specific voltage; and a positive voltage having an absolute value smaller than the minimum value and a negative voltage having an absolute value larger than the minimum value, or a negative voltage having an absolute value smaller than the minimum value and a positive voltage having an absolute value larger than the minimum value are applied, respectively to the pixel defined between the scanning electrode to which the select voltage is applied and the signal electrode to which the holding voltage is applied.

4. A method according to claim 1, 2 or 3 further comprising the step of periodically applying a voltage to the pixels to maintain the display state of the pixels.

* * * * *